US010925341B2

(12) United States Patent
Sussman et al.

(10) Patent No.: US 10,925,341 B2
(45) **Date of Patent: *Feb. 23, 2021**

(54) DECORATIVE HELMET

(71) Applicant: Pop Up Tops Ltd., London (GB)

(72) Inventors: Adrian Edward Sussman, Brecon (GB); Mark Wayne Plowman, Hartshorne (GB)

(73) Assignee: Pop Up Tops Ltd., London (GB)

( * ) Notice: Subject to any disclaimer, the term of this patent is extended or adjusted under 35 U.S.C. 154(b) by 374 days.

This patent is subject to a terminal disclaimer.

(21) Appl. No.: 15/603,887

(22) Filed: May 24, 2017

(65) Prior Publication Data

US 2017/0347734 A1 Dec. 7, 2017

Related U.S. Application Data

(63) Continuation of application No. PCT/EP2015/077566, filed on Nov. 24, 2015, which
(Continued)

(51) Int. Cl.
*A42B 1/20* (2006.01)
*A42B 1/00* (2006.01)
(Continued)

(52) U.S. Cl.
CPC ..... *A42B 1/208* (2013.01); *A42B 1/004* (2013.01); *A42B 1/201* (2013.01); *B65D 5/02* (2013.01);
(Continued)

(58) Field of Classification Search
CPC ..... A42B 1/208; A42B 1/201; A42B 1/004; A42B 3/00; A42B 3/0406; B65D 5/02;
(Continued)

(56) References Cited

U.S. PATENT DOCUMENTS 2,594,906 A * 4/1952 Gardner ..... A42B 1/208 2/171.01
3,551,911 A 1/1971 Holden
(Continued)

OTHER PUBLICATIONS

Make a Mask(r). Make a Mask and decorate! [online], [retrieved on Nov. 14, 2014]. Retrieved from the Internet <URL:http://www.makeamask.com/pages/hints-tips>.
(Continued)

*Primary Examiner* — Nathan E Durham
*Assistant Examiner* — Abby M Spatz
(74) *Attorney, Agent, or Firm* — Dorsey & Whitney LLP

(57) ABSTRACT

A decorative headgear simulating the appearance of a racing helmet is disclosed. It is in the form of a sheet of thin flexible material. The sheet is shaped and configured with a back panel (BP), a right panel (RP), a left panel (LP), a top panel (TP), a front panel (FP), and a chin cover (CC), all of which are adapted for inter-connection to form the helmet. The sheet has several pre-made lines in the sheet forming in whole or in part the headgear removable from the sheet, and wherein the sheet of thin flexible material has several pre-made fold lines in the sheet, said fold lines oriented to form said sheet into a container to hold other articles.

16 Claims, 45 Drawing Sheets

Related U.S. Application Data is a continuation-in-part of application No. 14/551,593, filed on Nov. 24, 2014, now Pat. No. 9,504,898, and a continuation-in-part of application No. 14/680,368, filed on Apr. 7, 2015, now Pat. No. 9,504,286.

(60) Provisional application No. 62/173,630, filed on Jun. 10, 2015, provisional application No. 62/182,948, filed on Jun. 22, 2015.

(51) Int. Cl.

| | |
|---|---|
| ***B65D 85/00*** | (2006.01) |
| ***B65D 5/42*** | (2006.01) |
| ***B65D 81/36*** | (2006.01) |
| ***B65D 71/36*** | (2006.01) |
| ***B65D 5/02*** | (2006.01) |
| ***A42B 1/208*** | (2021.01) |
| ***A42B 1/004*** | (2021.01) |
| ***A42B 1/201*** | (2021.01) |

(52) U.S. Cl.
CPC ..... *B65D 5/4229* (2013.01); *B65D 5/4266* (2013.01); *B65D 71/36* (2013.01); *B65D 81/363* (2013.01); *B65D 85/70* (2013.01)

(58) Field of Classification Search
CPC .... B65D 5/4266; B65D 81/363; B65D 85/70; B65D 5/4229; B65D 71/36
USPC ..... 2/200, 171, 1, 200.3, 171.1
See application file for complete search history.

(56) References Cited

U.S. PATENT DOCUMENTS

| | | | | |
|---|---|---|---|---|
| 3,917,153 | A | 11/1975 | Holschneider | |
| 4,429,420 | A * | 2/1984 | Wolff | A42B 1/208 2/175.1 |
| D312,915 | S | 12/1990 | Gilfert et al. | |
| 5,214,800 | A | 6/1993 | Braun | |
| 5,328,399 | A | 7/1994 | Reynolds | |
| 5,343,567 | A | 9/1994 | Zumbiel | |
| 5,428,842 | A | 7/1995 | Wise | |
| 5,881,384 | A | 3/1999 | Williams | |
| D417,768 | S | 12/1999 | Siragusa | |
| 6,295,649 | B1 | 10/2001 | Kang | |
| 6,401,258 | B1 | 6/2002 | Wilson | |
| D473,265 | S | 4/2003 | Miska | |
| 6,941,582 | B2 | 9/2005 | Miska | |
| 7,536,731 | B1 | 5/2009 | Feldman | |
| D651,355 | S | 12/2011 | Schwabe et al. | |
| D693,994 | S | 11/2013 | Brown | |
| D699,020 | S | 2/2014 | Caird | |
| D735,448 | S | 8/2015 | Caird | |
| D743,674 | S | 11/2015 | Caird | |
| D748,378 | S | 2/2016 | Caird | |
| 2005/0050617 | A1 | 3/2005 | Moore, III et al. | |
| 2011/0197407 | A1* | 8/2011 | McCabe | A44B 17/0023 24/700 |
| 2014/0150164 | A1 | 6/2014 | Lucier | |

OTHER PUBLICATIONS

Make a Mask(r). NFL helmet style masks [online], [retrieved on Nov. 14, 2014]. Retrieved from the Internet <URL:http://www.makeamask.com/pages/nfl-helmet-style-masks>.
Photograph of other's rally helmet taken Jul. 2014.

* cited by examiner

DECORATIVE HELMET

CROSS-REFERENCE TO RELATED APPLICATION

This application is a continuation of PCT Application No. PCT/EP2015/077566 filed Nov. 24, 2015, which claims the benefit of U.S. Ser. No. 14/551,593 filed Nov. 24, 2014; U.S. Ser. No. 14/680,368 filed Apr. 7, 2015; U.S. Provisional Application No. 62/173,630 filed Jun. 10, 2015, and U.S. Provisional Application No. 62/182,948 filed Jun. 22, 2015, which are hereby incorporated by reference.

BACKGROUND OF THE DISCLOSURE

The present invention relates to decorative headgear, and more specifically to decorative headgear simulating the appearance of a sports helmet (e.g., an American-football helmet, baseball helmet, hockey helmet or a motor-racing helmet) and/or a fictional/non-fictional character.

Sports are immensely popular. American football, for example, is played by the NFL, many colleges, high schools and otherwise. Many fans enjoy showing their support for a particular sports team by wearing jerseys and other indicators of affiliation. While perhaps the most iconic piece of equipment for American-football is its helmet, such helmets are expensive, heavy, and cumbersome, and accordingly have limitations on fan use and/or distribution to fans.

Various foldable headgear has existed. A mask like a football helmet offered by MakeAMask (www.makeamask-.com) includes two metal fasteners to hold together a series of strips radiating from such fasteners to the rear and back half of the head. Headgear shown in U.S. Pat. No. 6,941,582 B2 has a novelty head covering with mirror image sides of a football helmet joined along a fold line at the front and over an integral facemask. There remains, however, a desire for improvement in this field.

The present invention seeks to provide a decorative headgear that simulates the appearance of an American-football helmet, a motor-racing helmet, and/or a fictional/non-fictional character while doing so in a manner that is amenable to low costs, compact packing and shipping volume, and easy assembly.

SUMMARY OF THE DISCLOSURE

The claims, and only the claims, recite the invention. According to the present disclosure there is provided a headgear apparatus comprising a sheet of flexible material forming a top panel joined to a top edge of a back panel, the back panel comprising a top edge, a right edge, a left edge and a bottom edge distal from the top edge, wherein the bottom edge extends further in a lateral direction than the top edge, the apparatus further comprising a right side panel extending from the right edge of the back panel and a left panel extending from the left edge of the back panel, wherein the apparatus has an initial configuration and an erected configuration and includes attachment means arranged to attach the side panels to the top panel in only the erected configuration. With the bottom of the edge of the back panel distal from the top panel being wider than the edge adjoining the top panel, the side panels being attached to the top panel in only the erected configuration, the headgear can form a helmet-like structure that can be simply assembled from a generally planar blank and yet provide the dome-like appearance of a helmet. Normally the headgear will have panels that, in the erected configuration are arranged to essentially surround the head of a person wearing the headgear. Although this can be achieved with just two side panels, the apparatus will often be formed with one or more further left side panels extending from a left edge of the adjacent left side panel and one or more further right side panels extending from a right edge of the adjacent right side panel, wherein the attachment means is arranged to attach the further side panels to the top panel in only the erected configuration. Some or all of the side panels comprise a top edge, a right edge, a left edge and a bottom edge distal from the top edge, wherein the bottom edge extends further laterally than the top edge in order to assist in providing the desired shape and rigidity to the erected configuration.

Often the side edges of all or some of the side panels and back panel are curved. The lateral distance between the left edge and right edge of some or all of the side panels and back panel is greatest at a line intermediate the top edge and the bottom edge of the respective panel, and optionally wherein the back panel either narrows between the line and the bottom edge, or remains the same width. In which case, some or each side panel is joined to the adjacent side or back panel only between the line of greatest lateral distance and the respective bottom edge. These features further assist in providing a three dimensional structure due to the overlap/interference between the edges of adjacent panels in the erected configuration. Generally, the back and side panels are shaped to cooperate in the erected configuration to provide rigidity to the erected configuration. The cooperation may be abutment and/or interference along the adjacent side edges. In order to provide strength to the rear of the apparatus in the erected configuration, a lower back panel may extend from the lower edge of the back panel, the lower back panel being arranged to fold back over the surface of the back panel in the erected configuration.

In some embodiments, a lower front panel joins two side panels and/or is connected to the top panel in the erected configuration. In which case, the lower front panel may extend from the bottom edge of the front panel or from one of the said two side panels joined in the erected configuration. The lower front panel, in the erected configuration, may take the form of a visor or grill, and will often be provided as a separate part from the rest of the headgear in the initial configuration and only joined to the apparatus in the erected configuration. The initial configuration is normally substantially planar as this is a very convenient way to sell the headgear apparatus of the invention. In which case, the panels that are joined together in the initial configuration are normally joined along fold lines along the, or part of the, respective edges to minimize the number of independent parts. This reduces the chance of the user losing parts and can assist in the construction of the erected configuration as the number of possible orientations is reduced compared to a number of independent pieces.

The attachment means is generally provided as a tab on one panel and a corresponding slit on another panel where the one panel and the another panel are to be joined in the erected configuration. This provides a simple and reliable fixing method that can be implemented in a very cost-effective manner. In which case, the attachment means may comprise a tab and corresponding slit for each panel joined only in the erected configuration, though in some instances, more than one tab may be desired for the joining of particular panels.

The erected configuration is normally three dimensional and the shapes of the various panels are chosen to give the desired visual image and also to provide the necessary strength and rigidity to the erected configuration.

The top panel is often substantially circular, ovoid, rectangular, pentagonal, hexagonal, heptagonal, octagonal, nonagonal, decagonal or other polygon. The top panel includes a front panel which maybe integral therewith. Even if the front panel is integral with the top panel, the front panel will not normally be considered when describing the shape of the top panel. The apparatus will, in some embodiments, further comprise instructions that detail the actions to transfer the apparatus from the initial configuration to the erected configuration printed on to a surface of one of the panels. In this way, the user will always have the instructions to hand, even if packaging or other materials become separated from the apparatus. For example, where the apparatus is provided as part of a container for beer, the beer may be consumed at a sports venue, but the apparatus kept after the match and used again at another match. In such circumstances, it is useful if the apparatus can be put back in the initial configuration as it is easier to store and transport.

In many embodiments, the apparatus in the erected configuration simulates the appearance selected from:

a) a helmet;

b) sports headgear, wherein the sport is selected from the group comprising American football, baseball, motor-racing, motorcycle racing and ice-hockey; and/or c) a fictional or non-fictional character.

In one aspect of the invention, the apparatus is in the form of a single paper blank, except optionally the lower front panel may be a separate component. This is a very economical way of providing the apparatus, both in relation to production and shipping costs. The sheet will normally comprise paper or paper-based material such as carton board, which may be coated and/or printed. The sheet may be printed, coated or laminated with a polymer.

One way to provide a marketing tool is to provide a container comprising the apparatus in the initial configuration. The container may comprise a foodstuff container, e.g. a box of beer, wherein the headgear apparatus comprises part of the walls of the container. In which case, the headgear apparatus is separable from the container.

According to a second aspect of the present invention, there is provided a method for forming the erected configuration of the apparatus according to the first aspect of the invention, wherein the method comprises:

a) folding the back panel down in relation to the top panel, and b) connecting each side panel to the top panel and/or the front panel in order to form the erected configuration. The method may further comprise the initial step of separating the apparatus from the rest of the container if provided as part thereof, and/or the apparatus is deployed from a blank.

In certain aspects, the present disclosure teaches headgear formed from a sheet of thin flexible material. In some instances, the present disclosure provides a combination container and headgear formed of a common sheet of thin flexible material.

As mentioned above, the headgear apparatus may comprise a decorative headgear simulating the appearance of an American-football helmet, a motor-racing helmet, and/or a fictional/non-fictional character. It is made from one or more sheets of thin flexible material. The sheets are shaped and configured with a back panel, a right panel, a left panel, a top panel, a front panel, and a facemask, all of which are adapted for inter-connection to form the helmet. The side panels may comprise sub-panels, and their edges may converge bottom to top. Those may be connected to the top panel by connectors, which maybe reversible connectors, so that the apparatus can substantially revert to the flat configuration. Indicia, such as sports team indicia (e.g., football team indicia or racing indicia such as the driver/rider name, number or a sponsor's name/logo) may be on the sides of the headgear (e.g., helmet).

Further forms, objects, features, aspects, benefits, advantages, and embodiments of the present invention will become apparent from a detailed description and drawings provided herewith.

BRIEF DESCRIPTION OF THE ILLUSTRATED EMBODIMENTS

Figure 1:
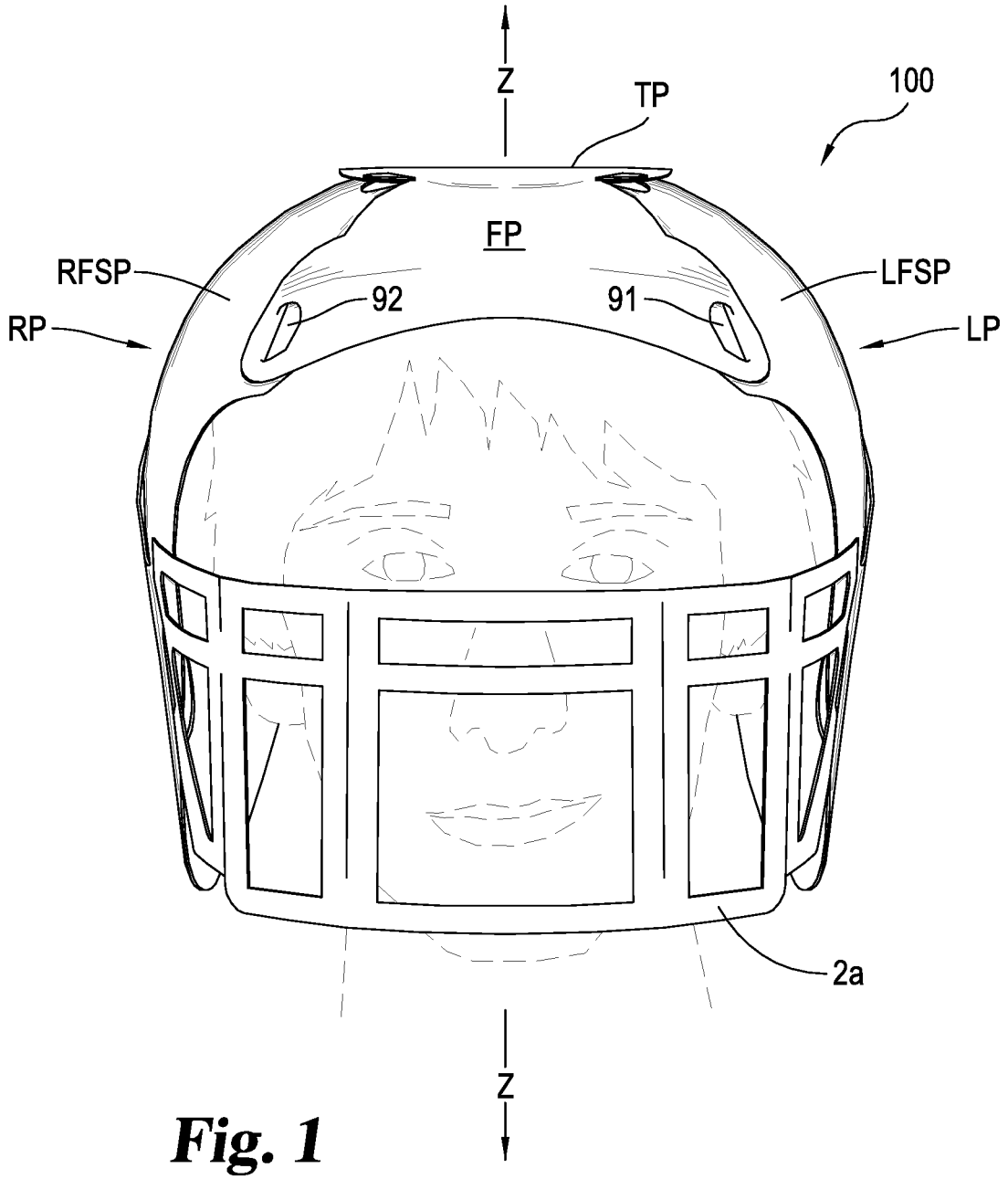
FIG. 1 is a front elevation view of one example of the present invention assembled in three dimensions to form a decorative headgear simulating and American-football helmet.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. Embodiments of the invention are shown in great detail, although it will be apparent to those skilled in the relevant art that some features that are not relevant to the present invention may not be shown for the sake of clarity. However, features shown in respect to one embodiment of the invention are combinable with each and every other described feature unless the respective features are technically incompatible.

Figure 8:
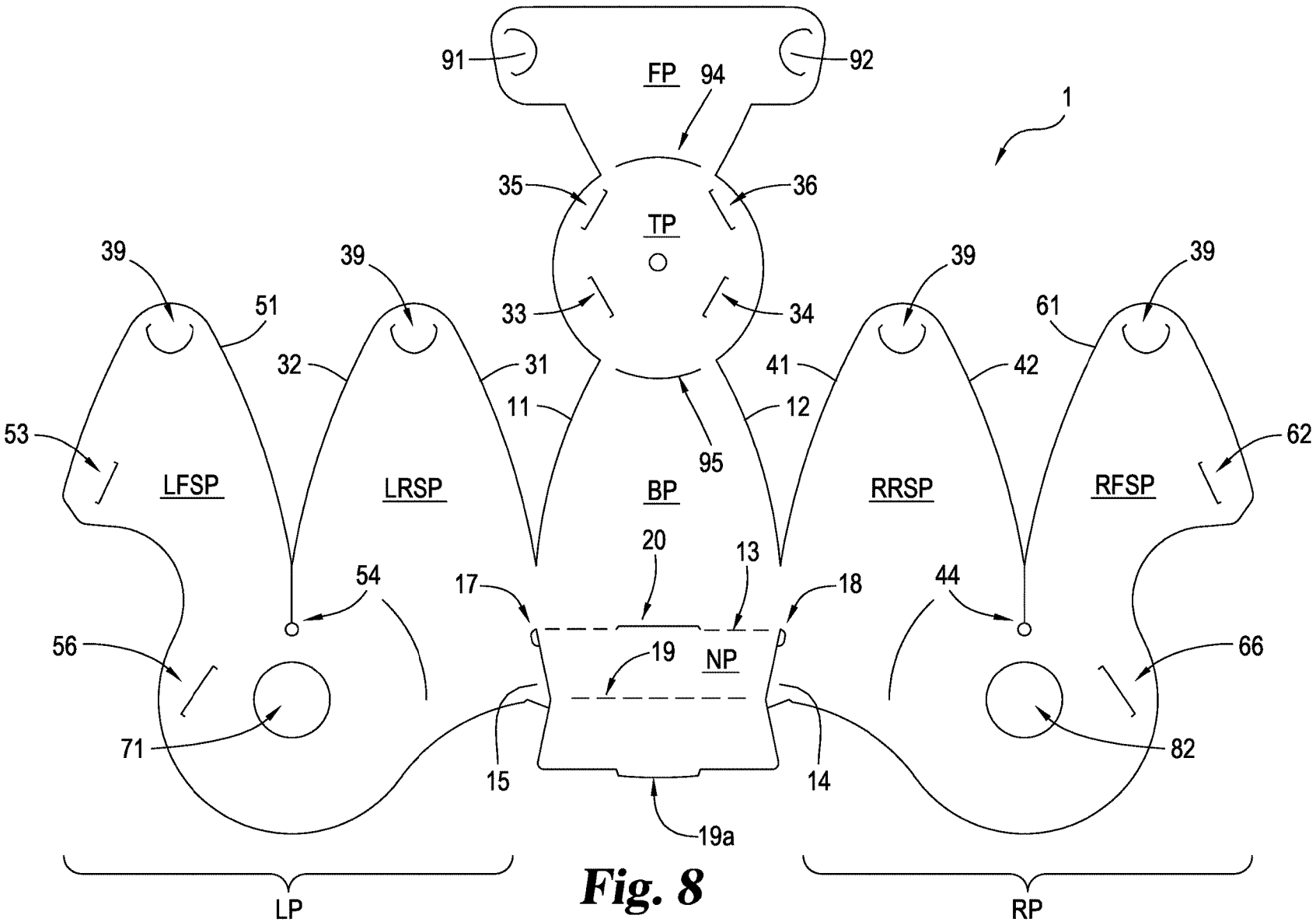
FIG. 8 is a top plan view of a helmet blank or sheet in two dimensions for making the example of FIG. 1.

With reference to the Figures, for example FIGS. 1-7, decorative headgear 100 is shown simulating the appearance of an American-football helmet. FIG. 8 shows an example of a sheet 1 used to make headgear 100. FIGS. 1-7 also form an ornamental design, depicted on a wearer shown in phantom lines. The headgear is made from one or more sheets, such as a helmet sheet with face mask or a helmet sheet 1 with a separate facemask sheet 2*a*, 2*b* (shown in FIGS. 9A and 9B, respectively). They are shown in two dimensions in FIGS. 8, 9A and 9B, and assembled in three dimensions in FIGS. 1-7 and 10. Other shapes, sizes (e.g. adult, youth; small, medium, large, etc.) and proportions consistent with this written description are also contemplated.

For example with the helmet sheet 1 of thin flexible material, the helmet sheet is shaped to comprise several panels. These may include subpanels, such as two or three subpanels making up each of the left and right panels.

The designation between panels and a subpanels is arbitary and is purely for the sake of explanation. As the illustrated example shows in FIG. 8, the helmet sheet may include a back panel (BP), the BP partially defined by a BP-right generally vertical edge 12 and a BP-left generally vertical edge 11, wherein in two-dimensions the two BP vertical edges converge towards each other bottom to top. The helmet sheet may also have a right panel (RP), wherein the RP in two-dimensions comprises a right rear sub-panel (RRSP), the RRSP integral with the BP below the BP-right generally vertical edge 12, the RRSP partially defined by a RRSP-leading generally vertical edge 42 and a RRSP-trailing generally vertical edge 41, wherein the two RRSP vertical edges converge towards each other bottom to top; and a right front sub-panel (RFSP), the RFSP integral with the RRSP below the RRSP-leading generally vertical edge 42, the RFSP partially defined by a RFSP-trailing vertical edge 61, wherein the RFSP trailing generally vertical 61 edge diverges away from the RRSP-leading generally vertical edge 42 bottom to top. The RRSP and RFSP could alternatively be considered to be two right side panels.

Likewise, on the other side, sheet 1 may include a left panel (LP), wherein the LP in two-dimensions comprises: a left rear sub-panel (LRSP), the LRSP integral with the BP below the BP-left generally vertical edge 11, the LRSP partially defined by a LRSP-leading generally vertical edge 32 and a LRSP-trailing generally vertical edge 31, wherein the two LRSP vertical edges converge towards each other bottom to top; and, a left front sub-panel (LFSP), the LFSP integral with the LRSP below the LRSP-leading generally vertical edge 32, the LFSP partially defined by a LFSP-trailing generally vertical edge 51, wherein the LFSP trailing vertical edge 51 diverges away from the LRSP-leading generally vertical edge 32 bottom to top. The LRSP and LFSP could alternatively be considered to be two left side panels. Optionally, but preferably, the left panel and right panel are symetric.

Sheet 1 preferably has a top panel (TP), and a front panel (FP), the FP located above a wearer's eyes. Preferably, the FP integral with only one of the group consisting of: TP, RFSP and LFSP.

Figure 9A:
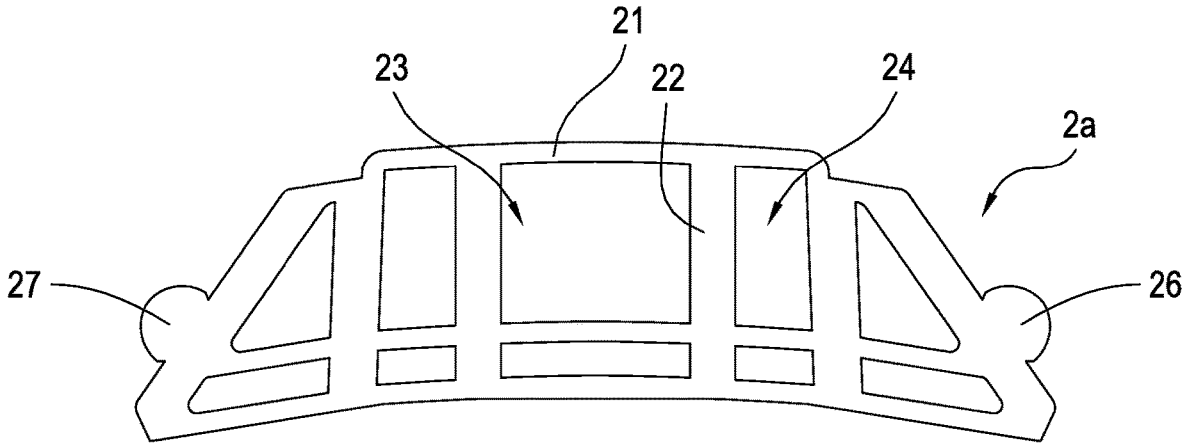
FIG. 9A is a top plan view of a facemask blank or sheet in two dimensions for making the example of FIG. 1.
Figure 9B:
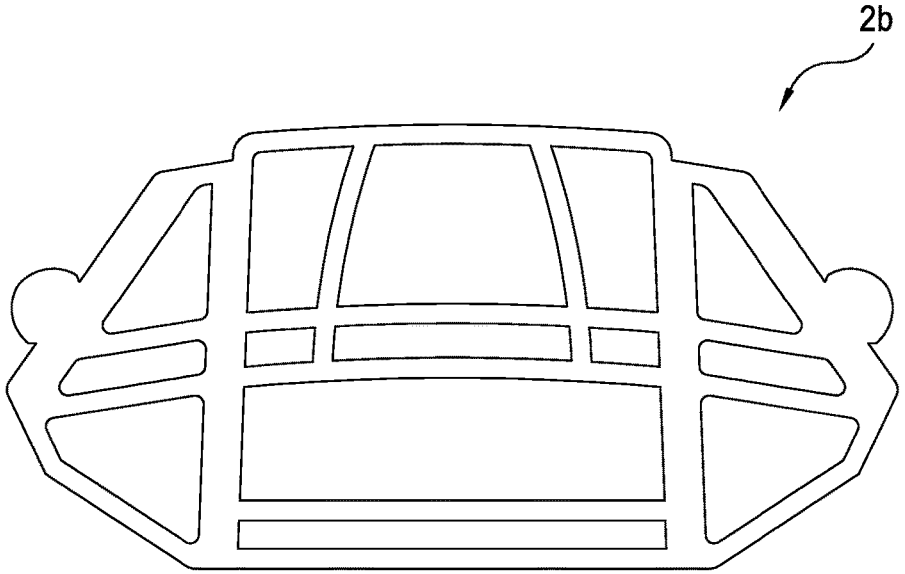
FIG. 9B is an alternative of the facemask of FIG. 9A.
Figure 10:
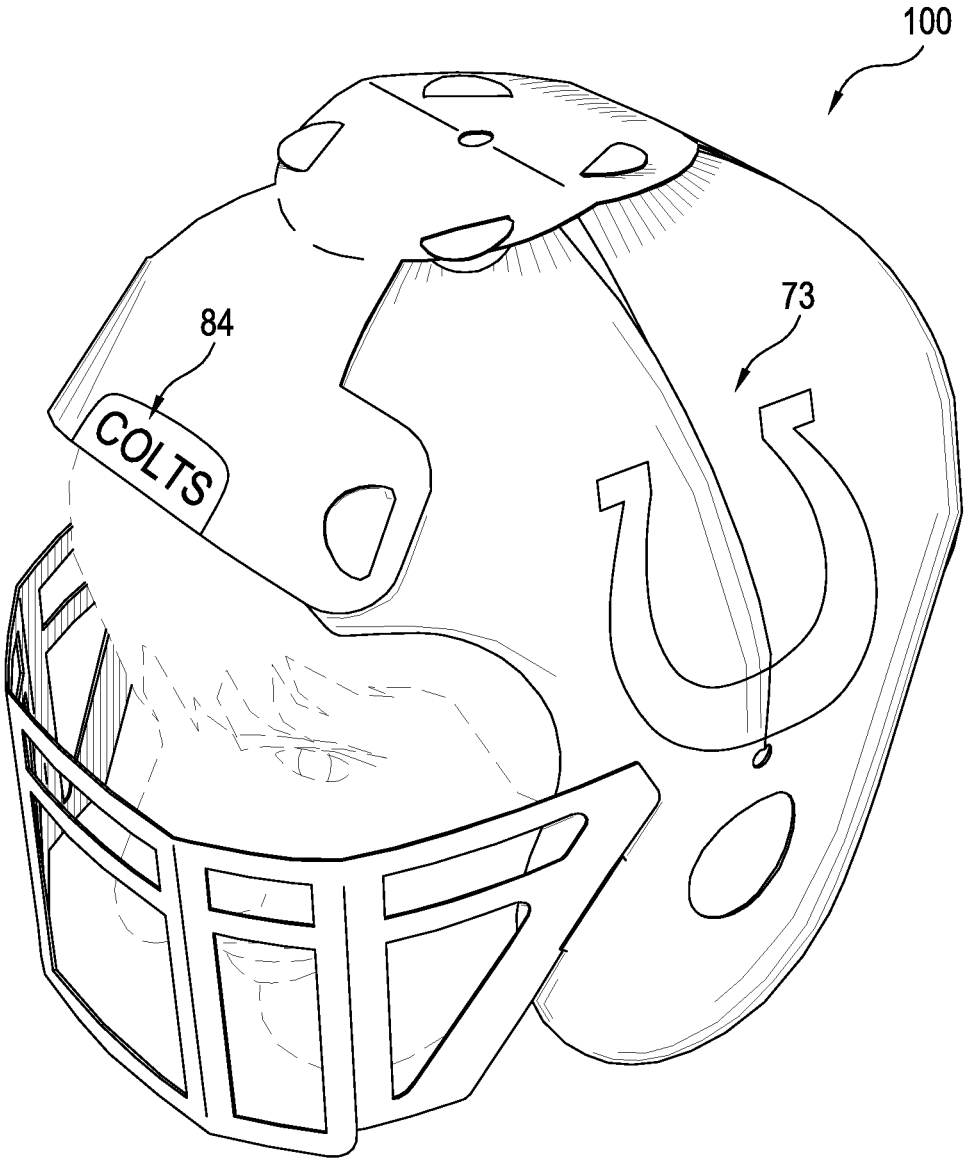
FIG. 10 is a top-front perspective view of the example of FIG. 7 with indicia added.

One or more facemask(s) 2*a* and/or 2*b* (for example) (FM) simulating an American-football helmet facemask with bars, such as bars 21, 22 and gaps, such as gaps 23, 24 between the bars are provide (see e.g. FIG. 9A). The facemask may be separate from or integral with helmet sheet 1. Optionally, but preferably, FM is a sheet of thin flexible material separate from the helmet sheet, and wherein the FM has at left and/or right sides thereof one or more slit/tab interface 27, 26 adapted for connection respectively with a slit/tab interface 66 on the RFSP and with a slit/tab interface 56 on the LFSP.

The helmet sheet 1 is, at least on an exterior surface thereon, made primarily of thin sheet plastic. Likewise, the sheet(s) making up the facemask may be of similar material. This may include plastic sheet(s), or a laminate with a plastic sheet layer on the outside (or both sides) and some other material(s) (e.g. cardboard, paper, photopaper, foil and/or otherwise) on the opposite side or in the interior. Such materials optionally may be in lieu of such plastic. With a plastic outer layer, it may be generally clear with printed colors and printed indicia on a layer under such clear plastic or on an inner surface of the plastic. Or the plastic may colored, opaque or otherwise, with or without printing thereon.

The headgear 100 optionally, but preferably, has the BP-right generally vertical edge 12 and the RRSP-trailing generally vertical edge 41 each curvilinear, such that when the headgear is assembled in three-dimensions has an edge variance 200 (see e.g. FIG. 4) not exceeding 10 millimeters; and, on the other side the BP-left generally vertical edge 11 and the LRSP-trailing generally vertical edge 31 are each curvilinear, and again when the headgear is assembled in three-dimensions has an edge variance 201 (see e.g. FIG. 4) not exceeding 10 millimeters.

Also, optionally, but preferably, as between the subpanels of the right and left panels, the RRSP-leading generally vertical edge 42 and the RFSP-trailing generally vertical edge 61 are each curvilinear, and when the headgear is assembled in three-dimensions has an edge variance 202 (see e.g. FIG. 2) not exceeding 10 millimeters; and, the LRSP-leading generally vertical edge 32 and the LFSP-trailing generally vertical edge 51 are each curvilinear, and when the headgear is assembled in three-dimensions has an edge variance 203 (see e.g. FIG. 3) not exceeding 10 millimeters.

While the forgoing edge variances are, preferably not to exceed 10 millimeters, even more preferably they do not exceed 5 millimeters. Alternatively, while their edge variance may exceed 5 or 10 millimeters, the average edge variance (average along a given set of opposing free edges) does not exceed 10 millimeters, or more preferably an average edge variance of 5 mm or less.

Such optional curved edges, may optionally be segments of generally sinusoidal curves and/or second order curves, and may geometrically simulate homolosine curving to form portions of the headgear in a spherical or somewhat spherical shape in three dimensions.

Optionally, but preferably, the top panel TP integral with only one of the group consisting of: BP, RRSP, RFSP, LRSP and LFSP. Most preferably, it is integral with, and only with, the back panel BP.

Optionally, but preferably, the headgear in three dimensions is assembled without any metal connectors. Optionally, but preferably, the top panel TP has four slit/tab interfaces 33, 34, 35, 36 respectively adapted for connection with slit/tab interfaces 39 at upper portions of a remaining four of the group consisting of: BP, RRSP, RFSP, LRSP and LFSP with which the TP is not integral. For example, if the top panel is integral with the back panel, then it is not intergral with the RRSP, RFSP, LRSP or LFSP. Optionally, but preferably, the top panel TP is generally circular, and optionally, but preferably, the TP is integral with the back panel BP.

Optionally, but preferably, fold lines, such as beside slits, such as curve slits at the front 94 and back 95 of top panel TP (see e.g. FIGS. 6 and 8) may facilitate bending or curving between the top panel and the front and back panels, respectively. Optional slit 20 (see e.g. FIGS. 4 and 8) may do that as between the back panel BP and neck panel NP.

Optionally, but preferably, front panel FP may have connectors, such as slit/tab interfaces 91, 92 to connect with connectors, such as slit/tab interfaces 53, 62 on the respective front sub-panels (see e.g. FIGS. 1 and 8).

Optionally, but preferably, the RP includes an ear hole 82 therein, and the LP includes an ear hole 71 therein. Optionally, but preferably, the printed indicia 84, 73 comprising a football team logo, the printed indicia on at least the RP, LP or both. This may be, for example, any NFL, college or other logo. Here, in FIG. 10, as merely one example, the NFL's Indianapolis Colts logo is shown.

The headgear is such that optionally, but preferably, the BP has a lower back panel, or neck panel (NP), the NP integral with the BP along a bottom of the BP, the NP partially defined by a folding line 13 between the BP and the NP, wherein the NP is adapted to be folded inwardly along fold line 19 (see e.g. FIGS. 4 and 8) and between the BP and a wearer's neck. Fold line 13 may be on either side of slit 20, which may receive tab 19*a*. Optionally, the device may further comprise a left integral tab (LIT) 15 integral with the LRSP and a right integral tab (RIT) 14 integral with the RRSP, the LIT and the MT each adapted to extend inwardly and between the BP and the NP or between portions of NP after fold along 19 is made.

Optionally but preferably, the RRSP-leading generally vertical edge and a RFSP-trailing vertical edge converge at generally round right side anti-stress riser hole 44; and, (2) the LRSP-leading generally vertical edge and a LFSP-trailing vertical edge converge at generally round left side anti-stress riser hole 54. This may reduce stress concentrations and an associated tear propagating through the sheet. Other such anti-stress riser holes or indents may be used, such as the anti-stress riser indents 17, 18 at either side of the neck panel.

Wherever here a connection is described as a slit/tab interface, either part may be inverted (e.g. slit interchanged for tab, and vice versa); and, one or more such slit-tab interfaces may be substituted with a connector as defined herein.

Figure 2:
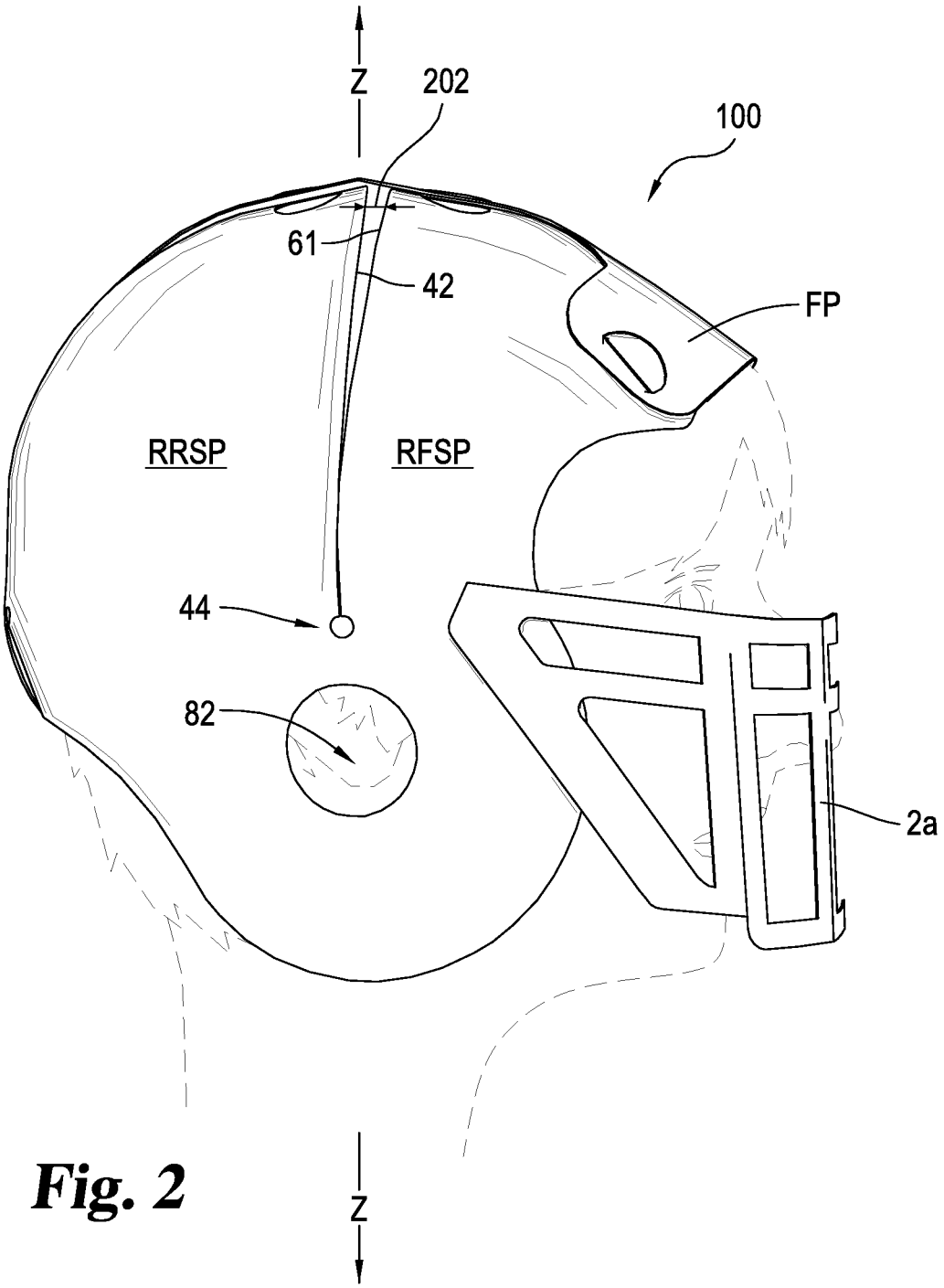
FIG. 2 is a right side elevation view of the example of FIG. 1.
Figure 3:
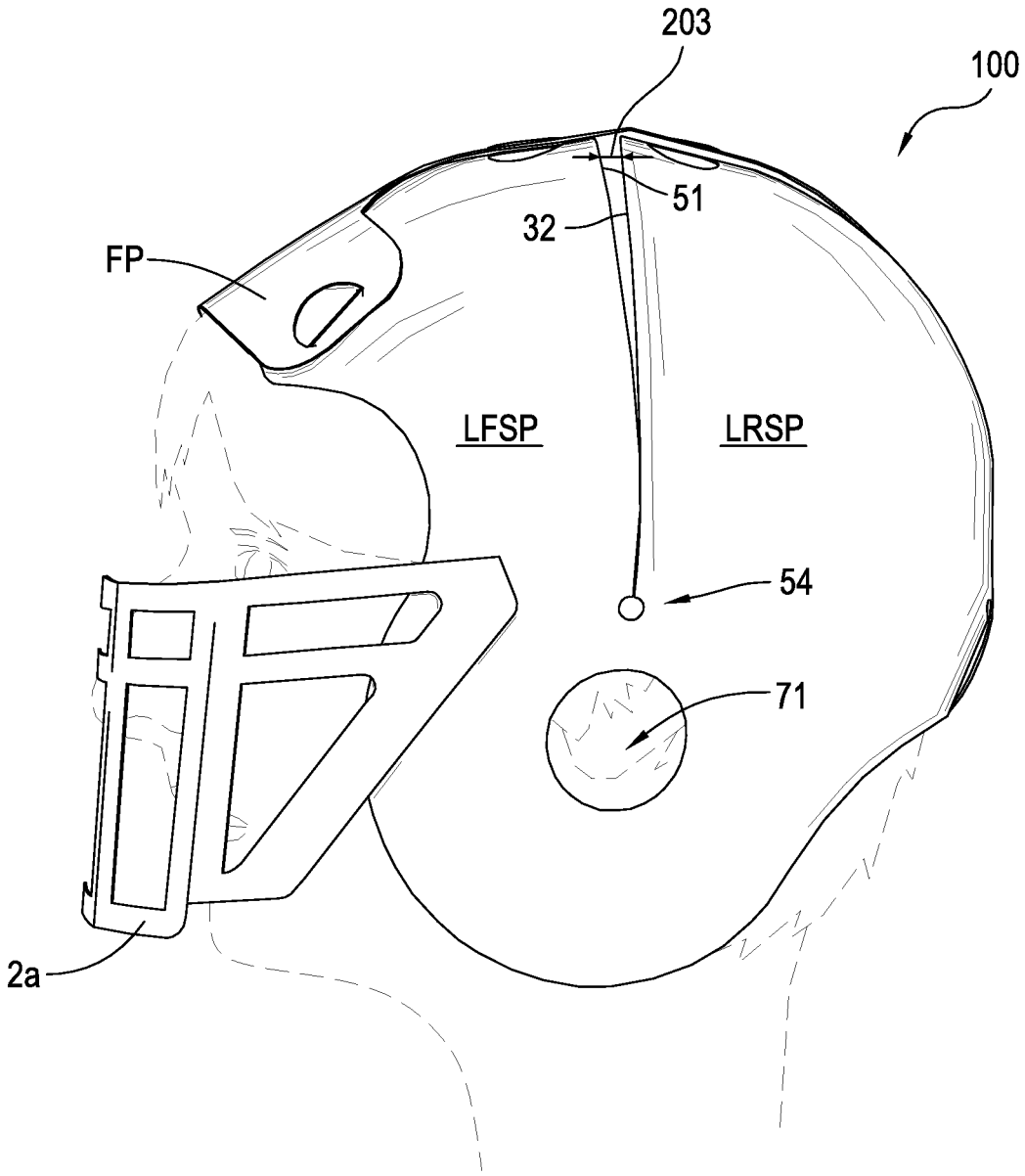
FIG. 3 is a left side elevation view of the example of FIG. 1.
Figure 4:
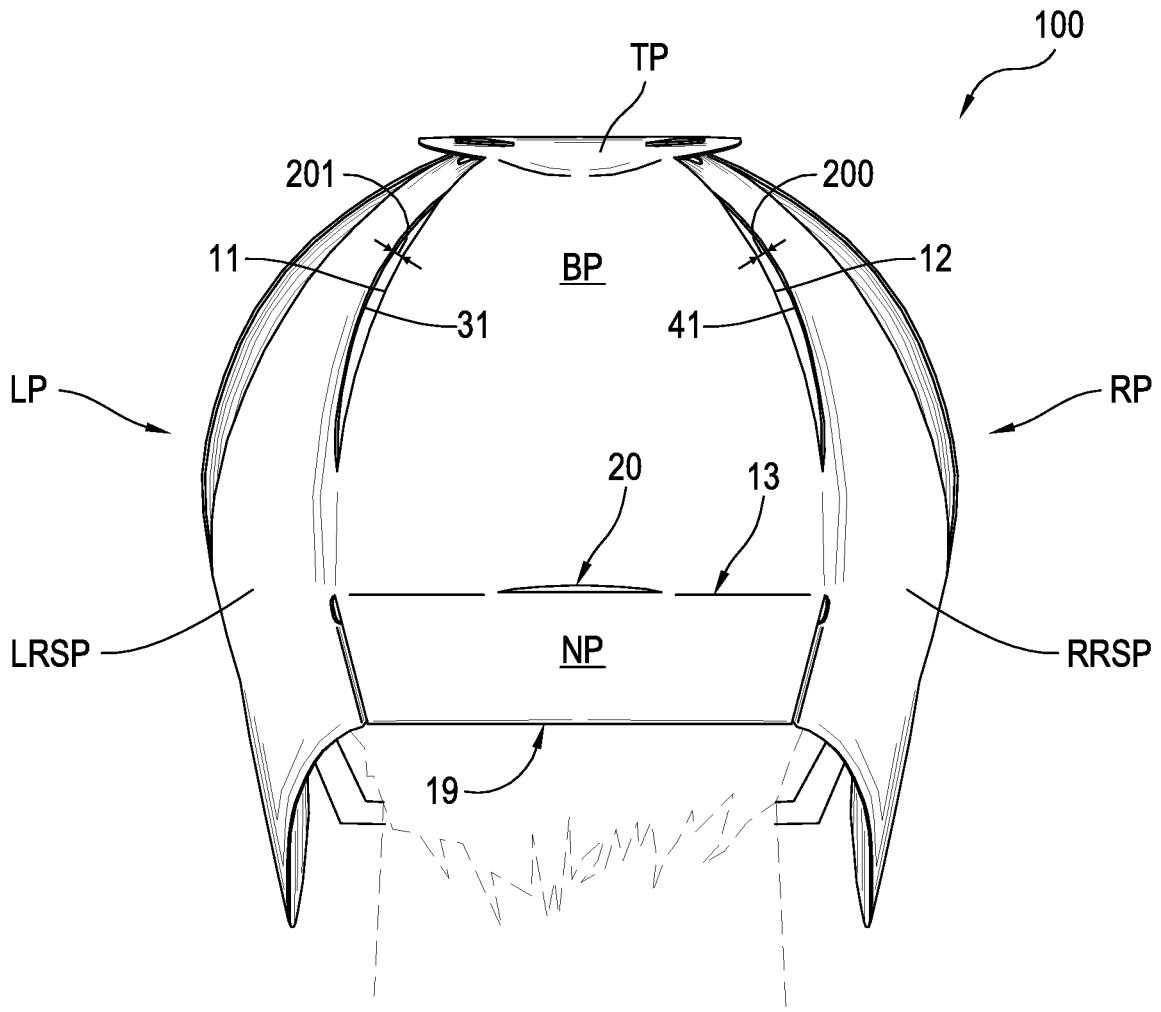
FIG. 4 is a rear elevation view of the example of FIG. 1.
Figure 5:
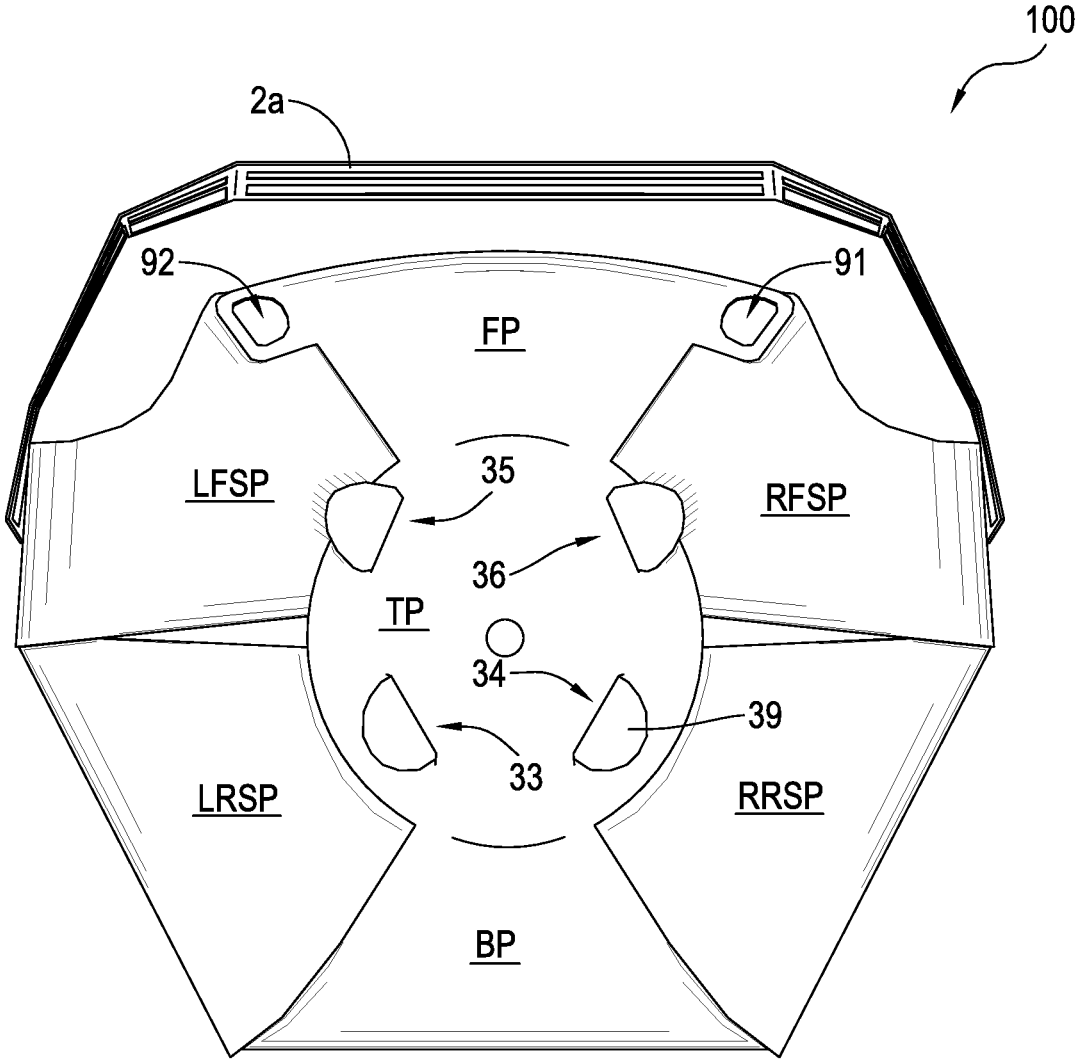
FIG. 5 is a top plan view of the example of FIG. 1.
Figure 6:
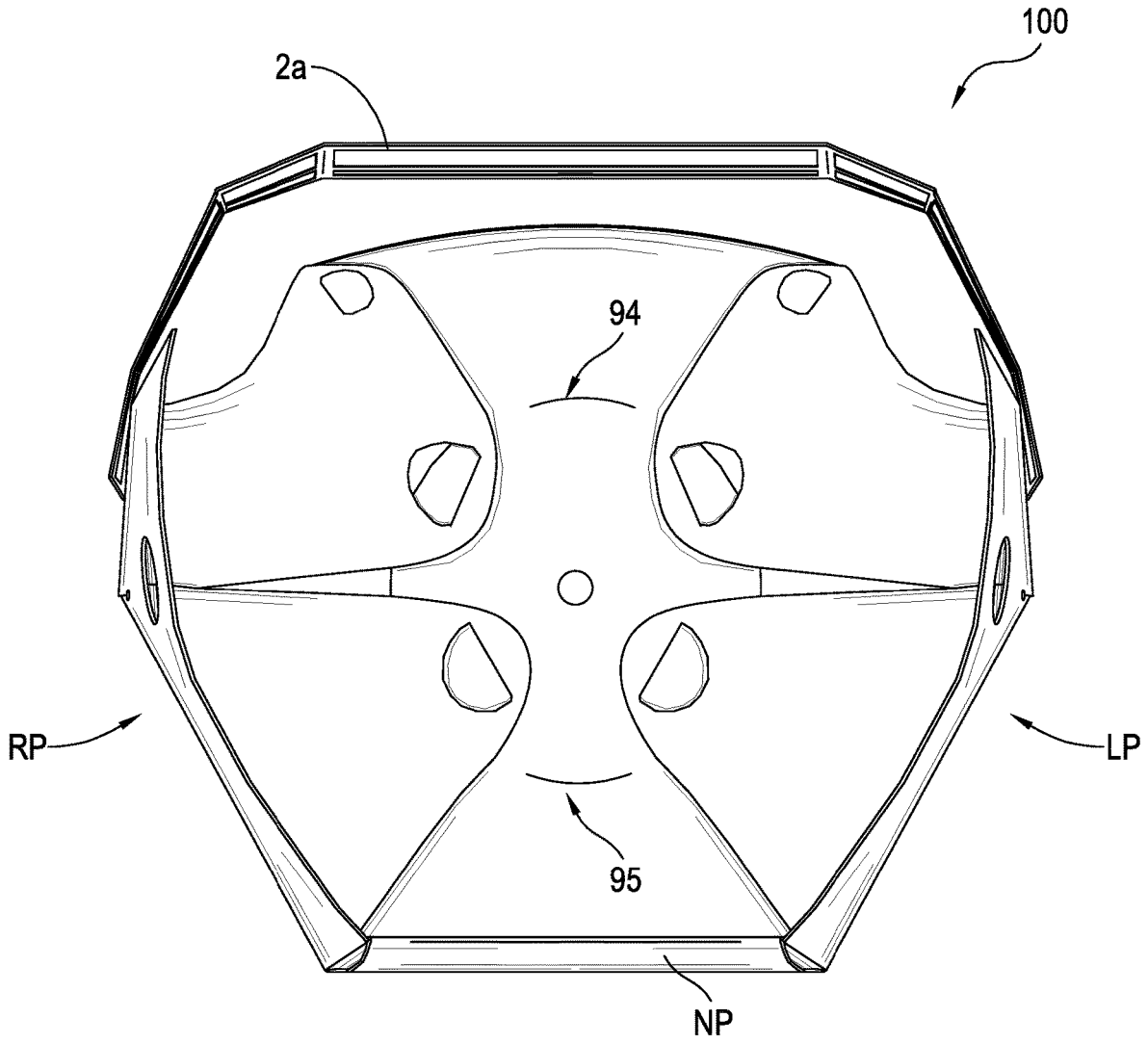
FIG. 6 is a bottom plan view of the example of FIG. 1.
Figure 7:
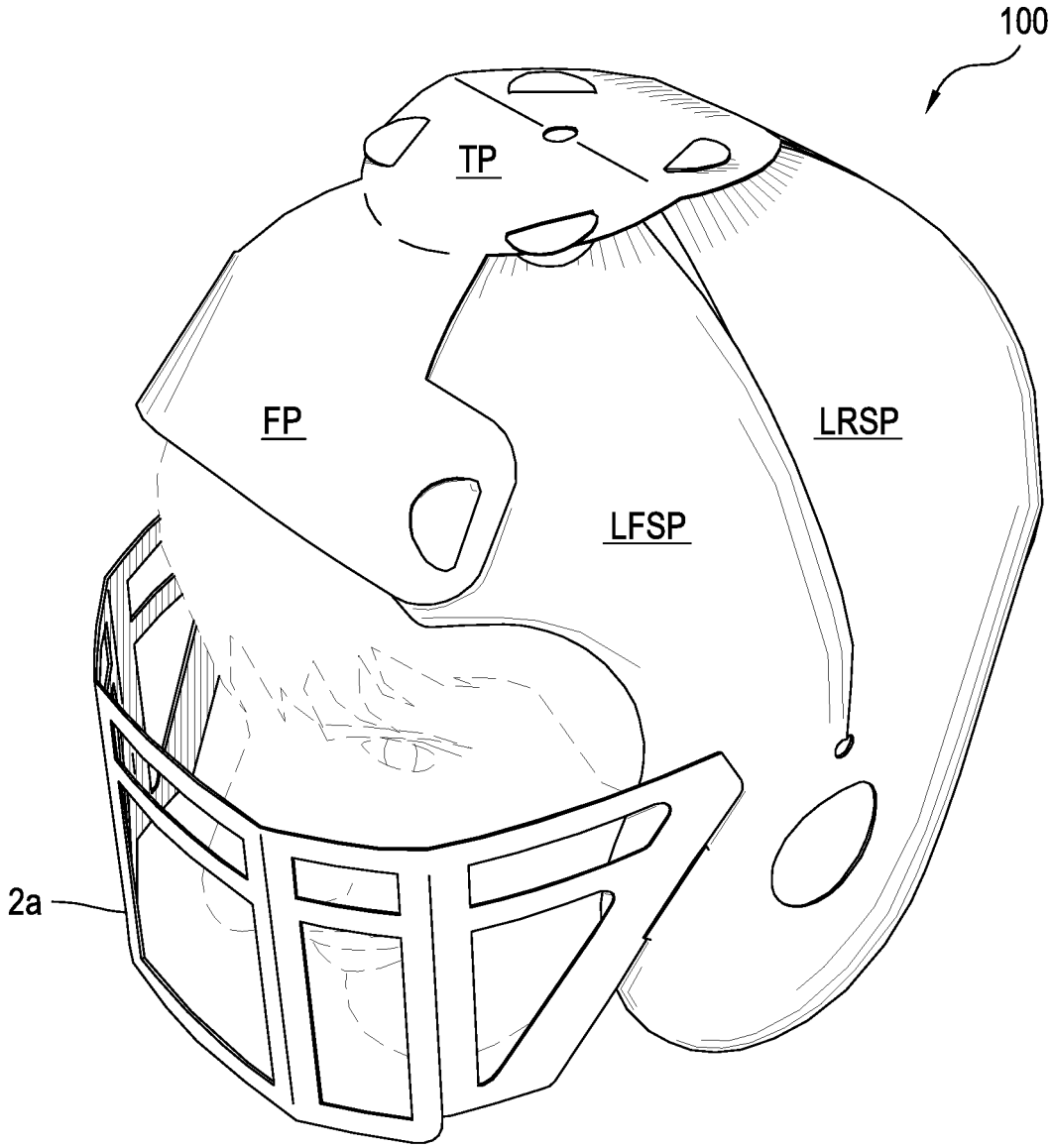
FIG. 7 is a top-front perspective view of the example of FIG. 1.

As can be now understood, the headgear may be assembled simply by starting from the back (back panel BP) and wrapping the right and left panels, including their subpanels generally in a vertical cylinder about axis Z (see FIGS. 1 and 2). This is done while wrapping the top and front panels, rearward to front, over the top of the space to be occupied by the wearer's head or skull. Thereafter, the upper portions of the right and left panels are curved inwardly toward the top panel TP and connected thereto, preferably near a perimeter of the top panel. The front connections of FP at 91 and 92 optionally are made. The face mask is attached.

Figure 18:
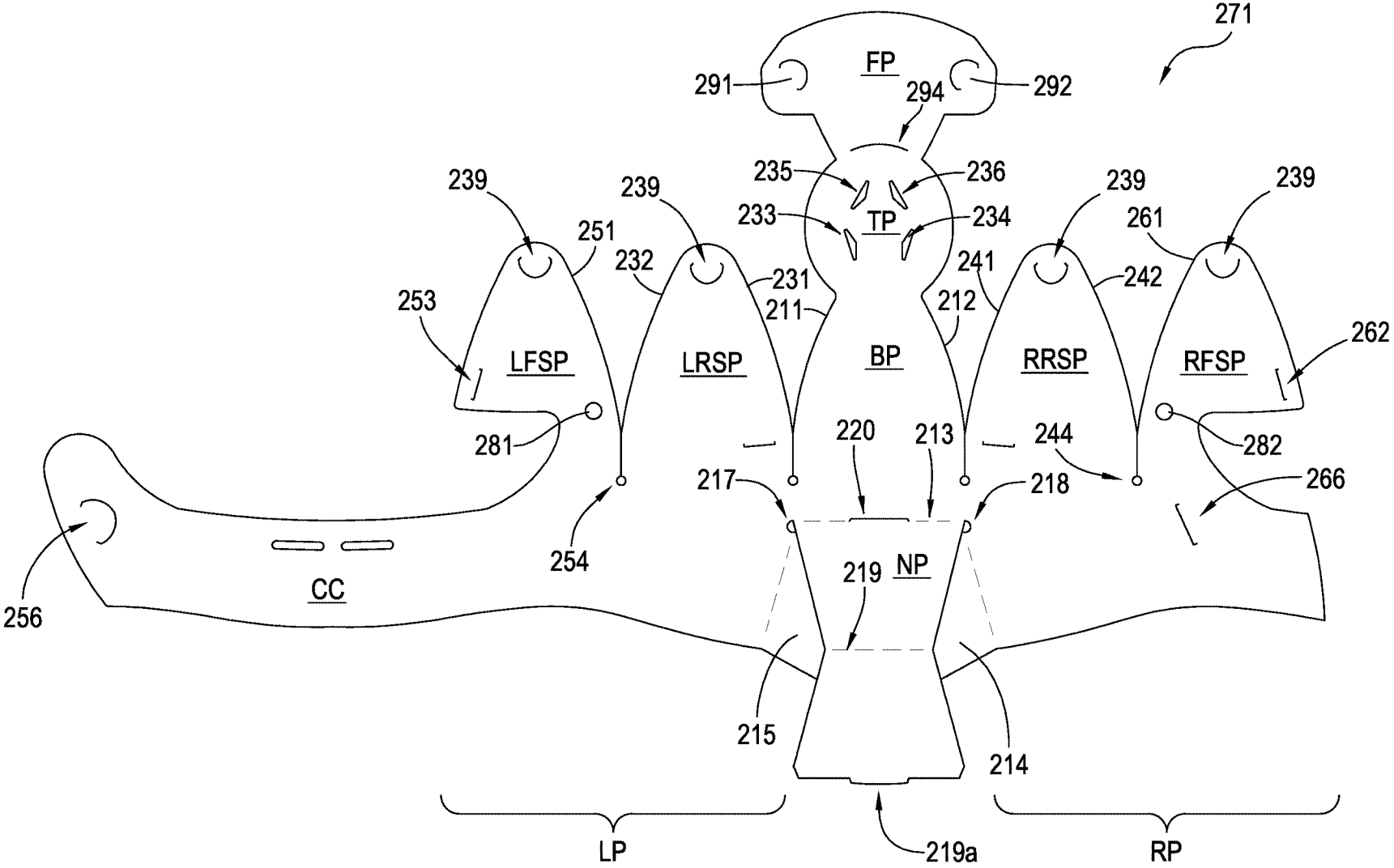
FIG. 18 is a top plan view of a helmet blank or sheet in two dimensions for making the example of FIG. 11.

In an alternative embodiment, a decorative headgear 270 is shown simulating the appearance of a racing helmet. FIG. 18 shows an example of a sheet 271 used to make headgear 270. FIGS. 11-17 also form an ornamental design, depicted on a wearer shown in phantom lines. Headgear 270 has a similar structure as headgear 100. Corresponding features shown in headgear 100 and headgear 270 are given similar reference numerals; however the features in headgear 270 have a 2 in front. For example, a feature in headgear 270 that corresponds with feature 20 of headgear 100 is given the reference numeral 220.

As shown in FIG. 18, headgear 270 may include a back panel (BP), the BP partially defined by a BP-right generally vertical edge 212 and a BP-left vertical edge 211, wherein in two-dimensions the two BP vertical edges converge towards each other bottom to top. It may also have a right panel (RP), wherein the RP in two-dimensions comprises a right rear sub-panel (RRSP), the RRSP integral with the BP below the BP-right generally vertical edge 212, the RRSP partially defined by a RRSP-leading generally vertical edge 242 and a RRSP-trailing generally vertical edge 241, wherein the two RRSP vertical edges converge towards each other bottom to top; and a right front sub-panel (RFSP), the RFSP integral with the RRSP below the RRSP-leading generally vertical edge 242, the RFSP partially defined by a RFSP-trailing vertical edge 261, wherein the RFSP trailing generally vertical 261 edge diverges away from the RRSP-leading generally vertical edge 242 bottom to top.

Likewise, on the other side, sheet 271 may include a left panel (LP), wherein the LP in two-dimensions comprises: a left rear sub-panel (LRSP), the LRSP integral with the BP below the BP-left generally vertical edge 211, the LRSP partially defined by a LRSP-leading generally vertical edge 232 and a LRSP-trailing generally vertical edge 231, wherein the two LRSP vertical edges converge towards each other bottom to top; and, a left front sub-panel (LFSP), the LFSP integral with the LRSP below the LRSP-leading generally vertical edge 232, the LFSP partially defined by a LFSP-trailing generally vertical edge 251, wherein the LFSP trailing vertical edge 251 diverges away from the LRSP-leading generally vertical edge 232 bottom to top. Optionally, but preferably the left panel and right panel are symmetric.

Sheet 271 preferably has a top panel (TP), and a front element comprising a lower front panel, which, in use, may comprise a visor (V) and/or a chin cover (CC) simulating racing helmet chin guard. The CC runs horizontally generally in front of a wearer's chin and defines a generally horizontal viewing opening for a wearer's eyes.

Optionally, but preferably, the front element comprises both the V and the CC. Also optionally, but preferably, the RFSP and the LFSP each have a cutout region partially defining lateral portions of a generally horizontal viewing opening for the wearer's eyes.

Optionally, but preferably, the V is a sheet of thin flexible material separate from the helmet sheet 271. The V has at left and right sides thereof a slit/tab interface adapted for connection respectively with a slit/tab interface 282 on the RFSP and with a slit/tab interface 281 on the LFSP. Optionally, but preferably, headgear 270 may have a transparent shield over the horizontal viewing opening.

Optionally, but preferably, the CC is a sheet of thin flexible material integral with one of the front side panels of the helmet sheet. The CC has a side slit/tab interface 256 adapted for connection respectively with a slit/tab interface 266 on an opposing front side panel.

The headgear 270, optionally, but preferably, has the BP-right generally vertical edge 212 and the RRSP-trailing generally vertical edge 241 each curvilinear, such that when the headgear is assembled in three-dimensions it has an edge variance 300 (see e.g. FIG. 14) not exceeding 10 millimeters; and, on the other side the BP-left generally vertical edge 211 and the LRSP-trailing generally vertical edge 231 are each curvilinear, and again when the headgear is assembled in three-dimensions, it has an edge variance 301 (see e.g. FIG. 14) not exceeding 10 millimeters.

Also, optionally, but preferably, as between the subpanels of the right and left panels, the RRSP-leading generally vertical edge 242 and the RFSP-trailing generally vertical edge 261 are each curvilinear, and when the headgear is assembled in three-dimensions has an edge variance 302 (see e.g. FIG. 12) not exceeding 10 millimeters; and, the LRSP-leading generally vertical edge 232 and the LFSP-trailing generally vertical edge 251 are each curvilinear, and when the headgear is assembled in three-dimensions has an edge variance 303 (see e.g. FIG. 13) not exceeding 10 millimeters.

While the forgoing edge variances are, preferably not to exceed 10 millimeters, even more preferably they do not exceed 5 millimeters. Alternatively, while their edge variance may exceed 5 or 10 millimeters, the average edge variance (average along a given set of opposing free edges) does not exceed 10 millimeters, or more preferably an average edge variance of 5 mm or less.

Such optional curved edges, may optionally be segments of generally sinusoidal curves and/or second order curves, and may geometrically simulate homolosine curving to form portions of the headgear in a spherical or somewhat spherical shape in three dimensions.

Optionally, but preferably, the top panel TP integral with only one of the group consisting of: BP, RRSP, RFSP, LRSP and LFSP. Most preferably, it is integral with, and only with, the back panel BP.

Optionally, but preferably, the headgear, in all embodiments of the invention, in three dimensions is assembled without any metal connectors. Optionally, but preferably, the top panel TP has four slit/tab interfaces 233, 234, 235, 236 respectively adapted for connection with slit/tab interfaces 239 at upper portions of a remaining four of the group consisting of: BP, RRSP, RFSP, LRSP and LFSP with which the TP is not integral. For example, if the top panel is integral with the back panel, then it is not intergral with the RRSP, RFSP, LRSP or LFSP. Optionally, but preferably, the top panel TP is generally circular, and optionally, but preferably, the TP is integral with the back panel BP.

The headgear is such that optionally, but preferably, the BP has a neck panel (NP), the NP integral with the BP along a bottom of the BP, the NP partially defined by a folding line 213 between the BP and the NP, wherein the NP is adapted to be folded inwardly along fold line 219 (see e.g. FIGS. 14 and 18) and between the BP and a wearer's neck. Fold line 213 may be on either side of slit 220, which may receive tab 219*a*. Optionally, the device may further comprise a left integral tab (LIT) 215 integral with the LRSP and a right integral tab (RIT) 214 integral with the RRSP, the LIT and the RIT each adapted to extend inwardly and between the BP and the NP or between portions of the NP after fold along 219 is made.

Optionally but preferably, the RRSP-leading generally vertical edge and a RFSP-trailing vertical edge converge at generally round right side anti-stress riser hole 244; and, the LRSP-leading generally vertical edge and a LFSP-trailing vertical edge converge at generally round left side anti-stress riser hole 254. This may reduce stress concentrations and an associated tear propagating through the sheet. Other such anti-stress riser holes or indents may be used, such as the anti-stress riser indents 217, 218 at either side of the neck panel.

Figure 11:
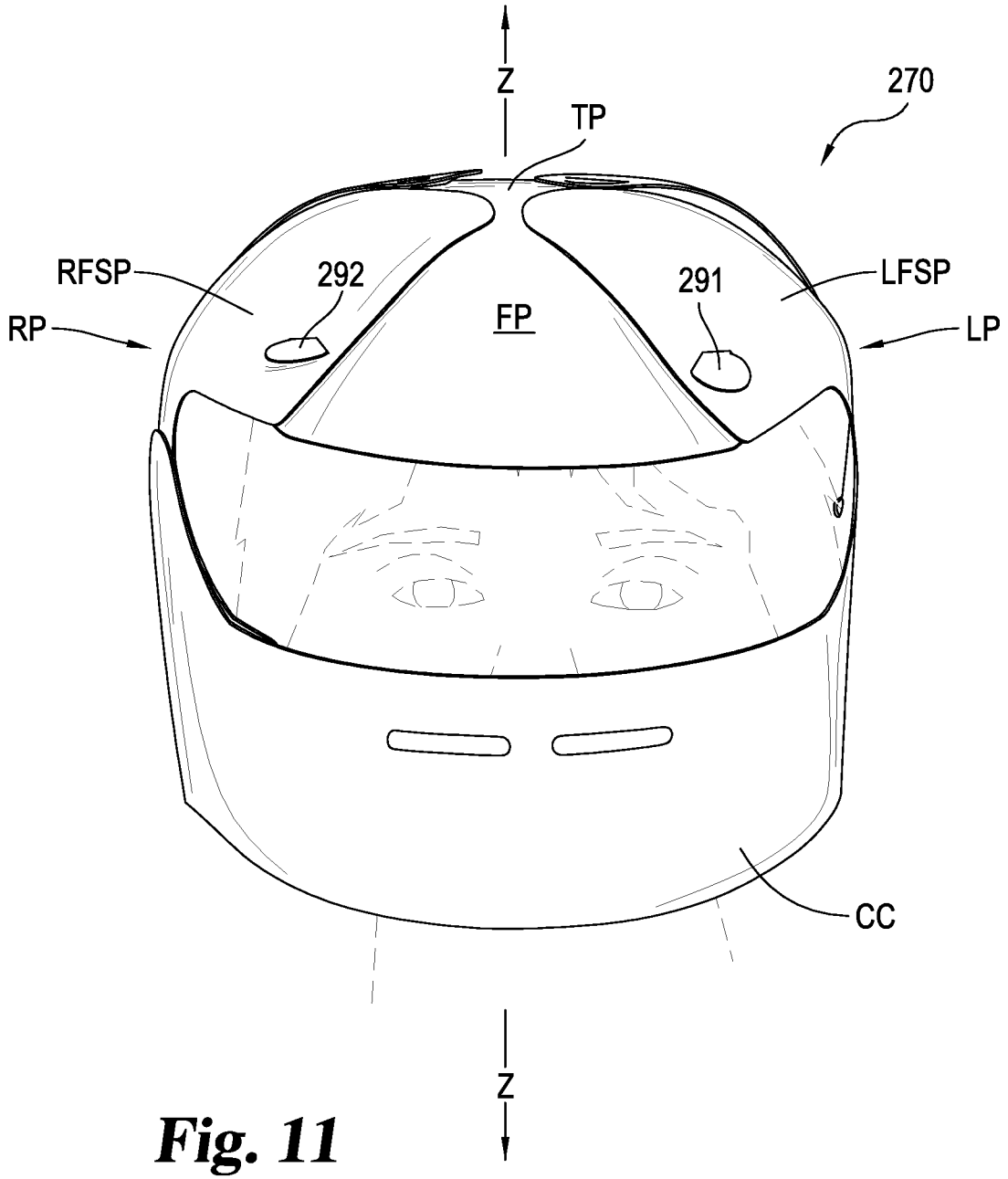
FIG. 11 is a front elevation view of one example of the present invention assembled in three dimensions to form a decorative headgear simulating a motor-racing helmet.
Figure 12:
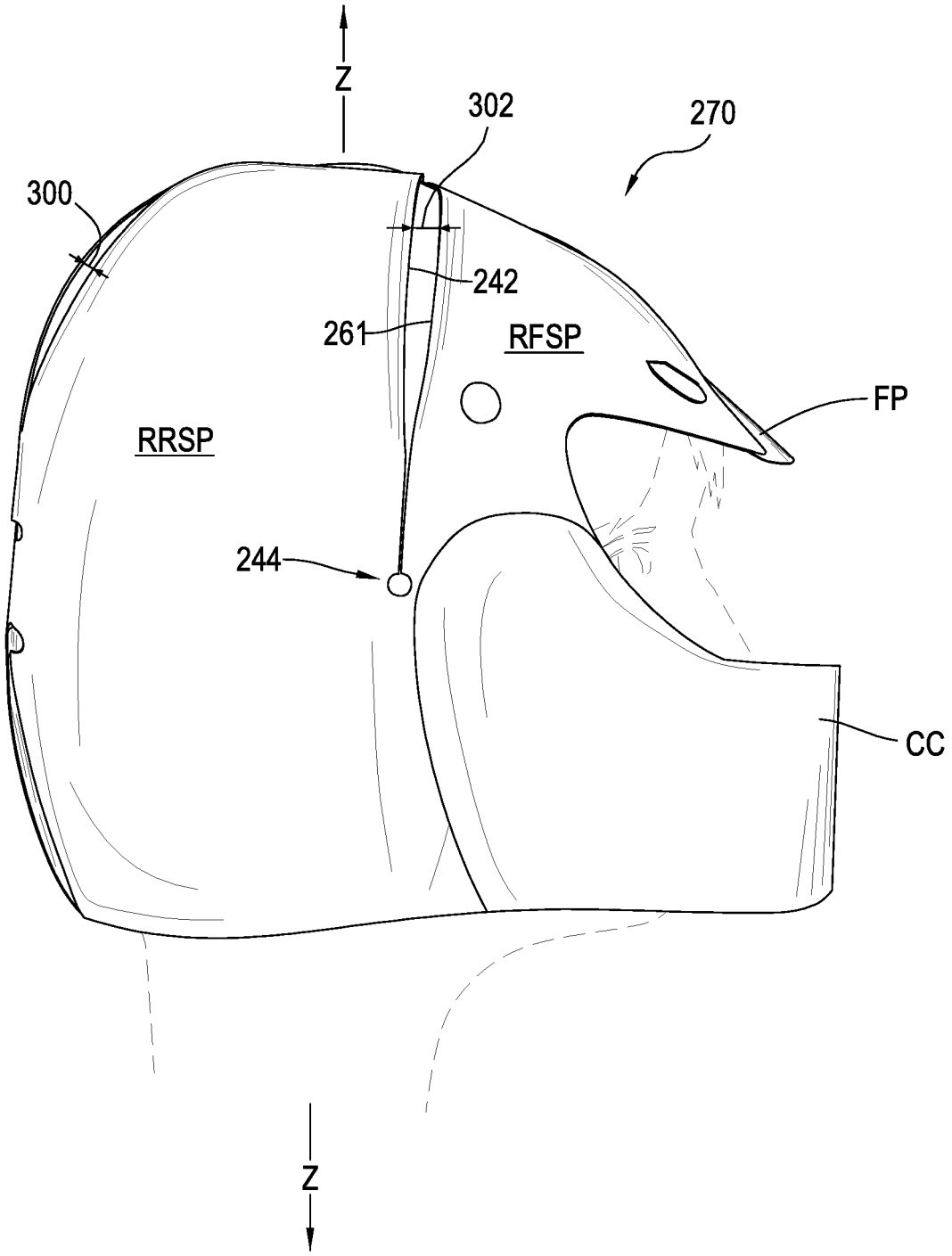
FIG. 12 is a right side elevation view of the example of FIG. 11.
Figure 13:
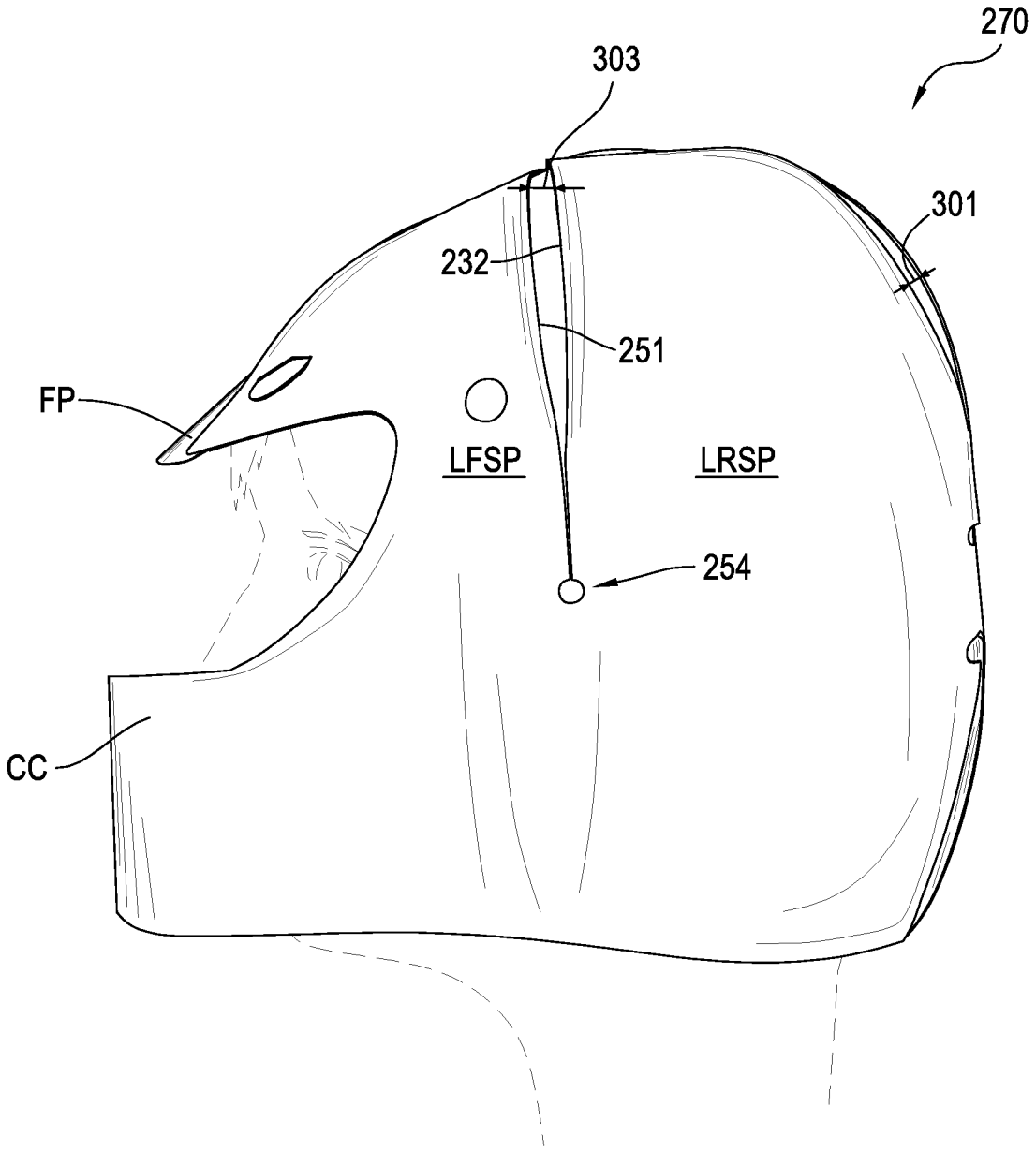
FIG. 13 is a left side elevation view of the example of FIG. 11.
Figure 14:
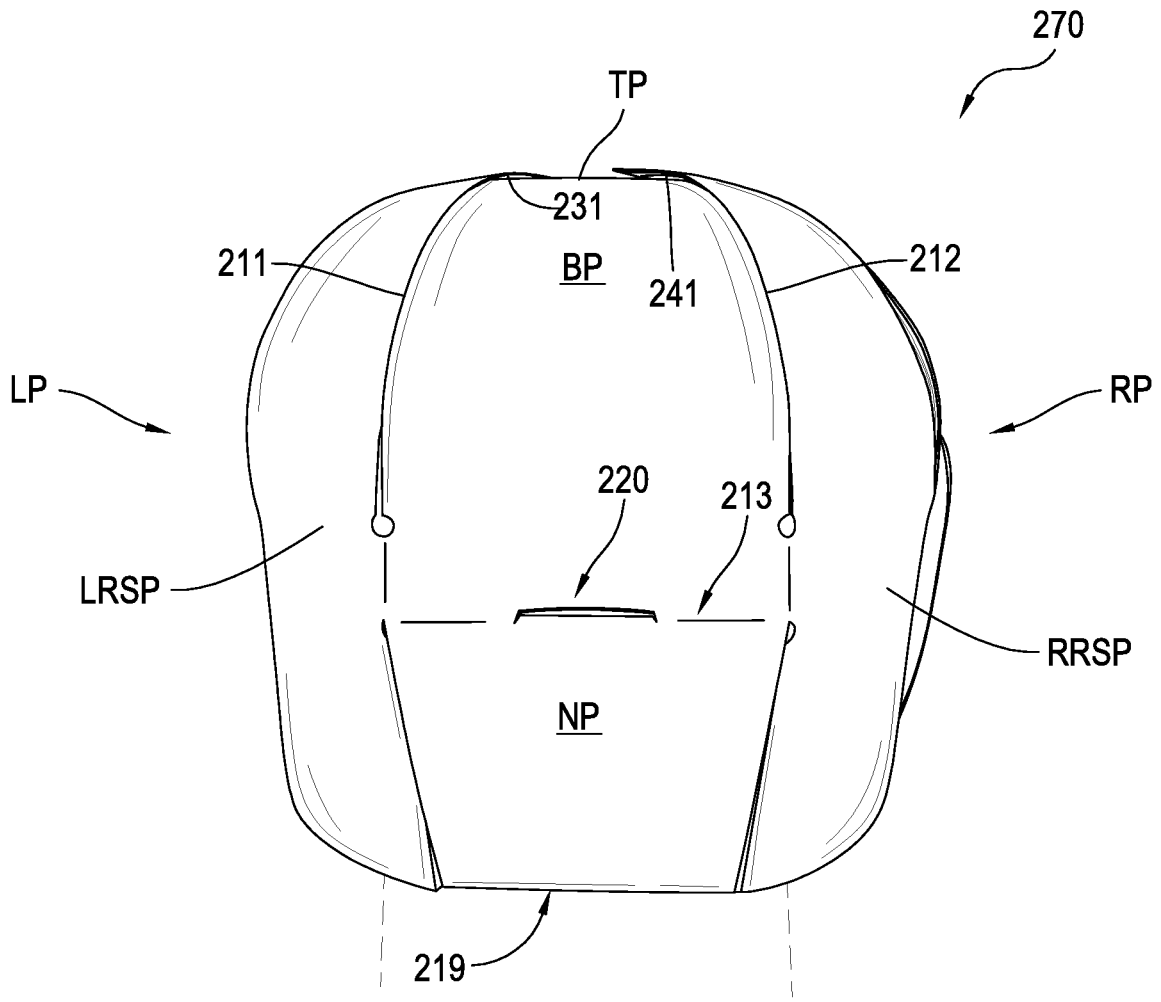
FIG. 14 is a rear elevation view of the example of FIG. 11.
Figure 15:
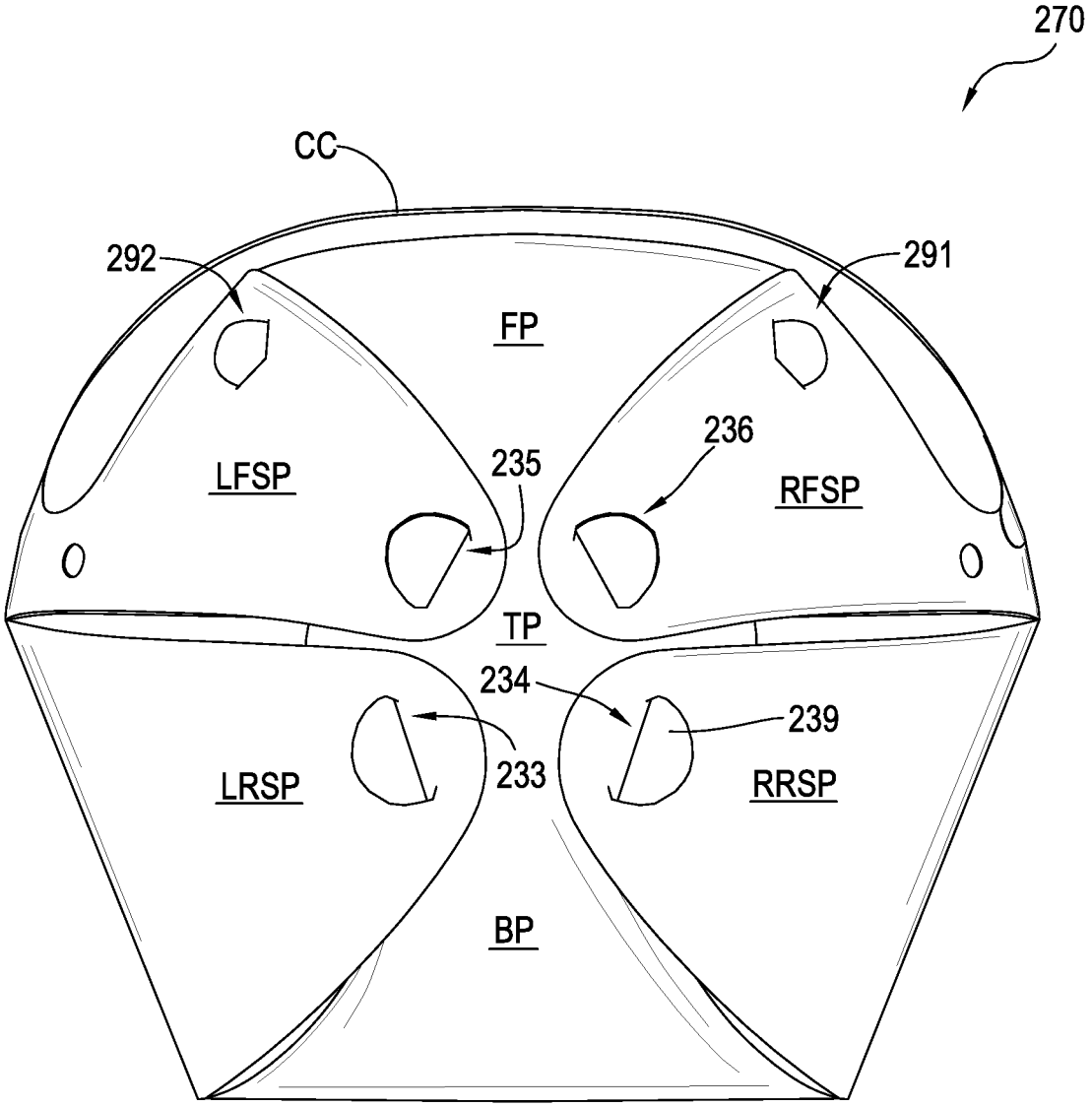
FIG. 15 is a top plan view of the example of FIG. 11.
Figure 16:
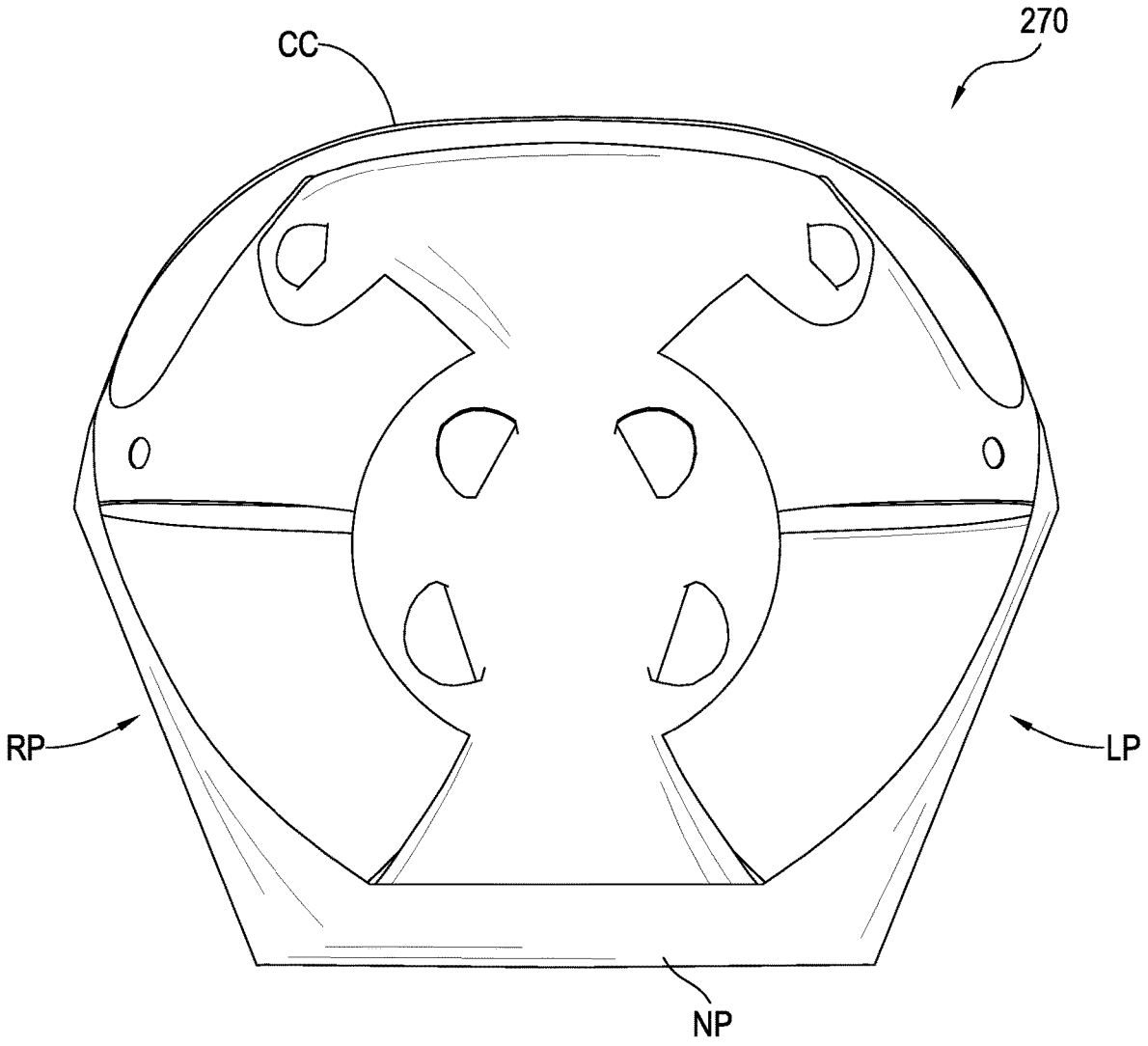
FIG. 16 is a bottom plan view of the example of FIG. 11.
Figure 17:
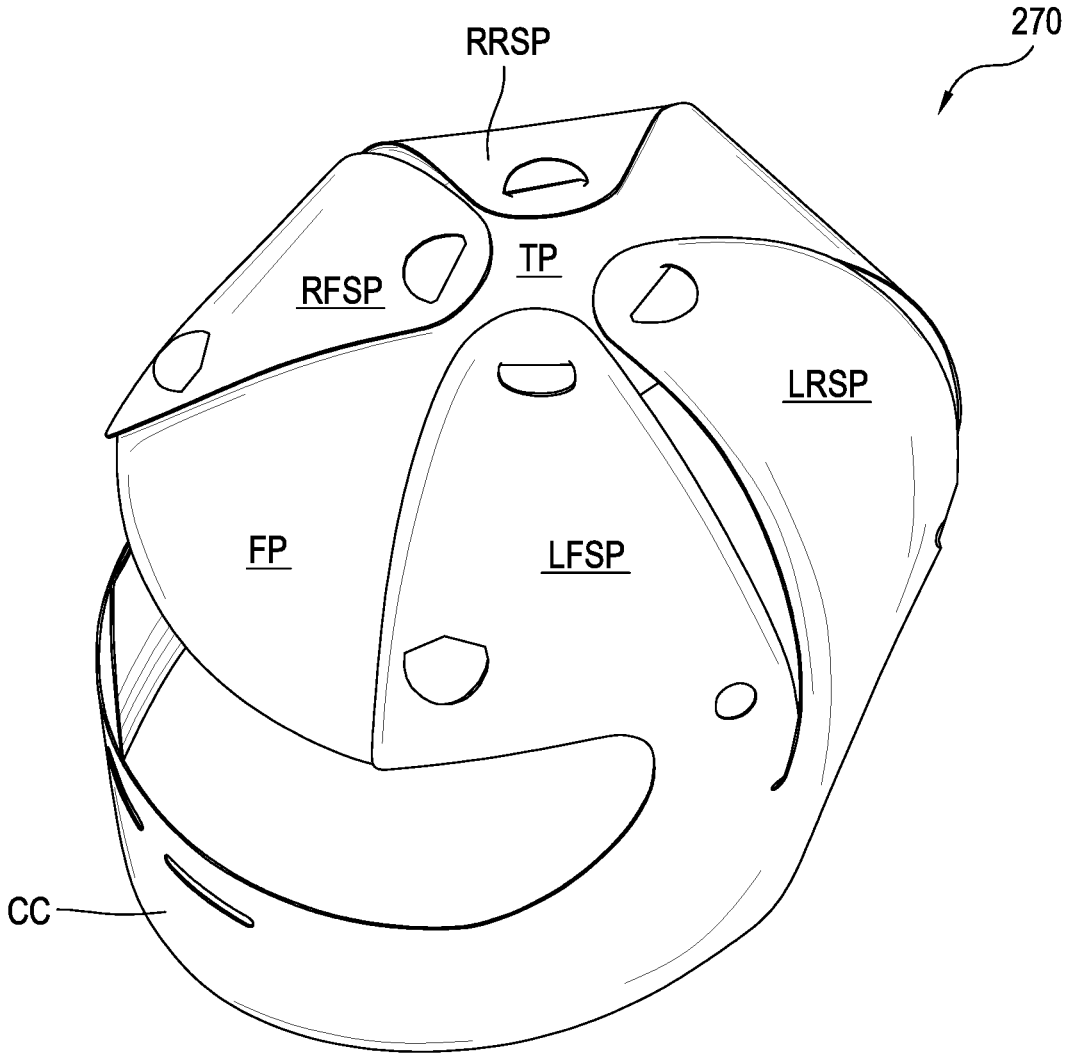
FIG. 17 is a top-front perspective view of the example of FIG. 11.

Optionally, but preferably, front panel FP may have connectors, such as slit/tab interfaces 291, 292 to connect with connectors, such as slit/tab interfaces 253, 262 on the respective front sub-panels (see e.g. FIGS. 11 and 18).

Optionally, but preferably, fold lines, such as beside slits, such as a curve slit at the front 294 of top panel TP (see e.g. FIGS. 16 and 18) may facilitate bending or curving between the top panel and the front panels. Optional slit 220 (see e.g. FIGS. 14 and 18) may do that as between the back panel BP and neck panel NP.

Figure 19:
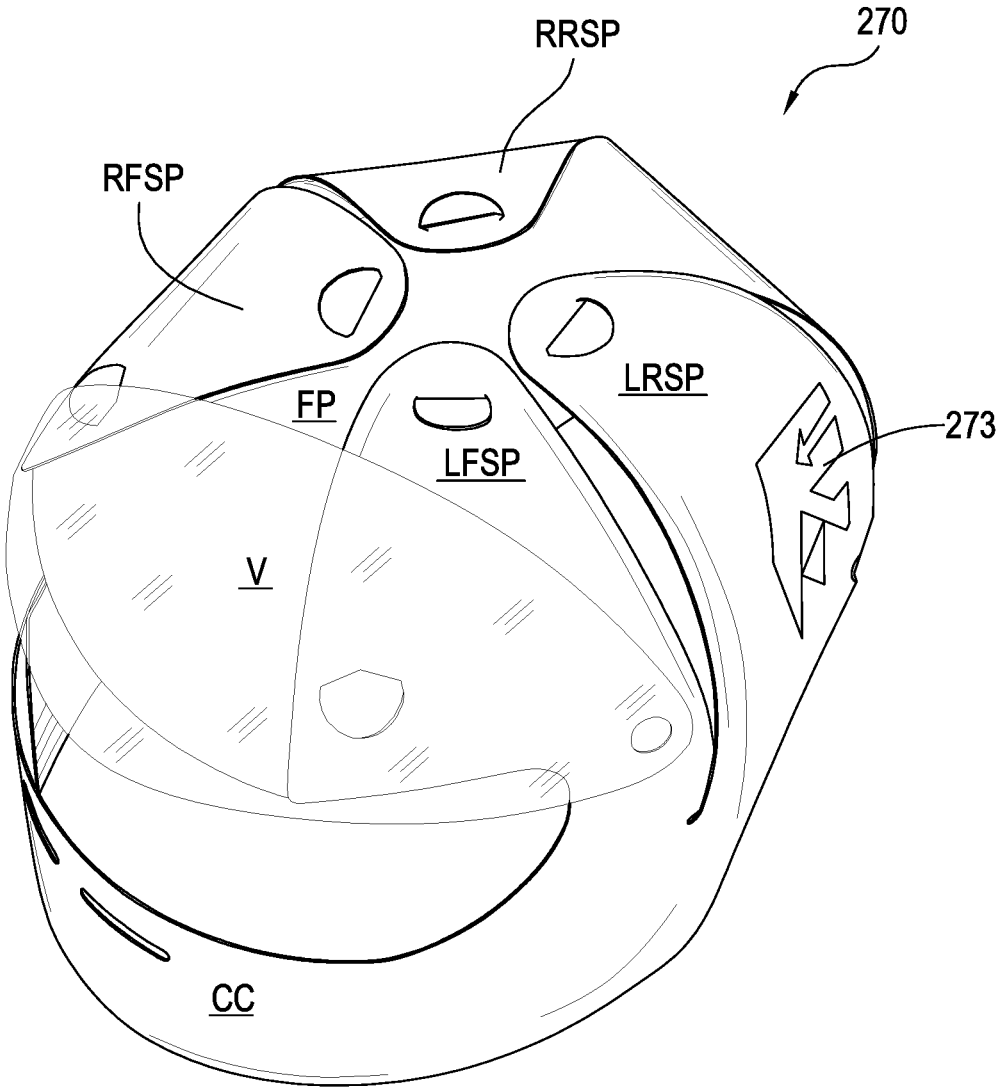
FIG. 19 is a top-front perspective view of the example of FIG. 17 with indicia and a visor added.
Figure 20:
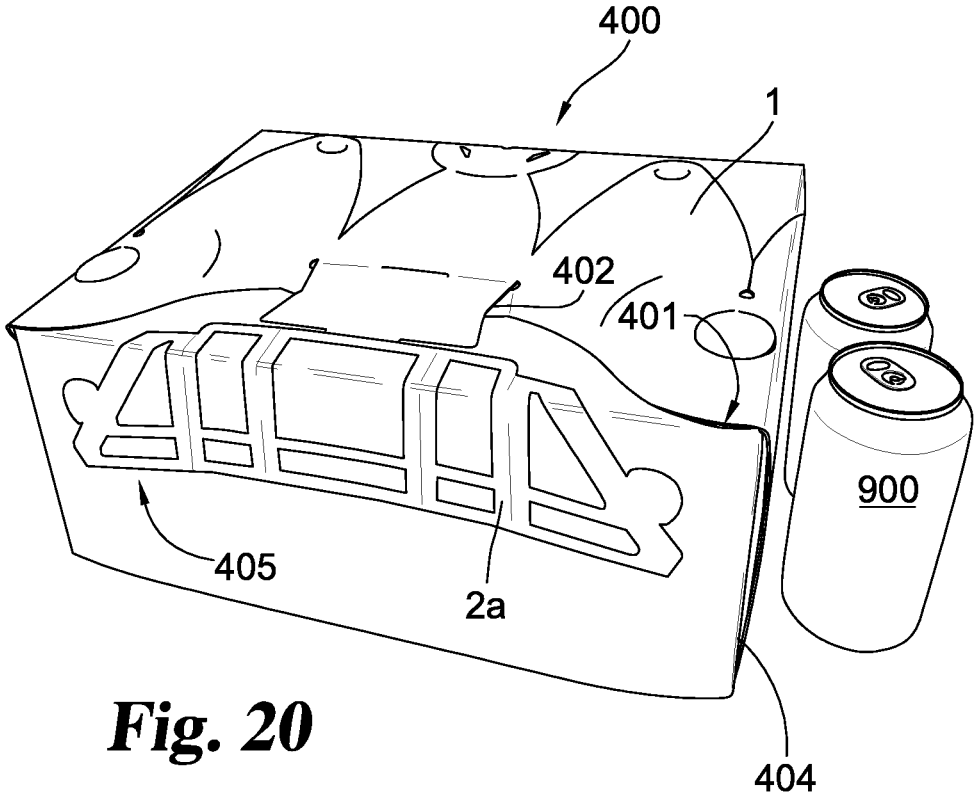
FIG. 20 and FIG. 21 are perspective views of an example of a container according to the present invention.
Figure 21:
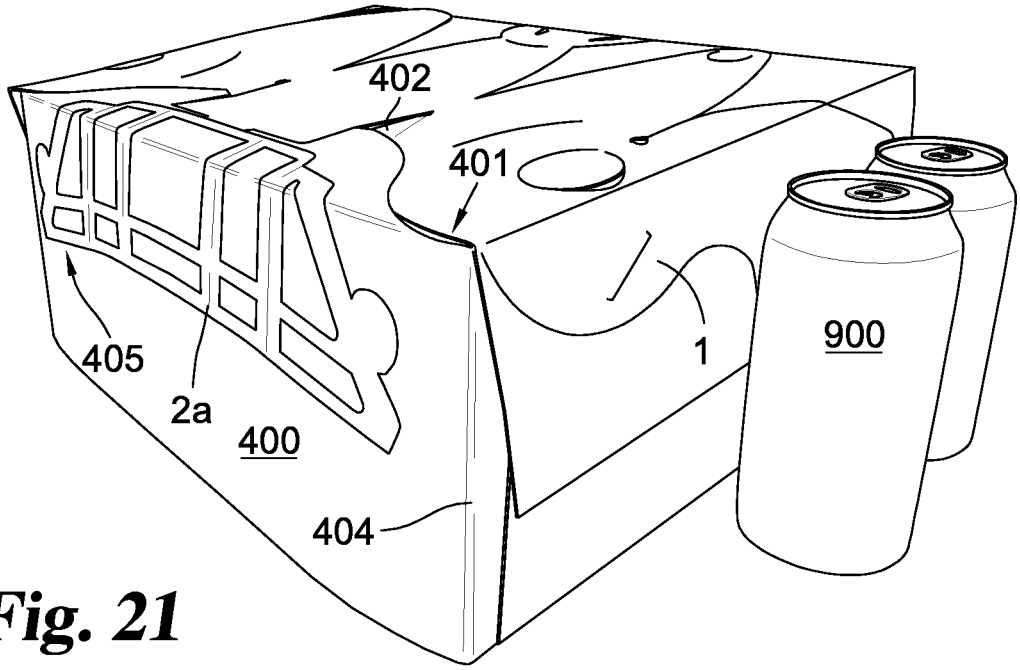
Figure 22:
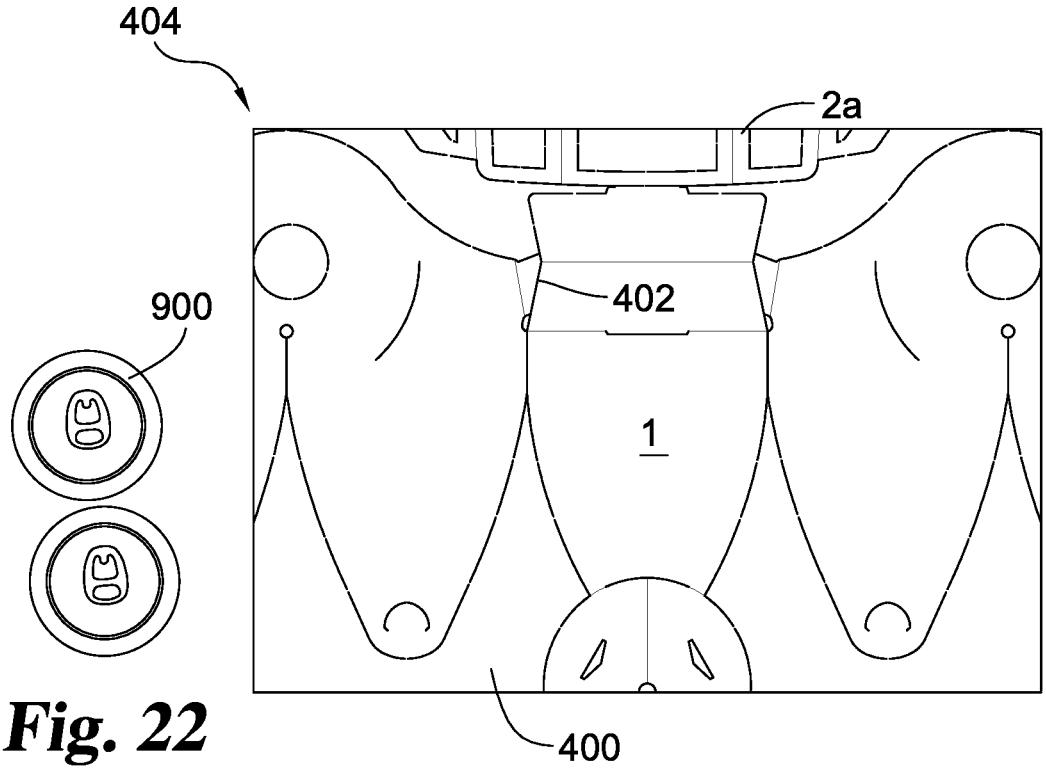
FIG. 22 is a top plan view of the container of FIG. 20.
Figure 23:
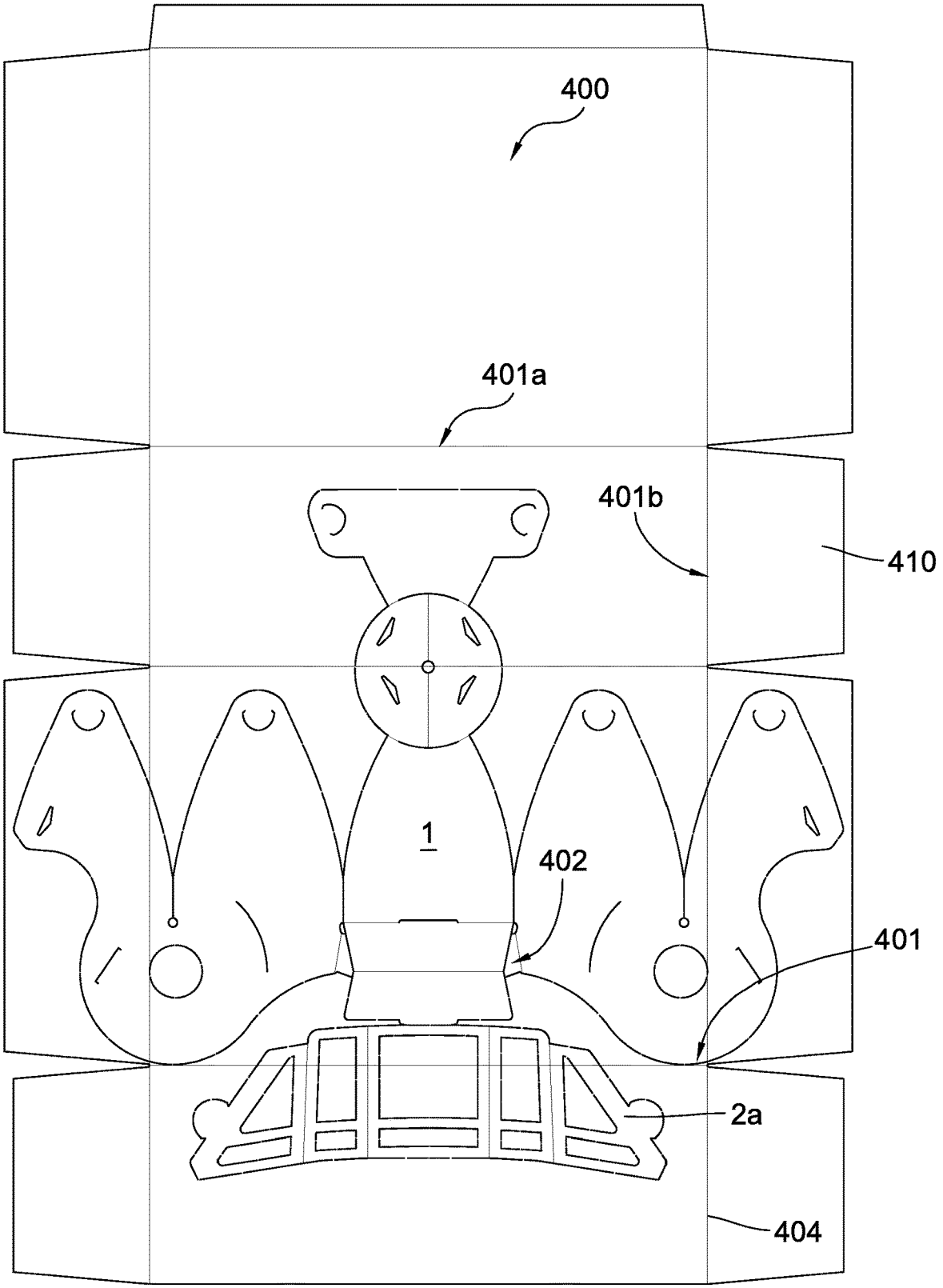
FIG. 23 is a plan view of a sheet, laid flat, used to make the container of FIG. 20.
Figure 24:
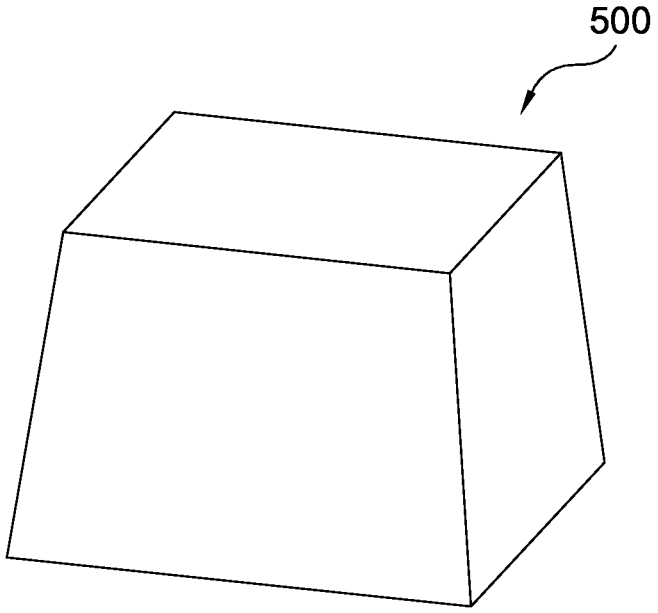
FIGS. 24 and 25 illustrate exemplary containers which are formed from a sheet into a box which is rectilinear when viewed from a top plan view and which is non-rectilinear and which tapers inward at its top half when viewed from a side elevation view.
Figure 25:
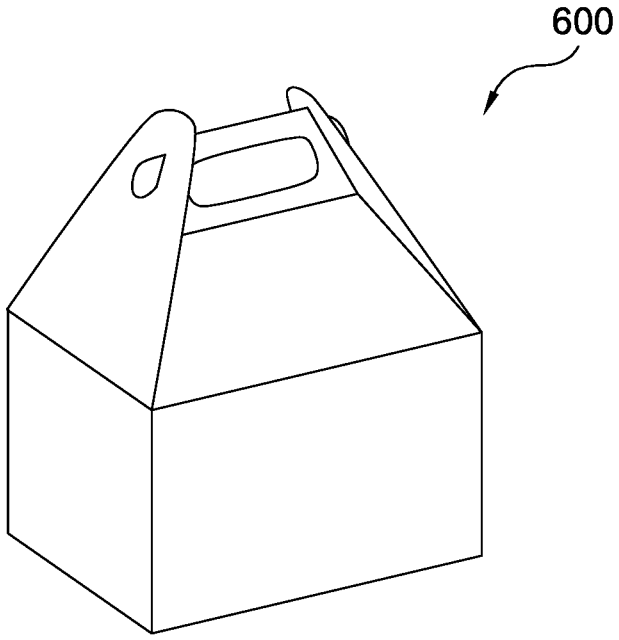
Figure 26:
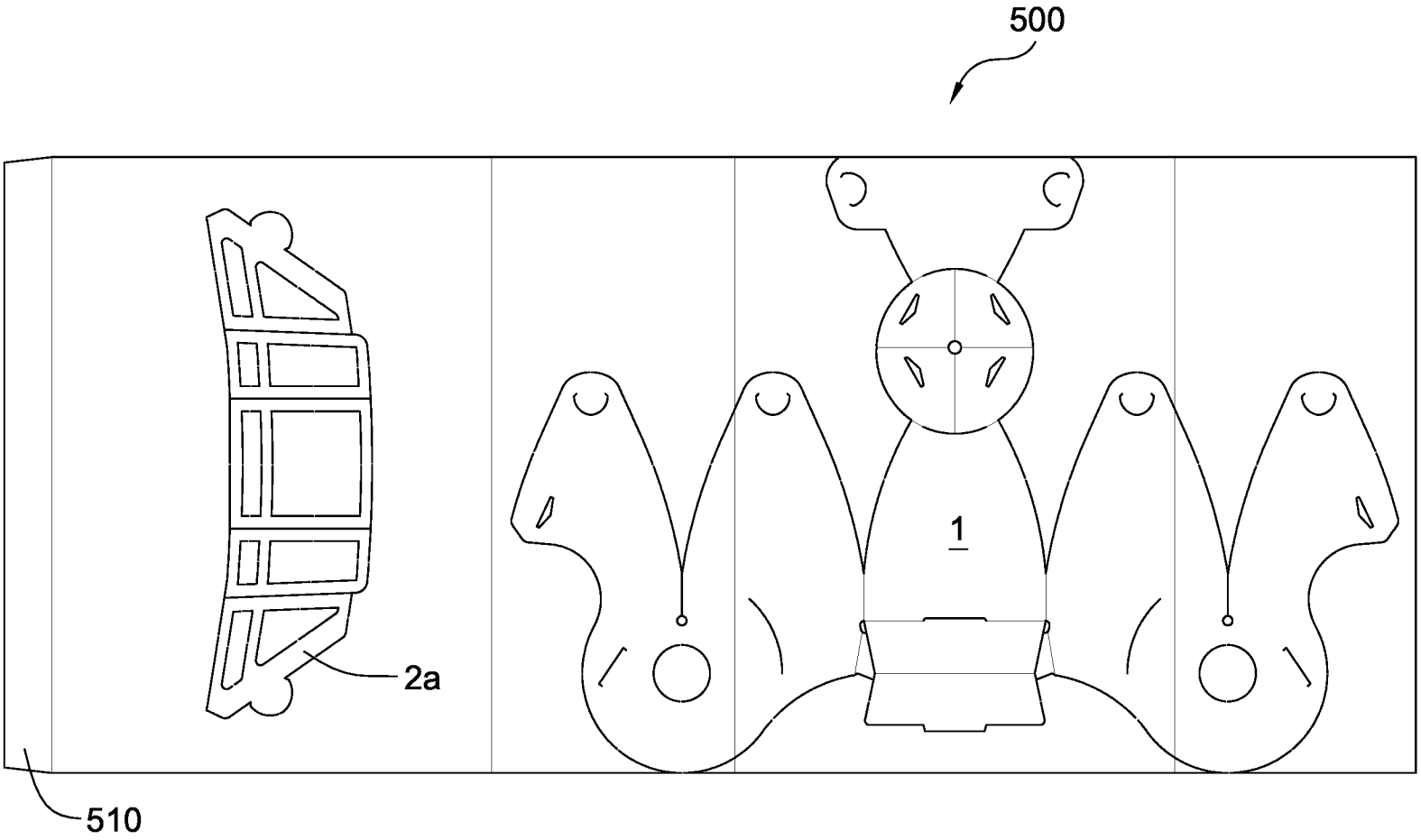
FIG. 26 is a plan view of a sheet, laid flat, used to make an alternative container or a sleeve for around another container/box (a container for another container).
Figure 27:
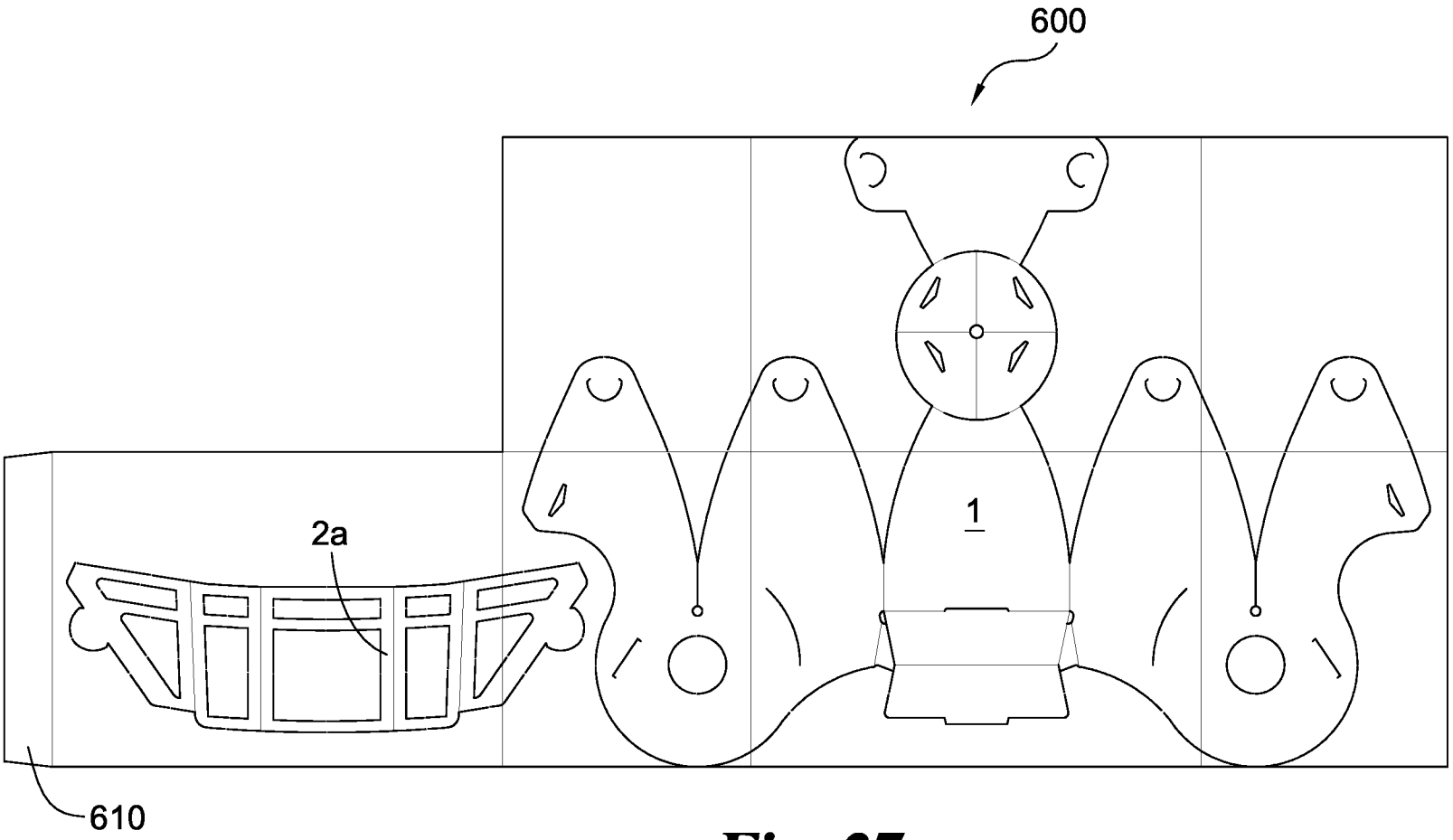
FIG. 27 is a plan view of a sheet, laid flat, used to make another alternative container or a sleeve for around another container/box (a container for another container).
Figure 28:
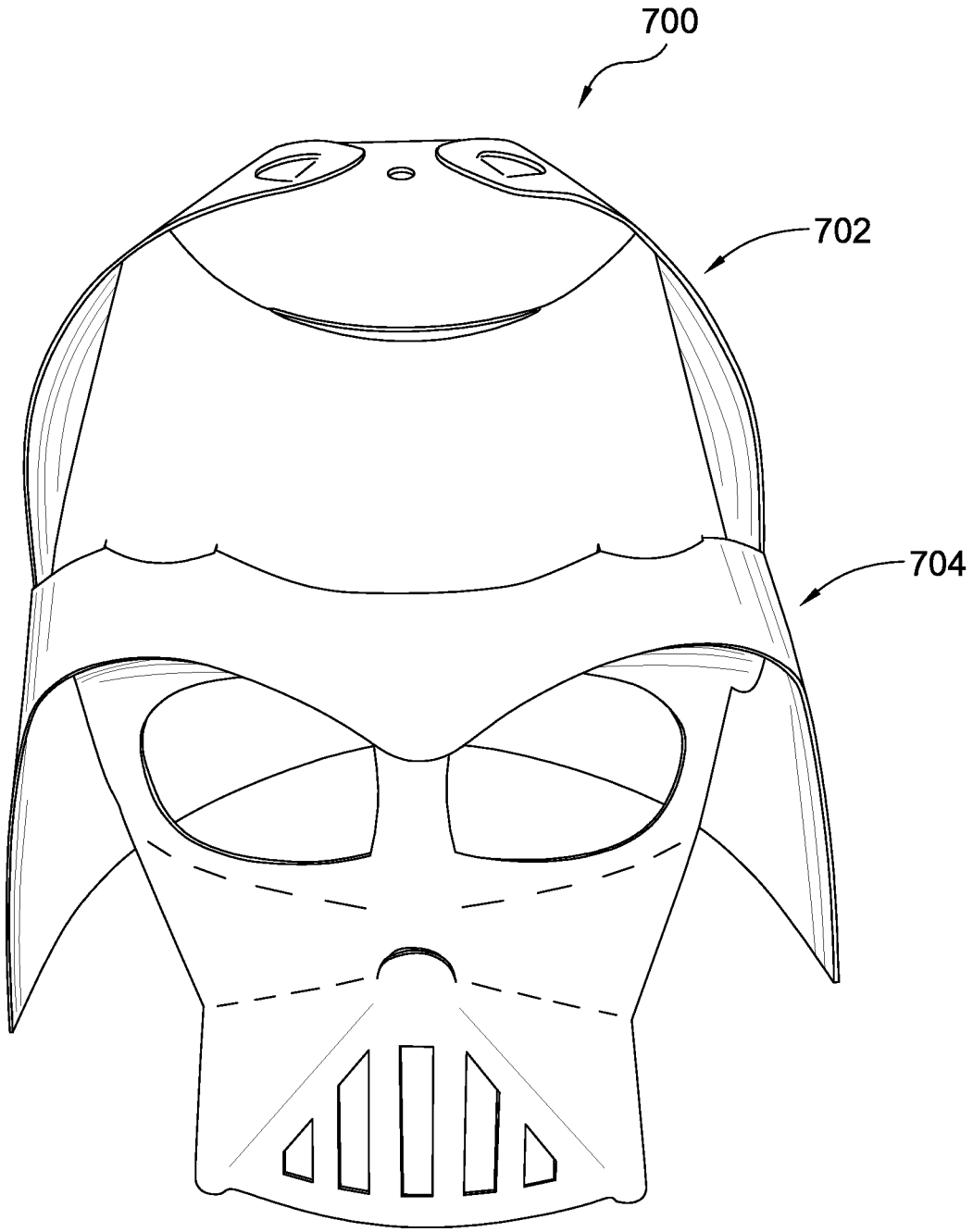
FIG. 28 is a top-front perspective view of one example of the present invention assembled in three dimensions to form a decorative headgear simulating a Darth Vader® helmet.
Figure 29:
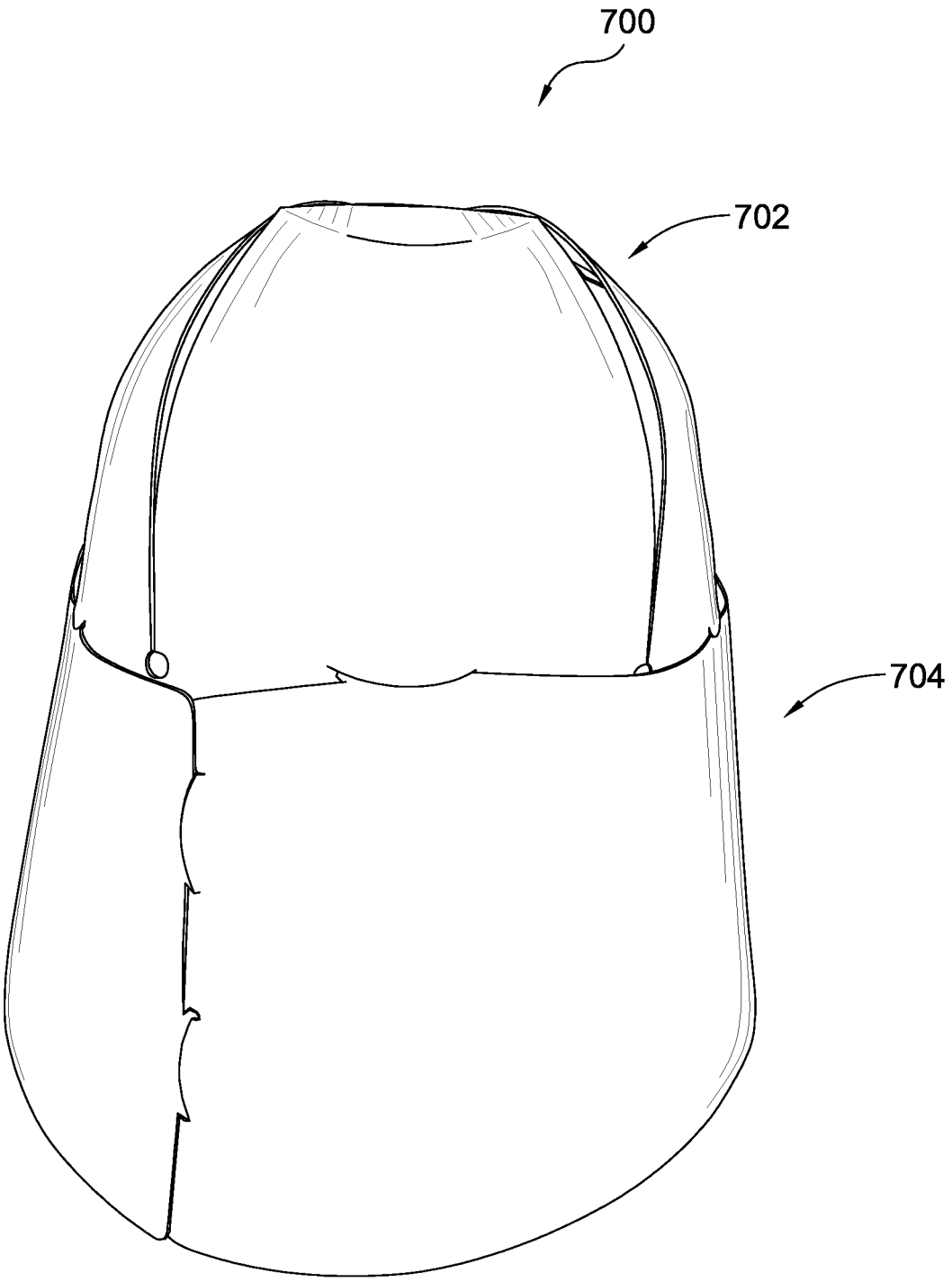
FIG. 29 is a rear elevation view of the example of FIG. 28.
Figure 30:
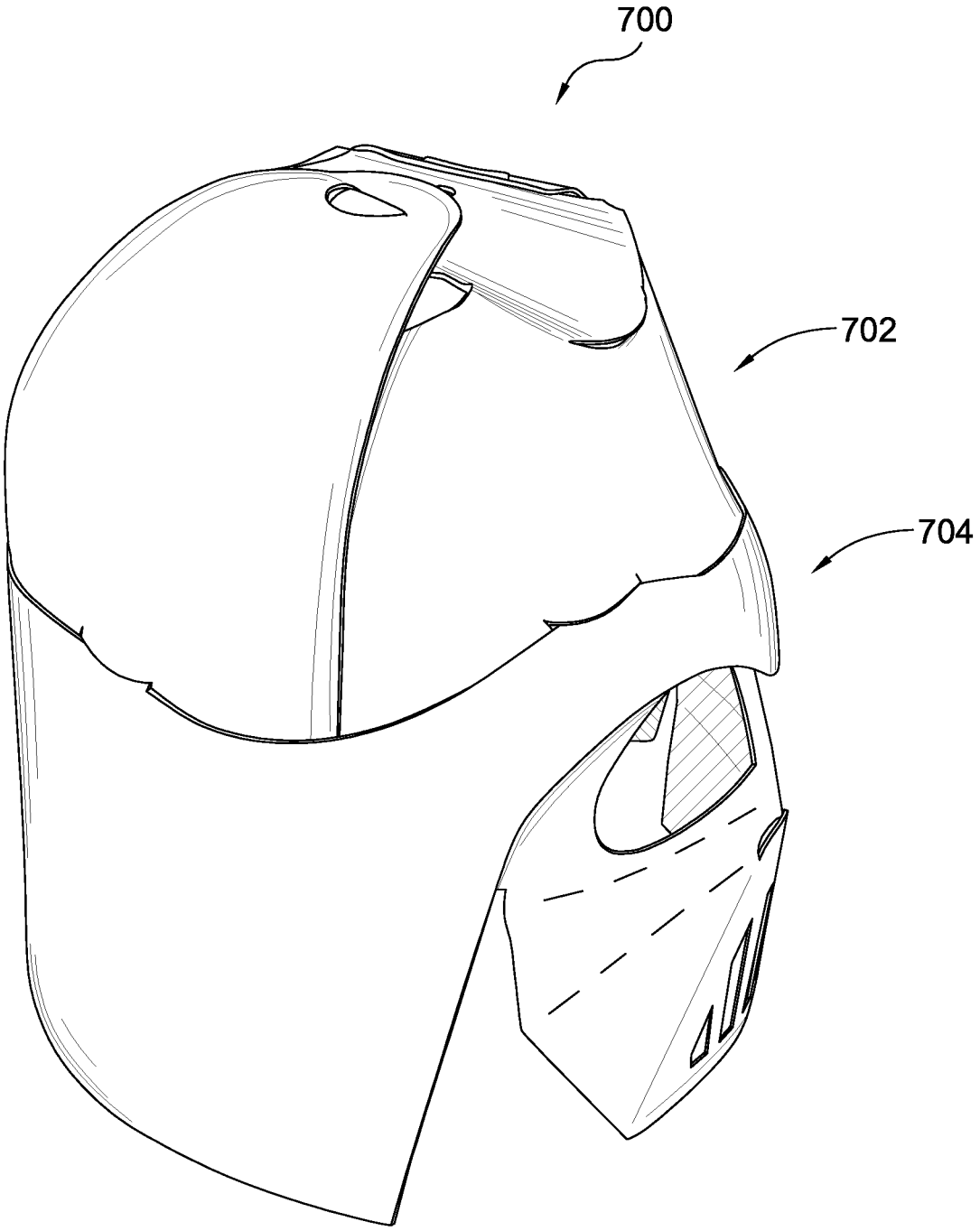
FIG. 30 is a top-right perspective view of the example of FIG. 28.
Figure 31:
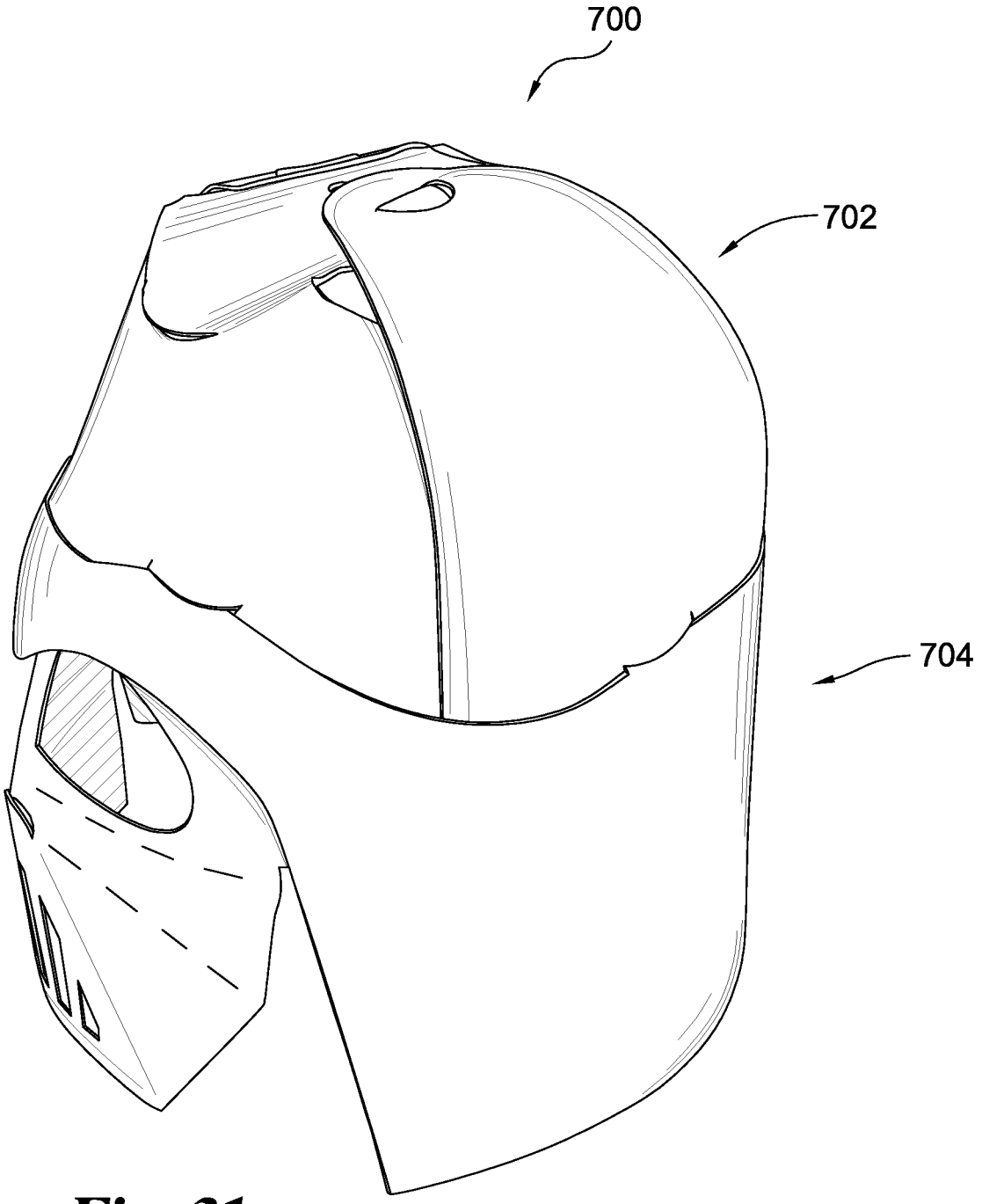
FIG. 31 is a top-left perspective view of the example of FIG. 28.
Figure 32:
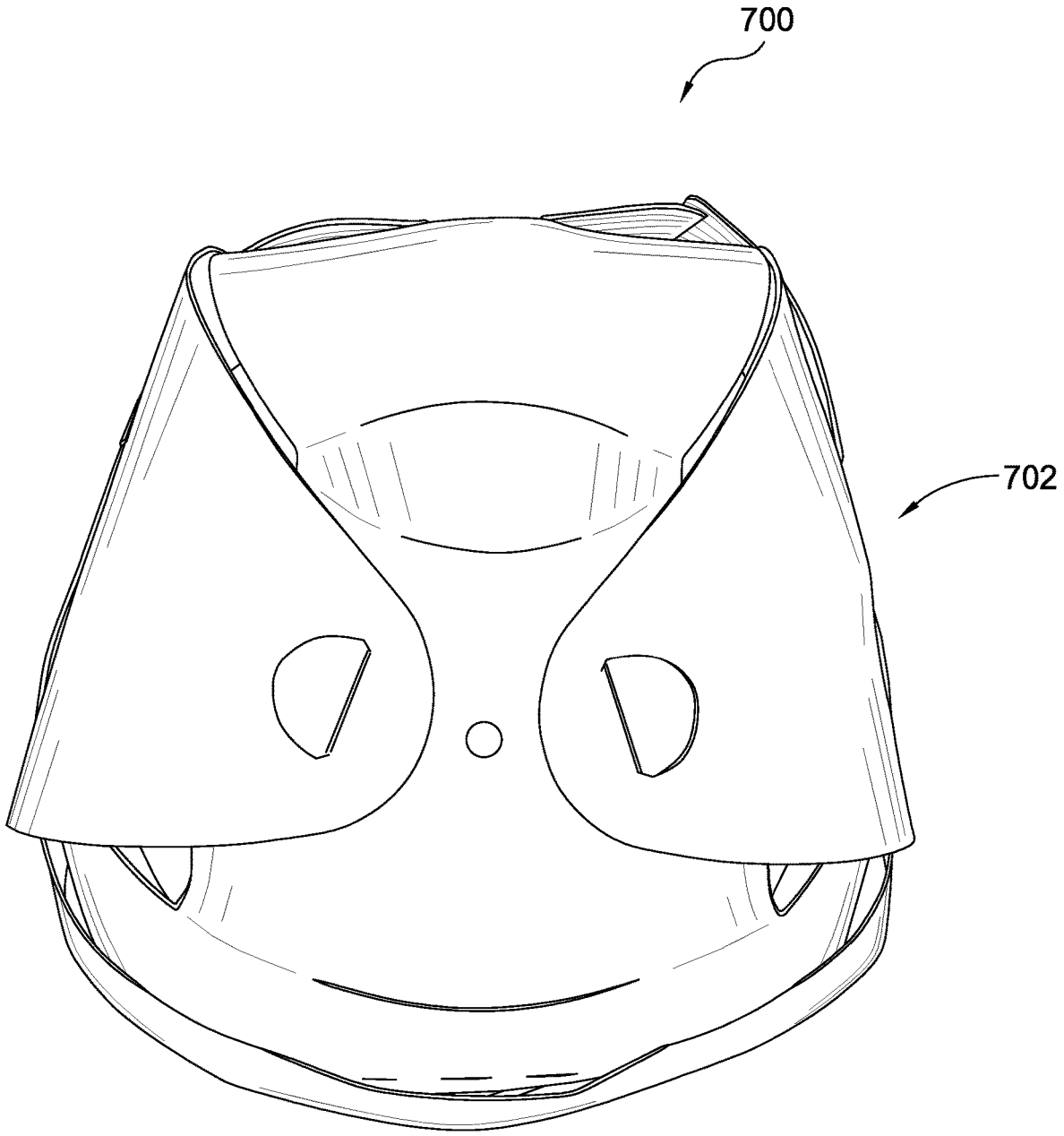
FIG. 32 is a top plan view of the example of FIG. 28.
Figure 33:
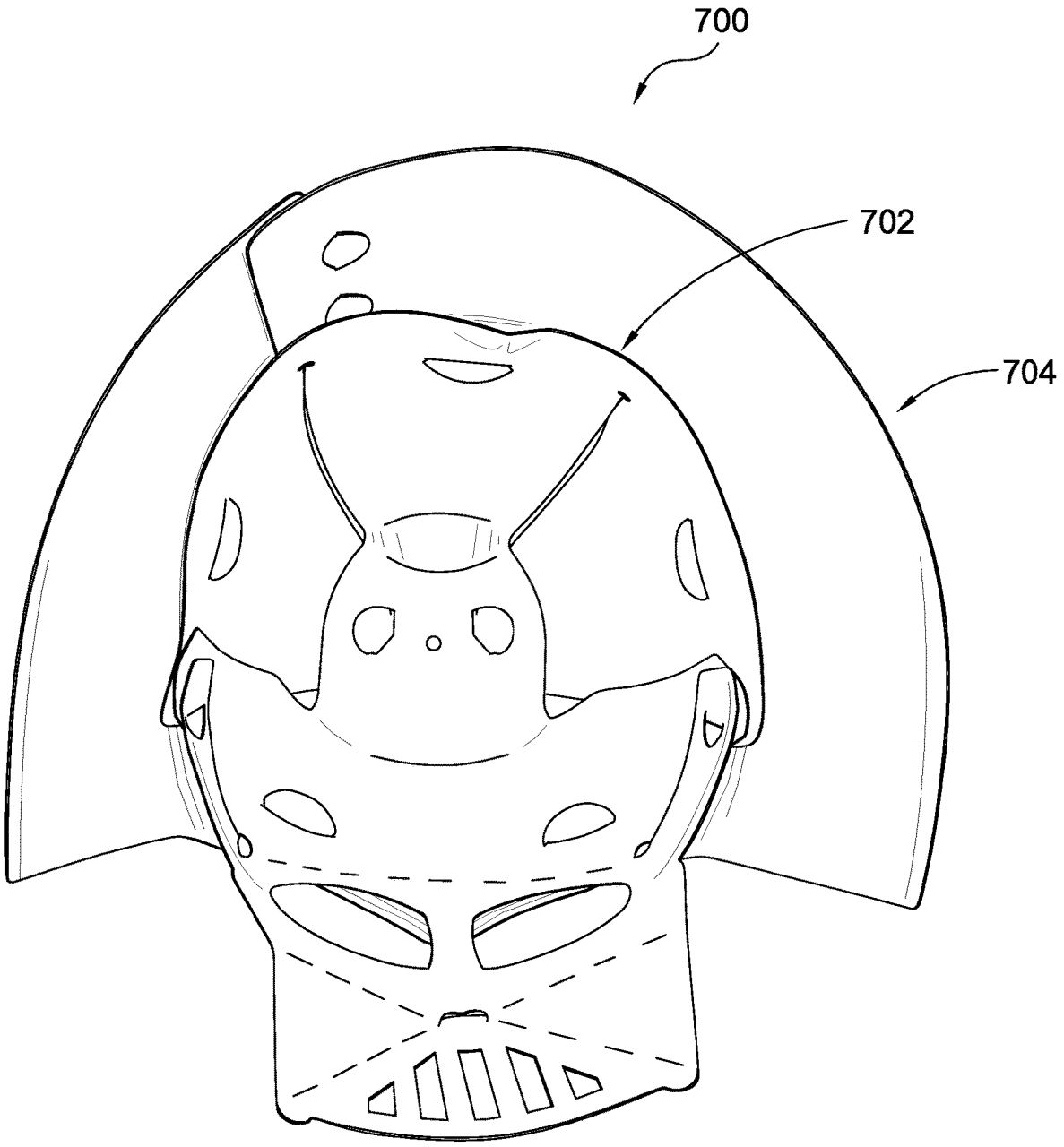
FIG. 33 is a bottom view of the example of FIG. 28.
Figure 34A:
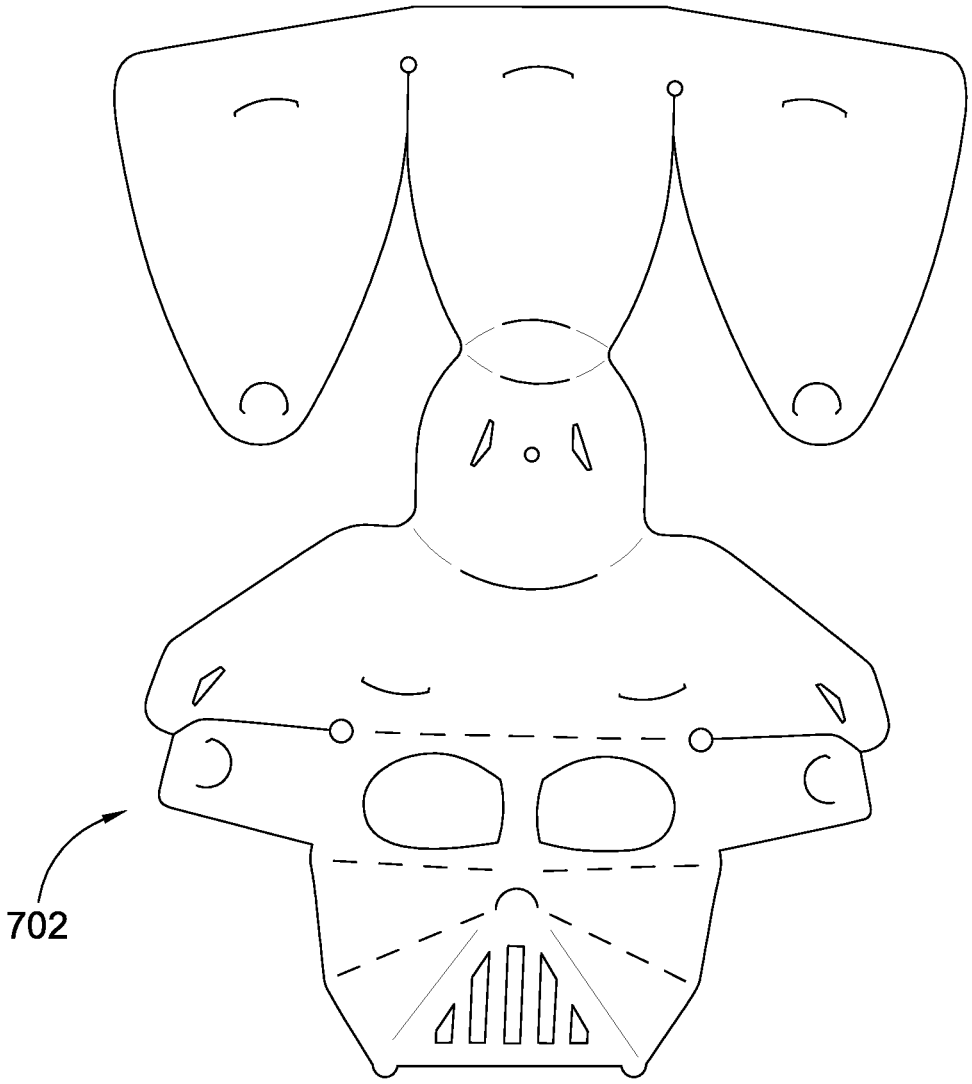
FIGS. 34A and 34B are top plan views of the helmet sheets in two dimensions for making the example of FIG. 28.
Figure 34B:
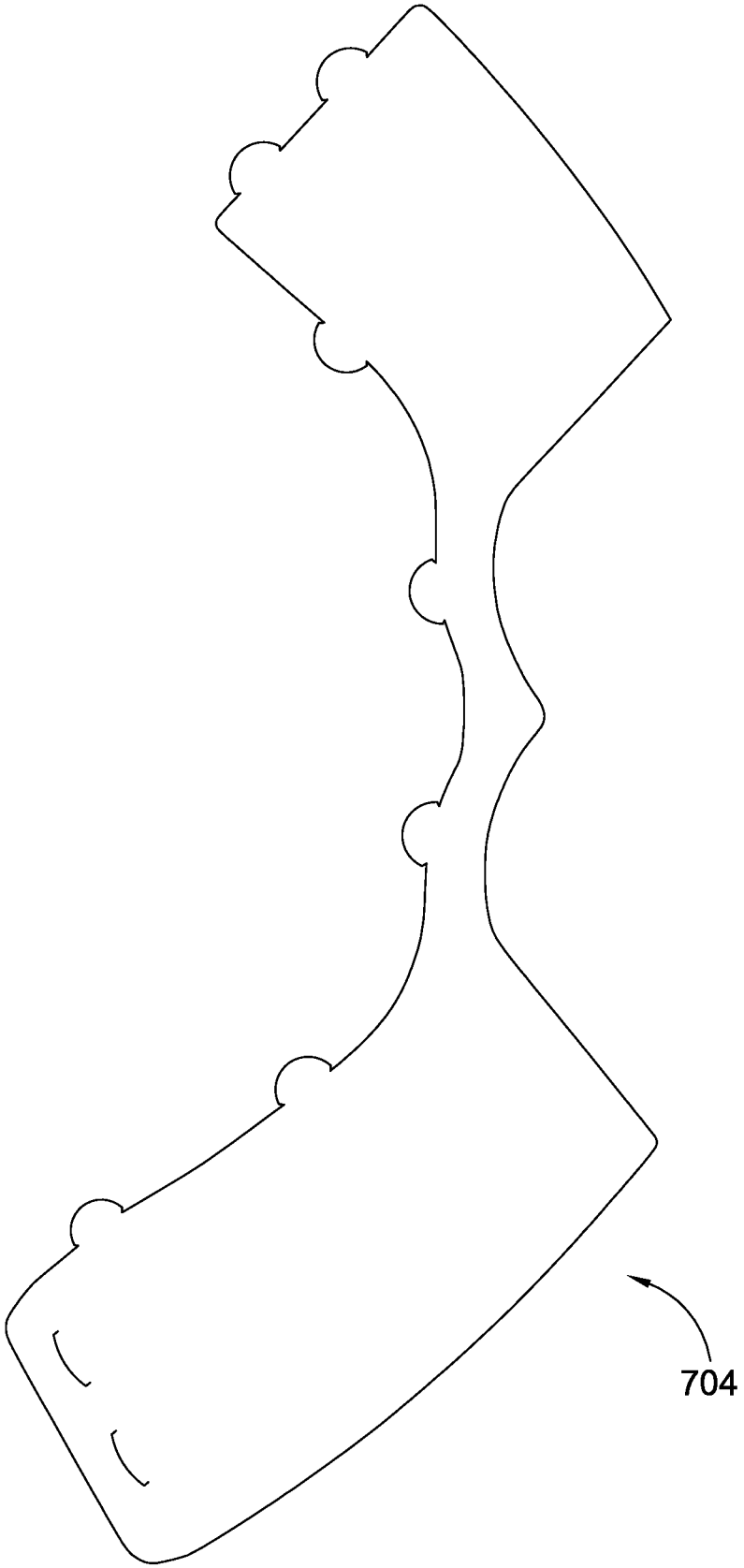
Figure 35:
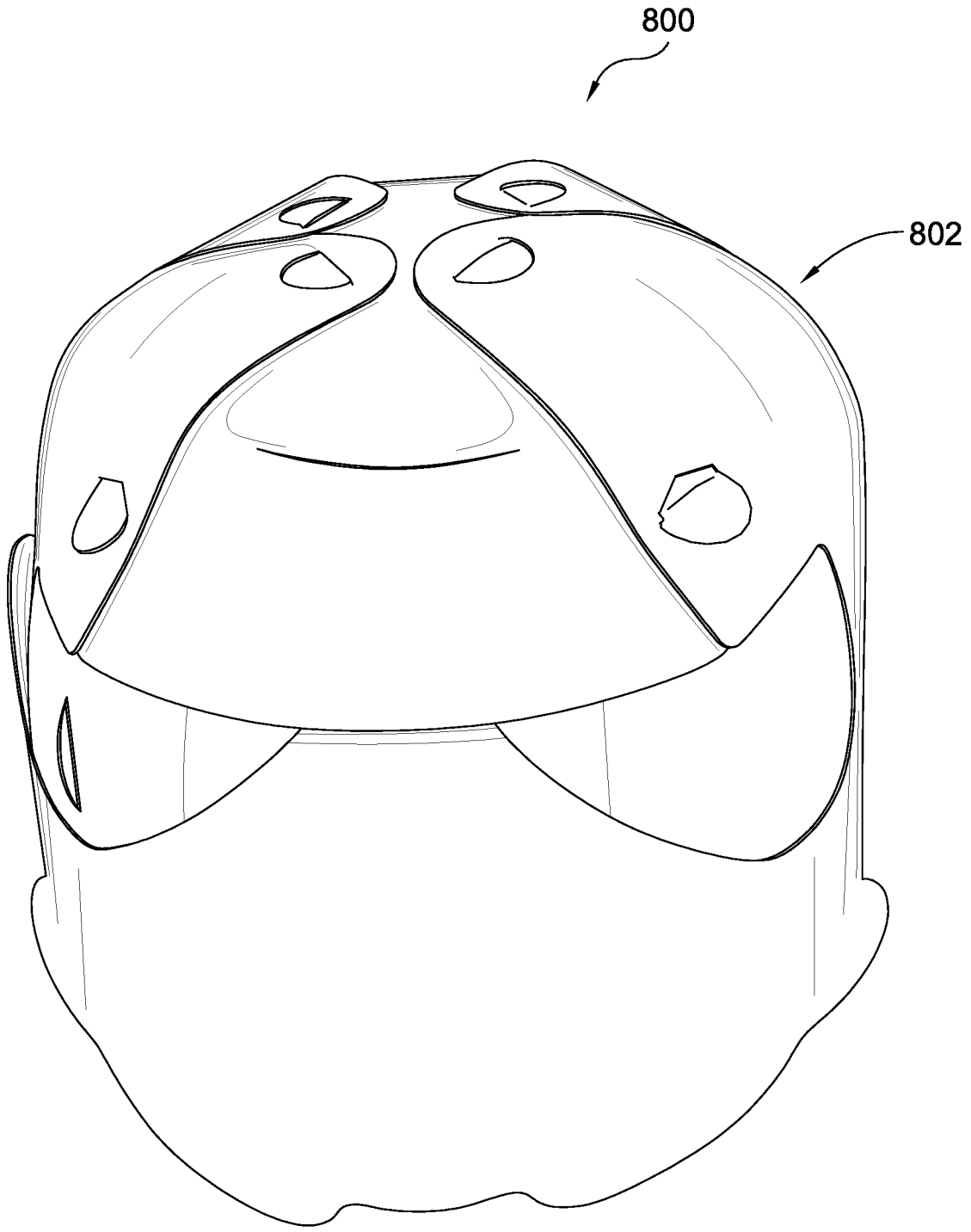
FIG. 35 is a top-front perspective view of one example of the present invention assembled in three dimensions to form a decorative headgear simulating a Stormtrooper® helmet.
Figure 36:
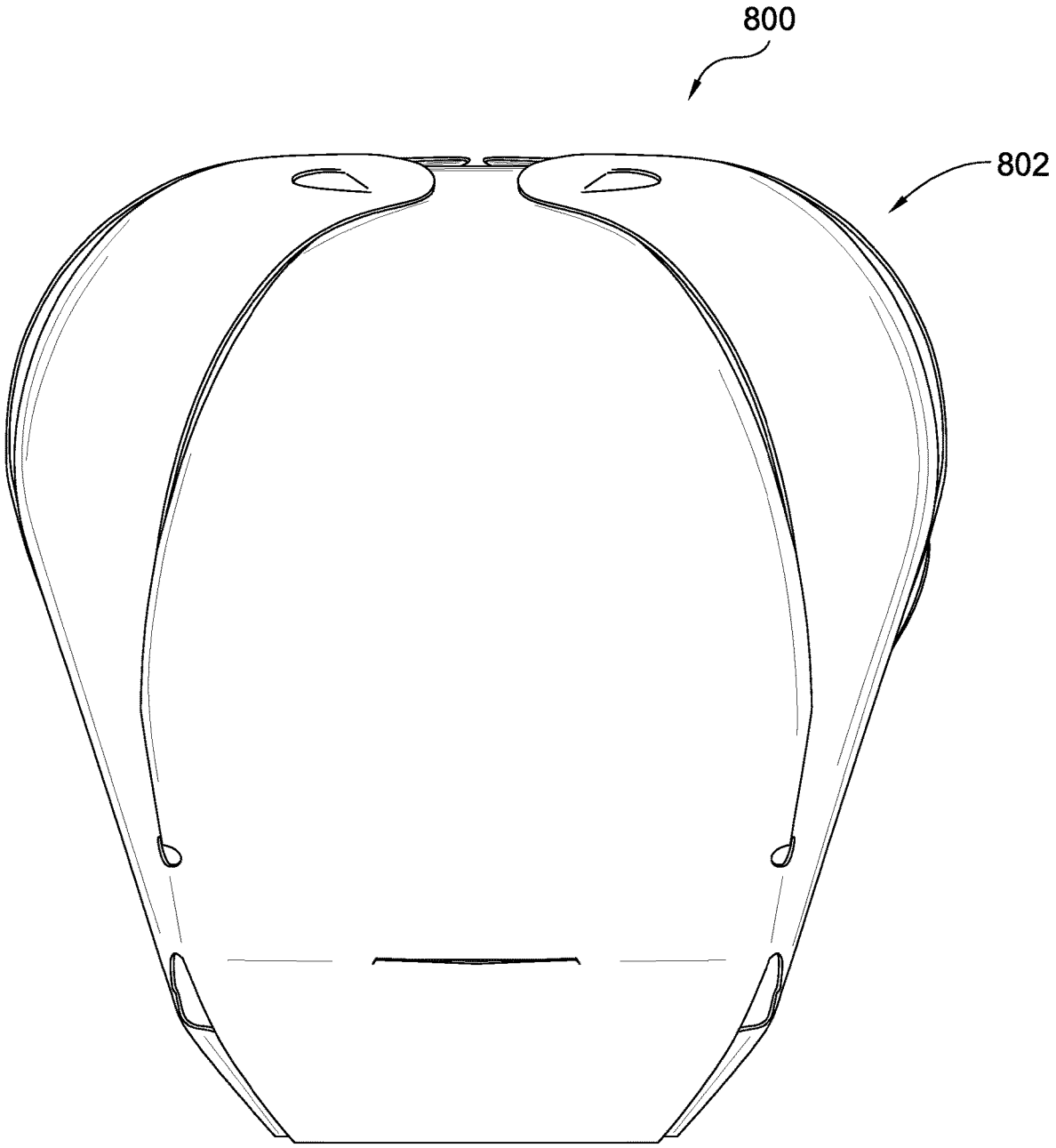
FIG. 36 is a top-rear perspective view of the example of FIG. 35.
Figure 37:
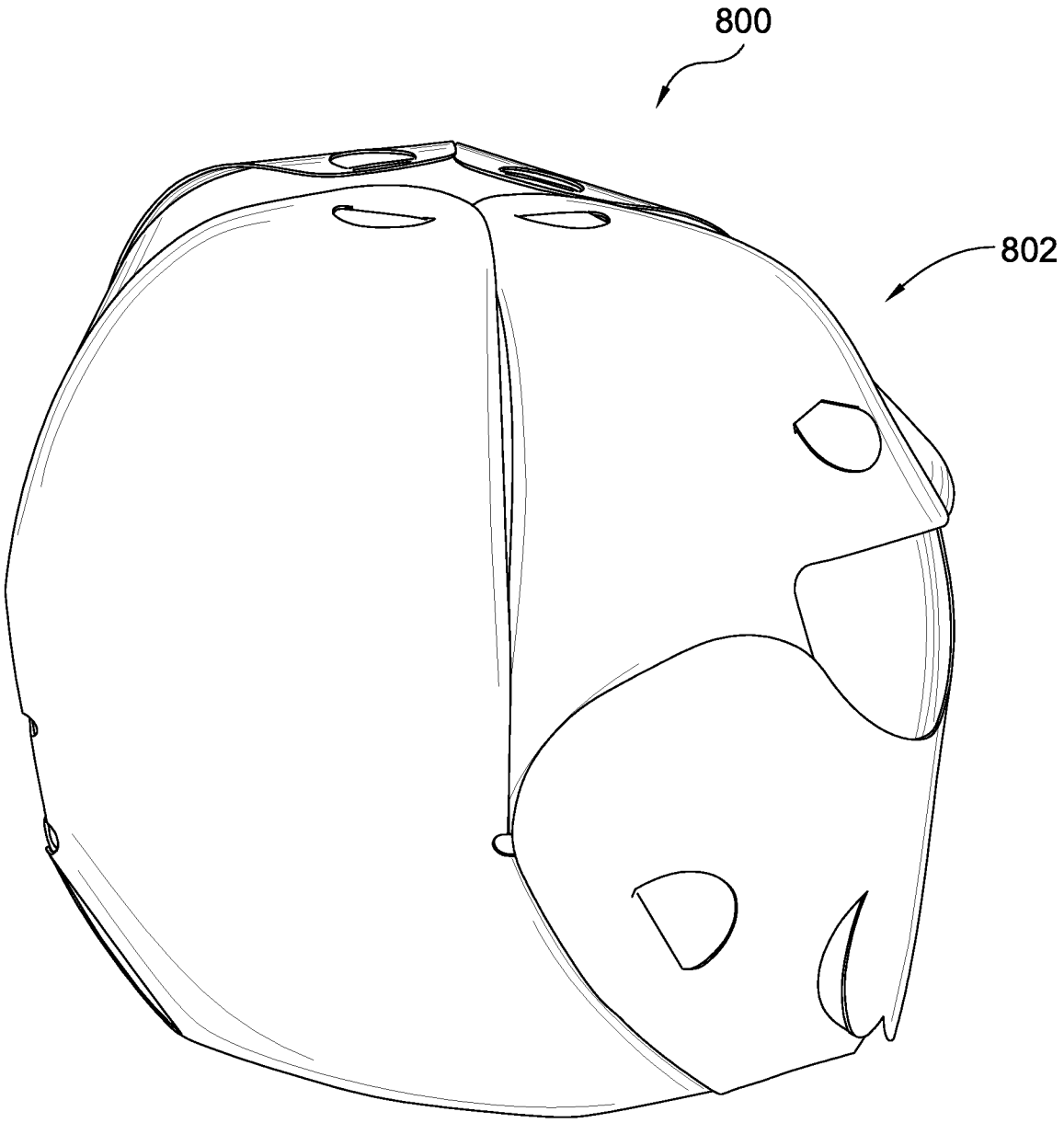
FIG. 37 is a top-right perspective view of the example of FIG. 35.
Figure 38:
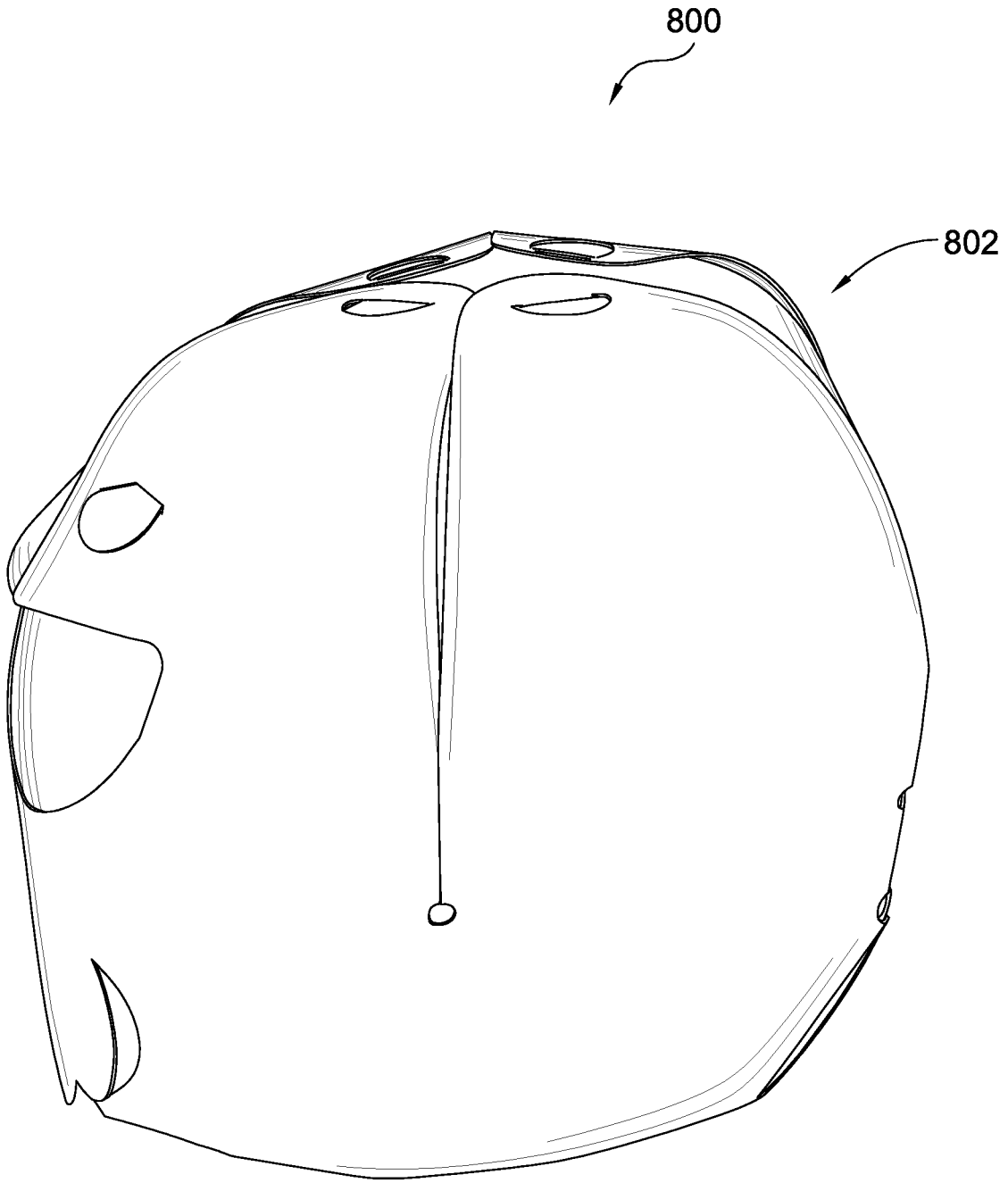
FIG. 38 is a top-left perspective view of the example of FIG. 35.
Figure 39:
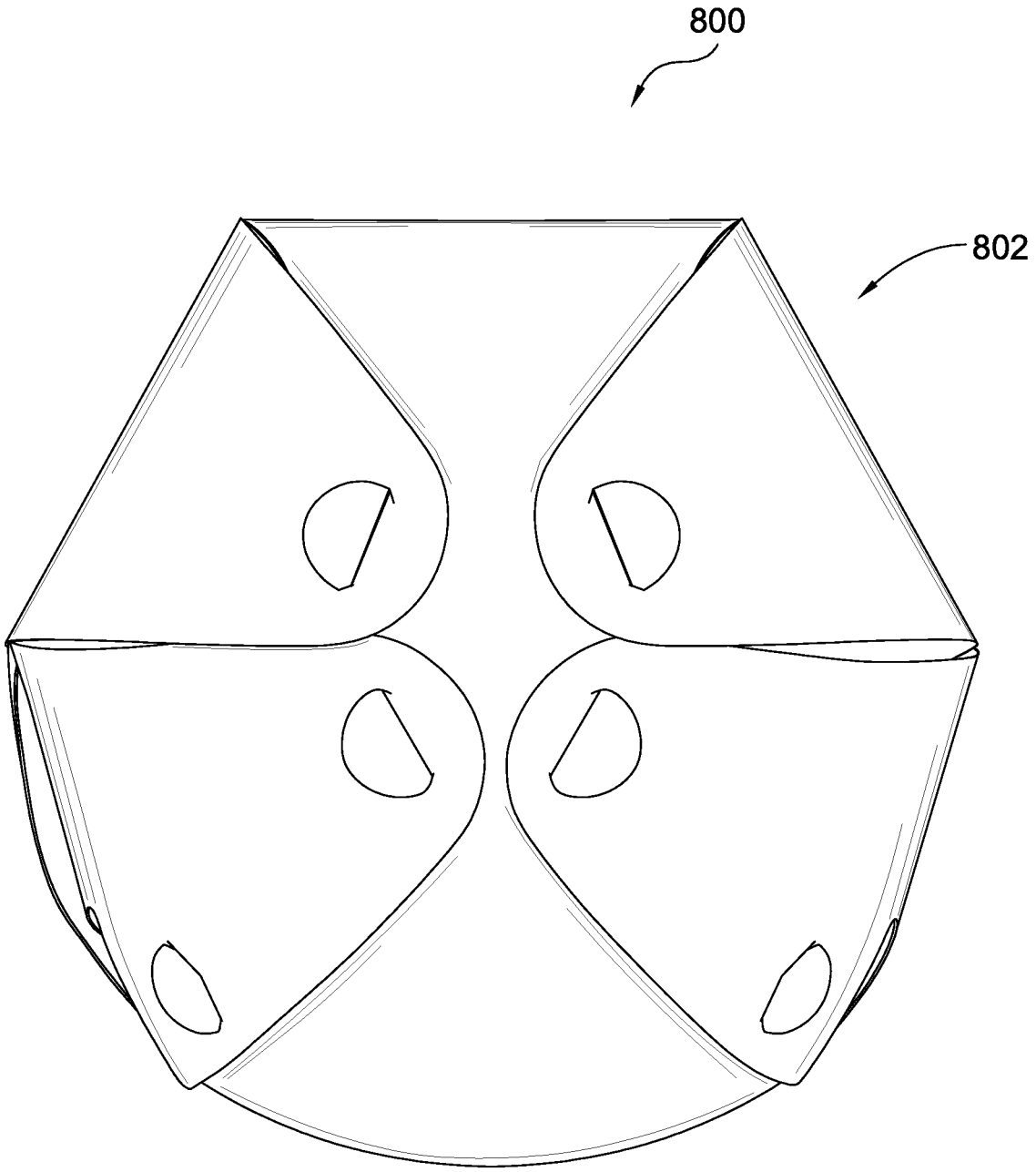
FIG. 39 is a top plan view of the example of FIG. 35.
Figure 40:
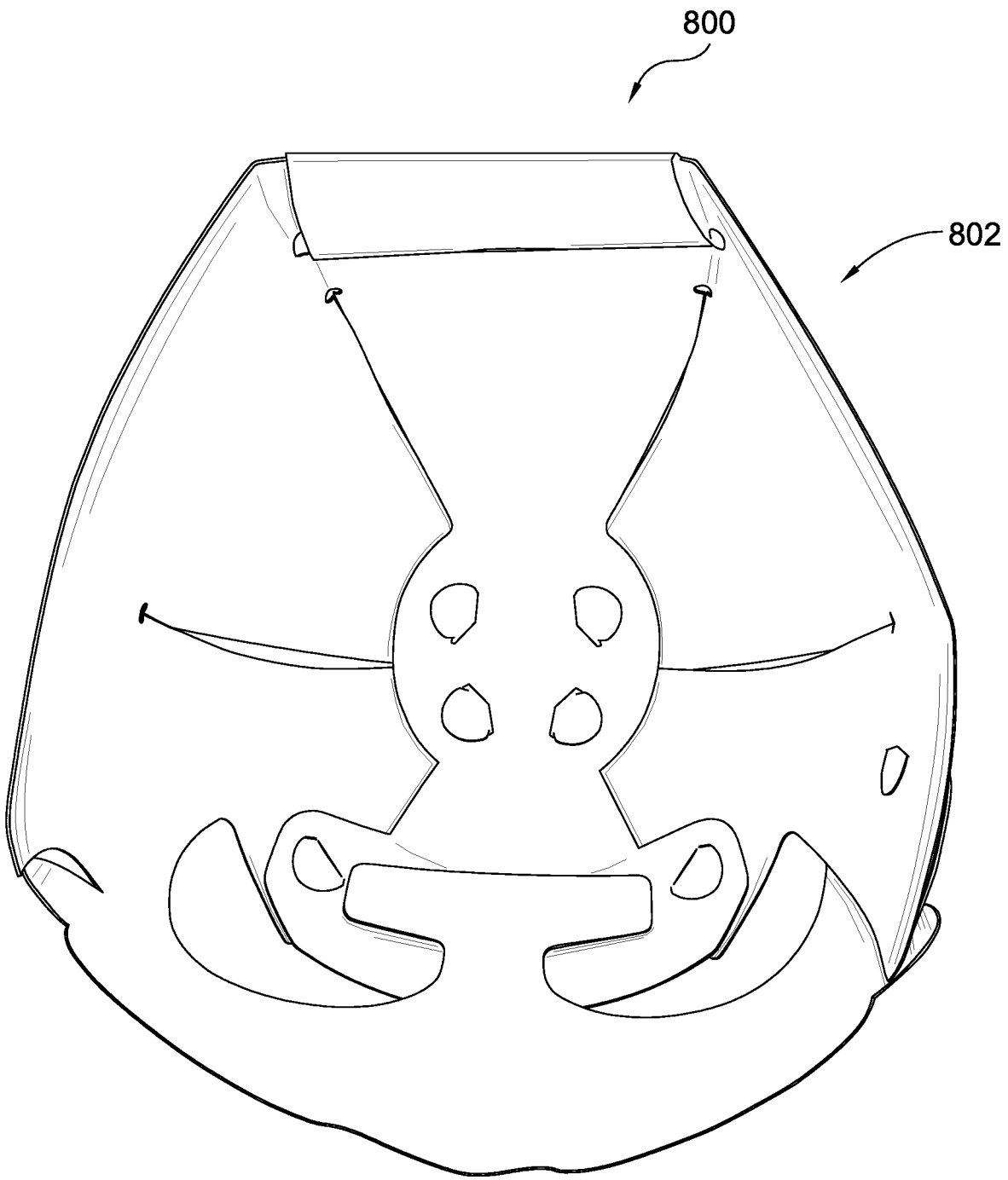
FIG. 40 is a bottom view of the example of FIG. 35.
Figure 41:
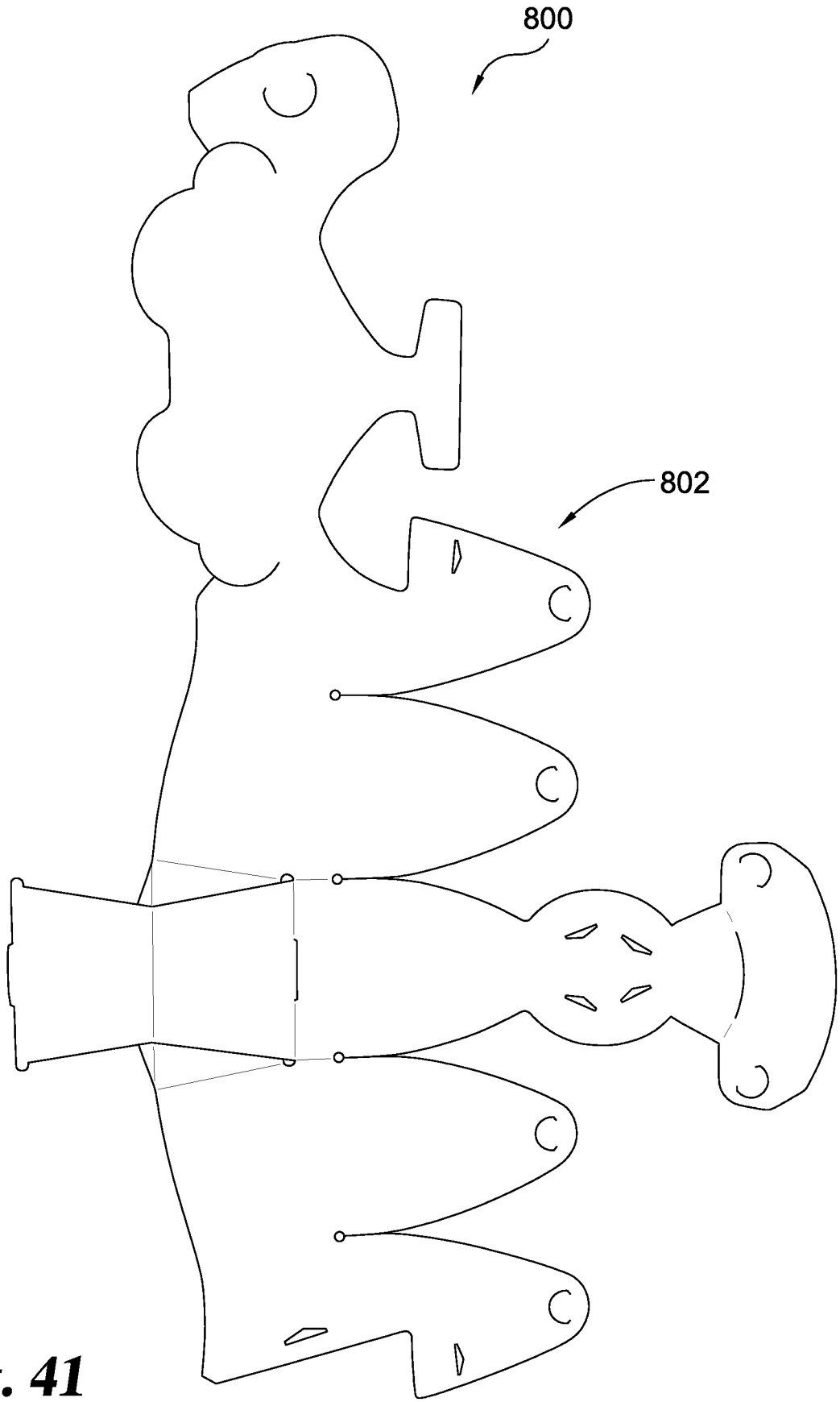
FIG. 41 is a top plan view of a+ helmet sheet in two dimensions for making a portion of the example of FIG. 35.
Figure 42A:
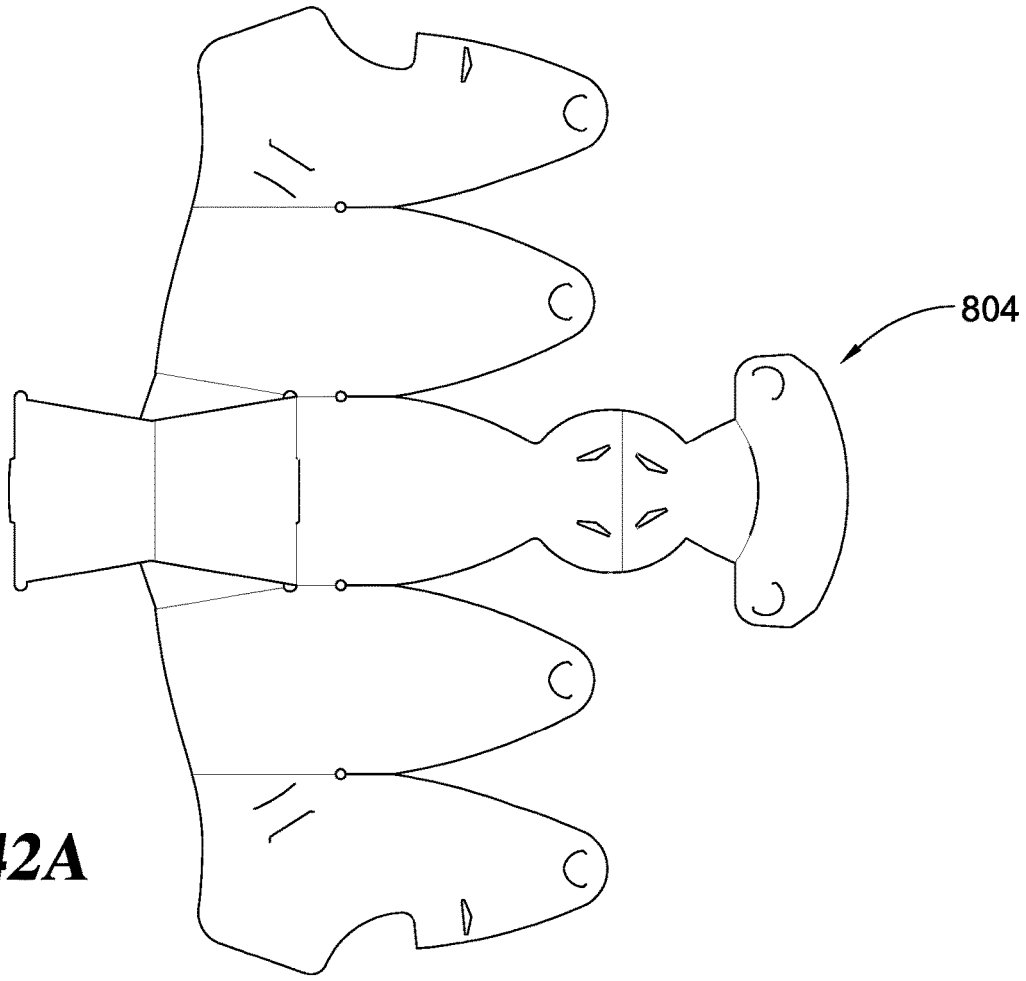
FIGS. 42A and 42B are half portions of an alternative version of the embodiment shown in FIG. 41.
Figure 42B:
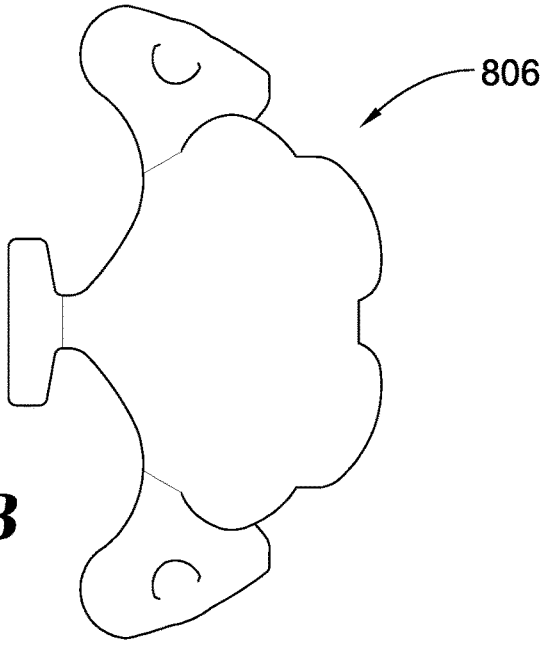

Optionally, but preferably, headgear 270 includes printed indicia 273 comprising a racing sponsor logo (see FIG. 19). The printed indicia may be printed on at least the RP, LP, BP, TP or any combination of panels.

Referring to the drawing FIGS. 20-27, a container 400 made from a sheet of thin flexible material, comprising: several pre-made cut lines 401, 402 in the sheet forming in whole or in part user wearable headgear 1 removable from the sheet; and, several pre-made fold lines 404, 401*a*, 401*b* in the sheet, said fold lines oriented to form said sheet into a container to hold other articles.

Optionally said sheet includes first printed indicia (see FIG. 10, 73) on said wearable headgear identifying a sports entity, and wherein said sheet includes second printed indicia, such as trademarks, logos, and the like, identifying said articles 900.

Optionally said fold lines are oriented to form said sheet into a rectilinear box 400.

Optionally the container further comprises adhesive and/or tabs 410 cut in said sheet, or both to hold said sheet together to form the container.

Optionally the sheet further includes several frangible lines (e.g. scored, dashed, deep folded, or otherwise) forming in part said wearable headgear removable from said sheet by tearing along said frangible lines.

Optionally the sheet further includes several printed lines forming in part said wearable headgear removable from said sheet by cutting along said printed lines.

Optionally the articles are beverage cans or bottles, and optionally are beer cans 900 or bottles. Optionally, they could be sports drinks, water, soft drinks or soda, food, snacks, chips, cereal boxes, and the like.

Optionally the said first printed indicia comprises a sports team logo 73. And, optionally, said second printed indicia comprises a beverage logo.

Figure 43:
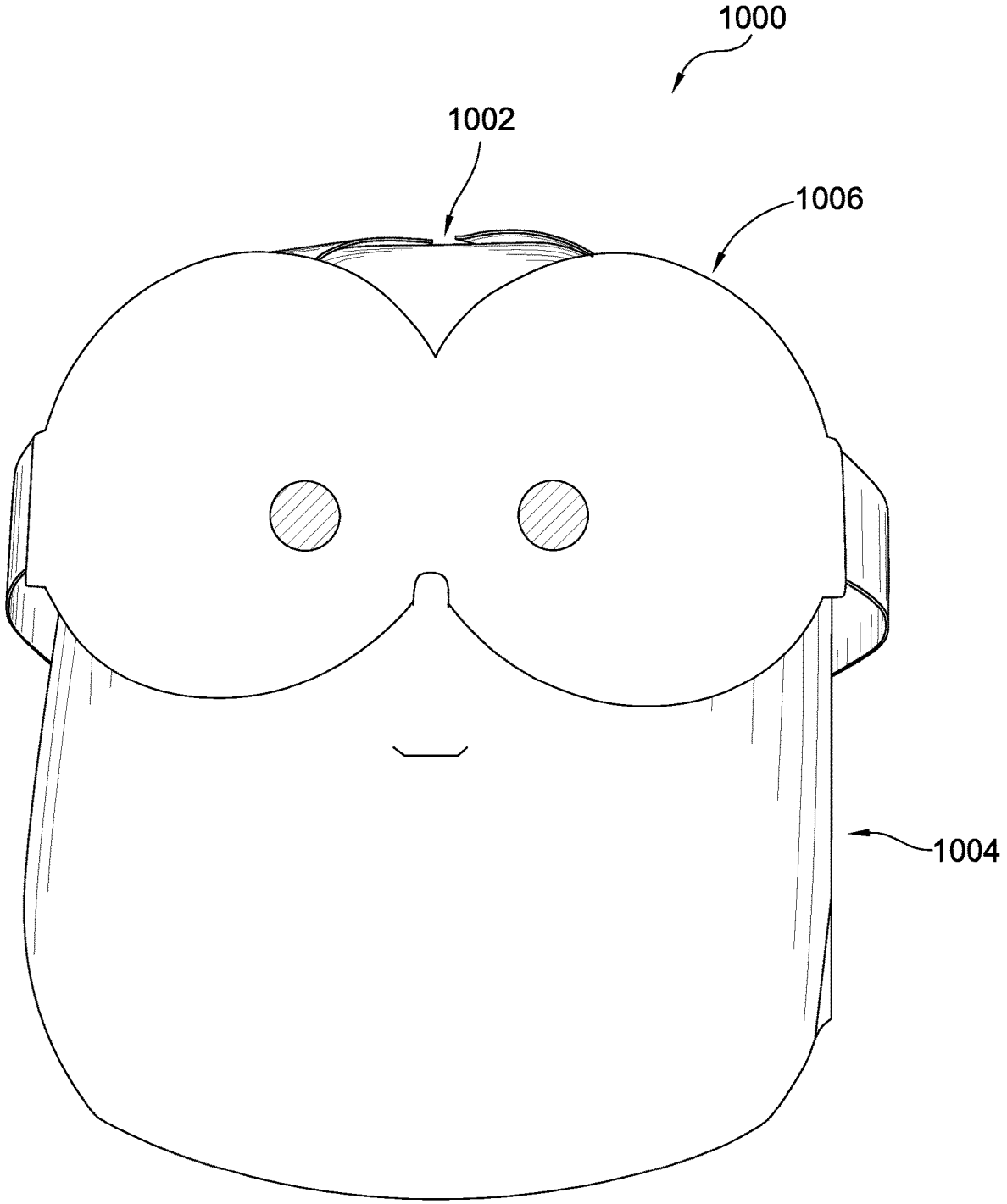
FIG. 43 is a front elevation view of one example of the present invention assembled in three dimensions to form a decorative headgear simulating a Minion® helmet.
Figure 44:
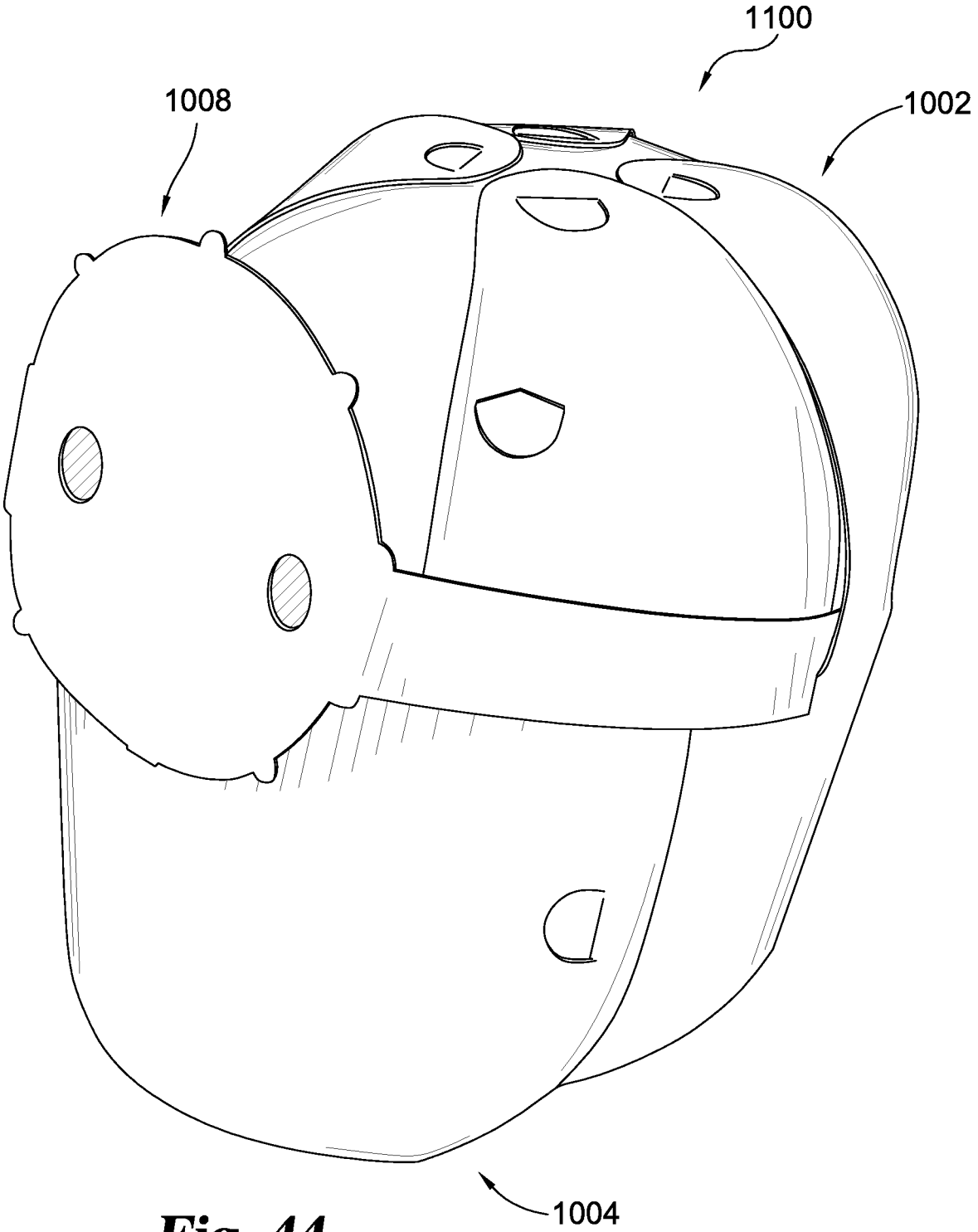
FIG. 44 is a left side elevation view of one example of the present invention assembled in three dimensions to form a decorative headgear simulating a Minion® helmet.
Figure 45A:
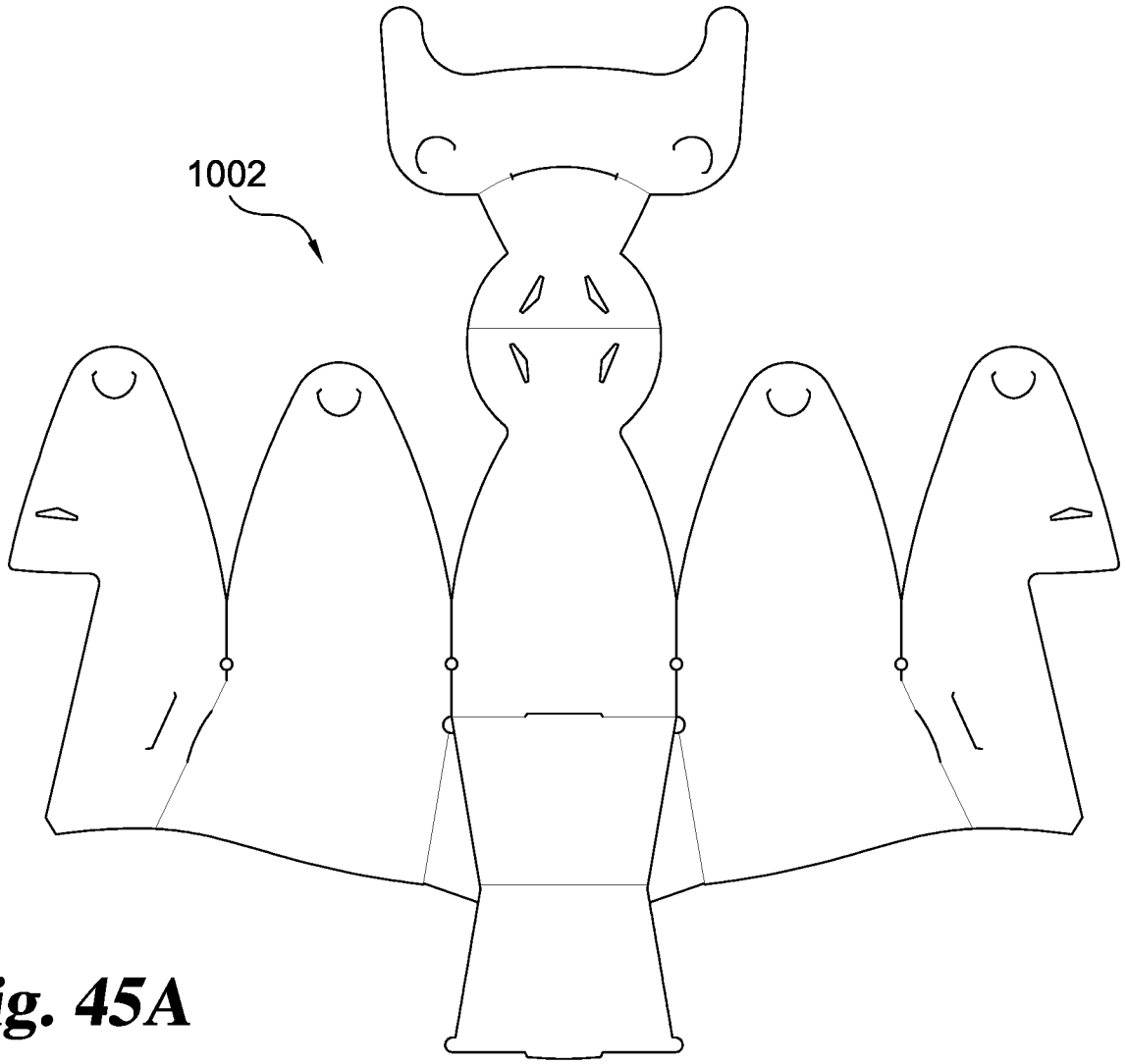
FIGS. 45A, 45B, 45C, and 45D are a top plan view of the helmet sheet in two dimensions for making the example of FIGS. 43 and 44.
Figure 45B:
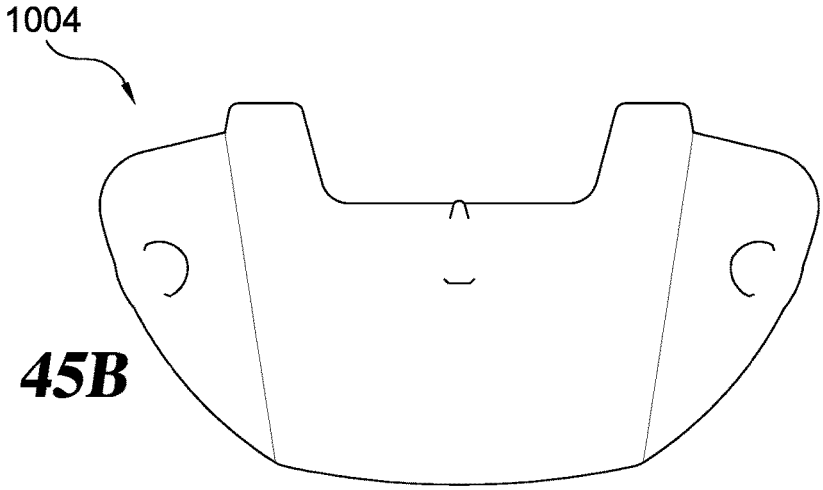
Figure 45C:
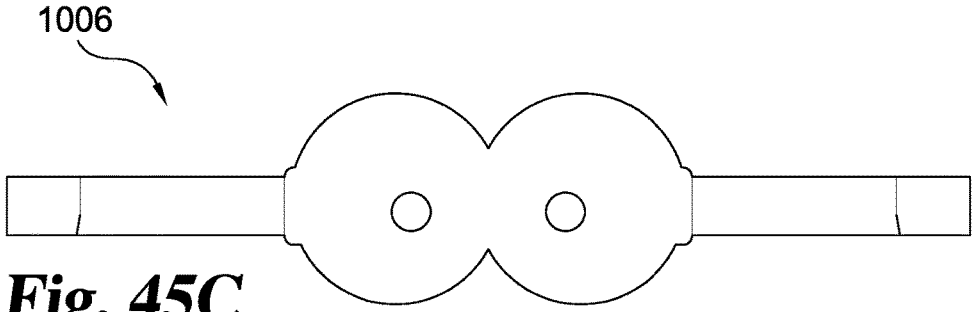
Figure 45D:
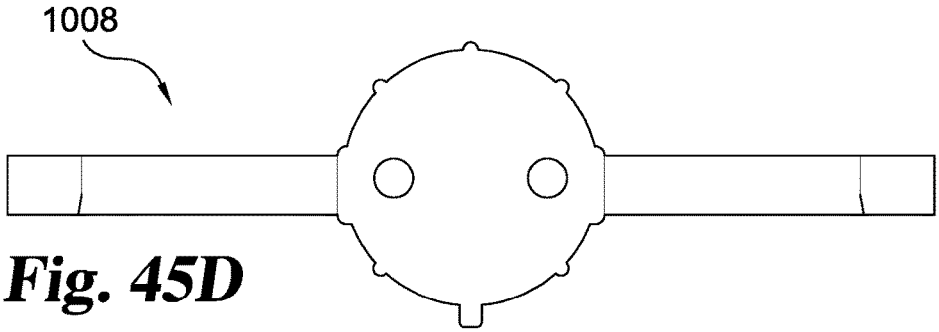

Optionally, said wearable headgear simulating sports headgear, selected from the group comprising football 1, baseball, cricket, auto racing, motorcycle racing and hockey. Optionally, said wearable headgear simulating a fictional/non-fictional character. Such character may include a character from a published movie (see 700, FIGS. 28-34 showing for example, Darth Vader from Star Wars; see 800, FIGS. 35-42 showing for example, a Stormtrooper from Star Wars; see 1000, FIGS. 43-45 showing for example, a Minion from The Despicable Me), selected from the group comprising movie super-hero, villain, and science fiction character.

Optionally, said wearable headgear removable from said sheet is as claimed in one or more of claims 1-31 of U.S. patent application Ser. No. 14/551,593, entitled DECORATIVE FOOTBALL HELMET, filed Nov. 24, 2014, and incorporate by reference herein; and/or, is as claimed in one or more of claims 1-35 of U.S. patent application Ser. No. 14/680,368, entitled DECORATIVE HELMET, filed Apr. 7, 2015, and incorporate by reference herein. Moreover, the headgear may be any size or shape or type made from a sheet, including without limitation for example those other types of such head gear list in the Information Disclosure Statements from the above two applications, also incorporated by reference herein.

Optionally said fold lines are oriented to form said sheet into a box which is rectilinear when viewed from a top plan view and which is non-rectilinear and which taper inward at its top half when viewed from a side elevation view.

Optionally, said at least two of said pre-made cut lines in the sheet are curvilinear.

Optionally, one, two or more extra panels may be included in the sheet without any or many pre-made cut lines and/or frangible lines for the headgear. This affords the option, for example, of having the headgear portion, when folded into a container (box or otherwise) to be located at a two-sheet layer thick portion of the container. In that way, optionally, the pre-made cut lines and/or pre-made frangible lines, to the extent they may weaken the overall strength or other integrity of the container, may be strengthened by the presence of another overlaying (and/or underlying) second (or third) layer at that portion of the container. When, for example, the headgear portion lies underneath such overlying layer, it may be accessed by a user by first disassembling the container back to sheet form, and then removing the headgear portion for headgear assembly. For example, in FIGS. 26 and/or 27, containers 500 and 600, respectfully are shown, each with an example headgear 1 and/or face cover 2*a*, comprising made from a sheet of thin flexible material, comprising: several pre-made cut lines, frangible lines, and/or printed lines for cutting in the sheet, formable in whole or in part into a user wearable headgear removable from the sheet; and, several pre-made fold lines in the sheet, said fold lines oriented to form said sheet into a container to hold other articles. Optionally, tabs 510 and/or 610 may be provided, such as for adhesive attachment to the other surfaces to make the three-dimensional container. Such containers 500 and/or 600 may form a sleeve, such as around a box of the type shown in FIGS. 20-25, (but without the cut lines in such box of FIGS. 20-25). In that way, the box, such as for beer or otherwise, can maintain its strength, with the largely uncut box forming the inner layer, with the helmet in the outer layer made by the sheet of FIG. 26 or 27. Or, alternatively, the box may have cuts, such as shown in FIGS. 20-23, with the overlaying layer being a sleeve of the type shown in FIGS. 26 and/or 27 or otherwise, (but without the cut lines in such box of FIGS. 26-27). Or, the sheets of either FIGS. 26 and/or 27 may be combined, in whole or in part, with a sheet of FIG. 23, and folded into a finished container, wherein the headgear is formed in one or the other portions, or in overlapping portions of such combined sheets. Optionally, but preferably, the outer layer would include at least some of the trademarks and/or other printed indicia reflecting the contents of the container. The headgear of FIGS. 26-27 may be other than the football helmet shown in that example. For instance, the headgear of FIGS. 26-27 may be other sports headgear or a fictional/non-fictional character.

Referring to the drawing FIGS. 28-34B, a wearable headgear simulating non-sports headgear and further comprises headgear simulating headgear of a fictional/non-fictional character from a published movie (see 700, FIGS. 28-34B showing for example, Darth Vader from Star Wars), selected from the group comprising movie super-hero, villain, and science fiction character. The headgear 700 of FIGS. 28-34B includes a first helmet sheet 702 and a visor 704.

Referring to the drawing FIGS. 35-42B, a wearable headgear simulating non-sports headgear and further comprises headgear simulating headgear of a fictional/non-fictional character from a published movie (see 800, FIGS. 35-42 showing for example, a Stormtrooper from Star Wars), selected from the group comprising movie super-hero, villain, and science fiction character. The headgear 800 illustrated in FIGS. 35-42B may be formed of an integral helmet sheet 802 or from the assembly of a helmet sheet 804 and a lower front panel, which, in use, may be a chin cover 806.

Referring to the drawing FIGS. 43-45D, a wearable headgear simulating non-sports headgear and further comprises headgear simulating headgear of a fictional/non-fictional character from a published movie (see 1000, FIGS. 43-45D showing for example, a Minion from The Despicable Me), selected from the group comprising cartoon fiction character. The headgear 1000 and 1100 illustrated in FIGS. 43-45D can be formed from a combination of a helmet sheet 1002, a chin cover 1004, and at least one of visors 1006 and 1008.

Headgear simulating headgear of other fictional/non-fictional characters is contemplated. For instance, headgear simuating the headgear and/or face of a Marvel Worldwide, Inc. character such a character of the Avengers, Guardians of the Galaxy, X-Men, Defenders, Fantastic Four, Brotherhood of Evil Mutants, Illuminati, Inhumans, Ant-Man, Iron Man, Captain America, Hulk, Spider-Man, Thor, X-Men, Black Panther, Daredevil, Ultron, Red Skull, Thanos, Ronan, Magneto and Dr. Doom, just to name a few non-limiting examples. Similarly, headgear may simulate the headgear and/or face of a DC Comics character such as a character of the Justice League, Green Lantern Corps, Watchmen, Superman, Batman, Wonder Woman, Green Lantern, The Flash, Joker, Hawkman, Hawkgirl, Lex Luther, Catwoman, Robin, Aquaman, Bane, Batgirl, and Harley Quinn, just to name a few non-limiting examples. Headgear may also simulate the headgear and/or face of a Disney character such as Mickey Mouse, Minnie Mouse, Donald Duck, Goofy, a Disney Princess such as Cinderella, Belle, Rapunzel, Snow White, Ariel, Mulan, Aurora, Jasmine, Tiana, Merida and Pocahontas, a Disney villian, or a character from Star Wars, Frozen, Lion King, Monsters Inc., Finding Nemo, Toy Story, Cars, Pirates of the Carribean, Alladin, Winnie the Pooh, and Peter Pan, just to name a few non-limiting examples.

As used here (claims, specification, and other definitions) the following terms have the following meaning:

Articles and phases such as, "the", "a", "an", "at least one", and "a first", "comprising", "having" and "including" here are not limited to mean only one, but rather are inclusive and open ended to also include, optionally, two or more of such elements and/or other elements. In terms of the meaning of words or terms or phrases herein, literal differences therein are not superfluous and have different meaning, and are not to be synonymous with words or terms or phrases in the same or other claims.

The term "means for" in a claim invokes 35 U.S.C. § 112(f), literally encompassing the recited function and corresponding structure and equivalents thereto. Its absence does not, unless there otherwise is insufficient structure recited for that claim element. Nothing herein or elsewhere restricts the doctrine of equivalents available to the patentee.

The term "and/or" is inclusive here, meaning "and" as well as "or". For example, "P and/or Q" encompasses, P, Q, and P with Q; and, such "P and/or Q" may include other elements as well.

In terms of orientation, the front is the face, with top, right, left and back (of the skull) having ordinary meaning. An axis Z is shown (see FIG. 8) which is a vertical axis, from bottom to top. However, there is no limitation to actual presentation of the apparatus of the invention, where the apparatus may be provided in any orientation.

The term "American-football helmet" as used herein has the meaning, a protective helmet, typically made of plastic and with a facemask on the front as used in American-football (such as, for example, the National Football League (NFL)).

The term "anti-stress riser hole" as used herein has the meaning, a hole, aperture or portion thereof having an edge which is generally curvilinear and without sharp corners.

The term "assembled in three-dimensions" as used herein has the meaning, no longer in two-dimensions, but rather assembled to have a volume.

The term "back panel" (BP) as used herein has the meaning, a structure that is joined to a top panel, and which comprises a top edge, a right edge, a left edge and a bottom edge distal from the top edge, wherein the bottom edge extends further in a lateral direction that the top edge. In use, the back panel (BP) is a portion of a sheet sized, shaped and positioned to cover some or a majority of the backside of a wearer's skull.

The term "bars" as used herein has the meaning, a cage like structure defining gaps there-between.

The term "connector" as used herein has the meaning, of a connecting structure, including without limitation, a slit, hole, hook, notch, tab, projection, peel-off backing adhesive, hook and/or loop (e.g. Velcro™), or otherwise that is user connectable to another such structure or surface or opening on or in the headgear to help hold the thin flexible sheet(s) in the shape simulating headgear.

The term "converge" as used herein has the meaning, to come together or towards one another.

The term "chin cover" (CC) as used herein has the meaning, a structure that is formed from the front panel and/or the lower front panel, and which, in use, is used to cover the chin for protection or to assist in keeping headgear from being removed from the head (e.g., a chinstrap). The term includes, but is not limited to, a racing helmet chin guard and a facemask.

The term "decorative" as used herein has the meaning, for decorative rather than impact protective use.

The term "diverges" as used herein has the meaning opposite of converge.

The term "ear hole" as used herein has the meaning, an opening in the sheet in either the right or left panel and, greater than about one centimeter across and located over or near the wear's ears.

The term "edge variance" as used herein has the meaning, the absolute value (positive) of the maximum distance, (whether positive or negative), that two edges are, respectively, separated from or overlap each other. Perfectly abutting edges have, at that point, a zero edge variance.

The term "facemask" (FM) as used herein has the meaning, a cage like structure (with or without actual or simulated visor) to cover at least a lower portion of a wear's face while allowing visibility above and/or through it.

The term "folding line" as used herein has the meaning, a pre-existing printed line (straight, dotted, dashed, etc.) and/or pre-existing score, crease or perforations guiding there-along a fold in part of all of a sheet.

The term "football team logo" as used herein has the meaning, any one or more service marks, symbols, images and/or words used to identify a football team.

The term "front panel" (FP) as used herein has the meaning, a structure that extends from the top panel (TP). In use, FP is a portion of a sheet sized, shaped and positioned to cover at least a portion of the crown of a wear's skull in front of the top side.

The term "headgear" as used herein has the meaning, an article, such as a helmet, wearable on a person's head.

The term "integral" as used herein has the meaning, made substantially from the same and contiguous sheet material, as opposed for example to two separate parts connected to each other.

The term "in two-dimensions" as used herein has the meaning, when an object, such as a sheet, is substantially flat/planar.

The term "inwardly" as used herein has the meaning, in a direction toward the wearer's skull.

The term "leading generally vertical edge" as used herein has the meaning, a free edge which is positioned toward the face of the wearer relative to the panel or other structure of which the edge is a part.

The term "left front sub-panel" (LFSP) as used herein has the meaning, a panel which makes up a part of the left panel and which is positioned to cover between about one-third to about one two-thirds of the left side of the wear's skull and is generally forward of center.

The term "left rear sub-panel" (LRSP) as used herein has the meaning, a panel which makes up a part of the left panel and which is positioned to cover between about one-third to about one two-thirds of the left side of the wear's skull and is generally rearward of center.

The term "neck panel" (NP) as used herein has the meaning, a structure that is formed from the back panel (BP), and which, in use is a portion of a sheet sized, shaped and positioned at or over the interface of the neck and the back of a wear's skull.

The term "plastic" as used herein has the meaning, primarily made of a polymer material.

The term "printed indicia" as used herein has the meaning, image, logo, lettering, numbering, symbol and/or a combination thereof that is laminated in, printed in or on a sheet and is visible.

The term "racing" and "racing helmet" as used herein has the meaning, pertaining to or a helmet for racing vehicles, such as for example cars, motorcycles and/or boats.

The term "right front sub-panel" (RFSP) as used herein has the meaning, a panel which makes up a part of the right panel and which is positioned to cover between about one-third to about one two-thirds of the right side of the wear's skull and is generally forward of center.

The term "right panel" (RP) as used herein has the meaning, a portion of a flexible sheet extending from the right edge of a back panel (BP). In use the RP is sized, shaped and positioned to cover a part and/or majority of the right side of a wear's skull.

The term "right rear sub-panel" (RRSP) as used herein has the meaning, a panel which makes up a part of the right panel and which may be positioned to cover between about one-third to about one two-thirds of the right wear's skull and is generally rearward of center.

The term "separate" as used herein has the meaning, made up of two or more items which are not integral.

The term "sheet" as used herein has the meaning, a single or multi-laminate product, such as made from paper, cardboard, foil, plastic film or a combination thereof.

The term "simulating the appearance" as used herein has the meaning, to look like something else.

The term "slit/tab interfaces" as used herein is a connector formed by a tab with at least one lateral projection adapted to fit and hold in a slit, or a slit for receiving that, cut into or as part of a sheet without further connection structure (i.e. without tape, adhesives, hook and/or loop, metal connector, etc.).

The term "thin flexible material" as used herein has the meaning, of around 0.10 mm to 1.0 mm in thickness and bendable without being brittle.

The term "top panel" (TP) as used herein has the meaning, a panel joined to a top edge of a back panel, comprising attachment means, and which, in use, is a portion of a sheet sized, shaped and positioned to sit towards the top of a wear's skull.

The term "trailing vertical edge" as used herein has the meaning, a free edge which is positioned away from the face of the wearer relative to the panel or other structure of which the edge is a part.

The term "wearer's" as used herein has the meaning, a human that is or can wear the headgear.

The term "visor" (V) as used herein has the meaning, a structure that is formed from the lower front panel, and which, in use is a structure worn in front of the face to protect a person's eyes. A visor may be clear or semi-transparent to allow a user to see through the visor. The term includes but is not limited to eye shades, glasses and goggles.

The invention may include any one or more articles or devices made by any of the claimed methods and/or may by different methods but with a claimed composition.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Webster's dictionaries and Random House dictionaries.

The following numbered clauses set out specific embodiments that may be useful in understanding the present invention:

1. Decorative headgear simulating the appearance of a helmet, comprising:
   a helmet sheet of thin flexible material, said helmet sheet being shaped to comprise:
   (a) a back panel (BP), said BP partially defined by a BP-right generally vertical edge and a BP-left vertical edge, wherein in two-dimensions said two BP vertical edges converge towards each other bottom to top;
   (b) a right panel (RP), wherein said RP in two-dimensions comprises:
      (i) a right rear sub-panel (RRSP), said RRSP integral with said BP below said BP-right generally vertical edge, said RRSP partially defined by a RRSP-leading generally vertical edge and a RRSP-trailing generally vertical edge, wherein said two RRSP vertical edges converge towards each other bottom to top; and,
      (ii) a right front sub-panel (RFSP), said RFSP integral with said RRSP below said RRSP-leading generally vertical edge, said RFSP partially defined by a RFSP-trailing vertical edge, wherein said RFSP trailing generally vertical edge diverges away from said RRSP-leading generally vertical edge bottom to top;
   (c) a left panel (LP), wherein said LP in two-dimensions comprises:
      (i) a left rear sub-panel (LRSP), said LRSP integral with said BP below said BP-left generally vertical edge, said LRSP partially defined by a LRSP-leading generally vertical edge and a LRSP-trailing generally vertical edge, wherein said two LRSP vertical edges converge towards each other bottom to top; and,
      (ii) a left front sub-panel (LFSP), said LFSP integral with said LRSP below said LRSP-leading generally vertical edge, said LFSP partially defined by a LFSP-trailing generally vertical edge, wherein said LFSP trailing vertical edge diverges away from said LRSP-leading generally vertical edge bottom to top; and,
   (d) a top panel (TP);
   (e) a front element comprising at least one of the group consisting of:
      (i) a visor (V) located in front of and above a wearer's eyes; and,
      (ii) a chin cover (CC) simulating racing helmet chin guard or a facemask, said CC running horizontally generally in front of a wearer's chin and defining a generally horizontal viewing opening for a wearer's eyes.

2. The headgear of clause 1, wherein said front element comprises both said V and said CC.

3. The headgear of clause 1 or 2 wherein said RFSP and said LFSP each have a cutout region partially defining lateral portions of a generally horizontal viewing opening for said wearer's eyes.

4. The headgear of any one of the preceding clauses, wherein said V is a sheet of thin flexible material separate from said helmet sheet, and wherein said V has at left and right sides thereof a slit/tab interface adapted for connection respectively with a slit/tab interface on said RFSP and with a slit/tab interface on said LFSP.

5. The headgear of any one of the preceding clauses, wherein said CC is a sheet of thin flexible material integral with one of said front side panels of said helmet sheet, and wherein said CC has a side slit/tab interface adapted for connection respectively with a slit/tab interface on an opposing front side panel.

6. The headgear of any one of the preceding clauses, and further comprising a transparent shield over said horizontal viewing opening.

7. The headgear of any one of the preceding clauses, wherein: (b)(i) said BP-right generally vertical edge and said RRSP-trailing generally vertical edge are each curvilinear, and when said headgear is assembled in three-dimensions has an edge variance not exceeding 10 millimeters; and, (c)(i) said BP-left generally vertical edge and said LRSP-trailing generally vertical edge are each curvilinear, and when said headgear is assembled in three-dimensions has an edge variance not exceeding 10 millimeters.

8. The headgear of any one of the preceding clauses, wherein: (b)(ii) said RRSP-leading generally vertical edge and said RFSP-trailing generally vertical edge are each curvilinear, and when said headgear is assembled in three-dimensions has an edge variance not exceeding 10 millimeters; and, (c)(ii) said LRSP-leading generally vertical edge and said LFSP-trailing generally vertical edge are each curvilinear, and when said headgear is assembled in three-dimensions has an edge variance not exceeding 10 millimeters.

9. The headgear of any one of the preceding clauses, wherein said TP is integral with only one of the group consisting of: BP, RRSP, RFSP, LRSP and LFSP.

10. The headgear of any one of the preceding clauses, wherein in three dimensions it is assembled without any metal connectors.

11. The headgear of any one of the preceding clauses, wherein said TP has four slit/tab interfaces respectively adapted for connection with slit/tab interfaces at upper portions of a remaining four of said group consisting of: BP, RRSP, RFSP, LRSP and LFSP with which said TP is not integral.

12. The headgear of any one of the preceding clauses, wherein said TP is generally circular and is integral with said BP.

13. The headgear of any one of the preceding clauses, wherein said BP has a neck panel (NP), said NP integral with said BP along a bottom of said BP, said NP partially defined by a folding line between said BP and said NP, wherein said NP is adapted to be folded inwardly and between said BP and a wearer's neck.

14. The headgear of any one of the preceding clauses, and further comprising a left integral tab (LIT) integral with said LRSP and a right integral tab (RIT) integral with said RRSP, said LIT and said MT each adapted to extend inwardly and between said BP and said NP.

15. The headgear of any one of the preceding clauses, and further comprising printed indicia comprising a racing sponsor logo, said printed indicia on at least said RP, LP or both.

16. The headgear of any one of the preceding clauses, wherein: (1) said RRSP-leading generally vertical edge and a RFSP-trailing vertical edge converge at generally round right side anti-stress riser hole; and, (2) said LRSP-leading generally vertical edge and a LFSP-trailing vertical edge converge at generally round left side anti-stress riser hole.

17. The headgear of any one of the preceding clauses, wherein said front element includes V and said V is a sheet of thin flexible material separate from said helmet sheet, and wherein said V has at left and right sides thereof a slit/tab interface adapted for connection respectively with a slit/tab interface on said RFSP and with a slit/tab interface on said LFSP.

18. The headgear of any one of the preceding clauses, wherein said front element includes CC and said CC is a sheet of thin flexible material integral with one of said front side panels of said helmet sheet, and wherein said CC has a side slit/tab interface adapted for connection respectively with a slit/tab interface on an opposing front side panel.

19. The headgear of any one of the preceding clauses, wherein said headgear simulates the appearance of a racing helmet.

20. Decorative headgear simulating the appearance of a helmet, comprising:

a helmet sheet of thin flexible material, said helmet sheet being shaped to comprise:

(a) a back panel (BP);

(b) a right panel (RP), comprising a right rear sub-panel (RRSP) and a right front sub-panel (RFSP); and, (c) a left panel (LP), comprising a left rear sub-panel (LRSP) and a left front sub-panel (LFSP); and, (d) a front element comprising at least one of the group consisting of:

(i) a visor (V) located in front of and above a wearer's eyes; and, (ii) a chin cover (CC) simulating racing helmet chin guard or a facemask, said CC running horizontally generally in front of a wearer's chin and defining a generally horizontal viewing opening for a wearer's eyes;

(e) a top panel (TP), wherein said TP is not integral with and has four slit/tab interfaces respectively adapted for connection with slit/tab interfaces at upper portions of said RRSP, RFSP, LRSP and LFSP.

21. The headgear of clause 20, wherein said front element comprises both said V and said CC.

22. The headgear of clause 20 or 21 wherein said RFSP and said LFSP each have a cutout region partially defining lateral portions of a generally horizontal viewing opening for said wearer's eyes.

23. The headgear of any one of clauses 20-22, wherein said front element comprises V and said V is a sheet of thin flexible material separate from said helmet sheet, and wherein said V has at left and right sides thereof a slit/tab interface adapted for connection respectively with a slit/tab interface on said RFSP and with a slit/tab interface on said LFSP.

24. The headgear of any one of clauses 20-23, wherein said front element comprise CC and said CC is a sheet of thin flexible material integral with one of said front side panels of said helmet sheet, and wherein said CC has a side slit/tab interface adapted for connection respectively with a slit/tab interface on an opposing front side panel.
25. The headgear of any one of clauses 20-24, wherein said headgear simulates the appearance of an American-football helmet.
26. A container made from a sheet of thin flexible material, comprising:
several pre-made cut lines in the sheet forming in whole or in part user wearable headgear removable from the sheet; and,
several pre-made fold lines in the sheet, said fold lines oriented to form said sheet into a container to hold other articles.
27. The container of clause 26 wherein said sheet includes first printed indicia on said wearable headgear identifying a sports entity, and wherein said sheet includes second printed indicia identifying said articles.
28. The container of clause 26 or 27 wherein said fold lines are oriented to form said sheet into a rectilinear box.
29. The container of any one of clauses 26-28 and further comprising adhesive, tabs cut in said sheet, or both to hold said sheet together to form the container.
30. The container of any one of clauses 26-29 wherein said sheet further includes several frangible lines forming in part said wearable headgear removable from said sheet by tearing said frangible lines.
31. The container of any one of clauses 26-30 wherein said sheet further includes several printed lines forming in part said wearable headgear removable from said sheet by cutting along said printed lines.
32. The container of any one of clauses 26-31 wherein said articles are beverage cans or bottles.
33. The container of any one of clauses 26-32 wherein said articles are beer cans or bottles.
34. The container of any one of clauses 26-33 wherein said first printed indicia comprises a sports team logo.
35. The container of any one of clauses 26-34 wherein said second printed indicia comprises a beverage logo.
36. The container of any one of clauses 26-35 wherein said wearable headgear simulating sports headgear, selected from the group comprising football, baseball, auto racing, motorcycle racing and hockey.
37. The container of any one of clauses 26-36 wherein said wearable headgear simulating non-sports headgear and further comprises headgear simulating headgear from a published movie, selected from the group comprising movie super-hero, villain, and science fiction character.
38. The container of any one of clauses 26-36 wherein said wearable headgear removable from said sheet of any one of claims 1-31 of U.S. patent application Ser. No. 14/551, 593, entitled DECORATIVE FOOTBALL HELMET, filed Nov. 24, 2014, and incorporated by reference herein.
39. The container of any one of clauses 26-36 wherein said wearable headgear removable from said sheet of any one of claims 1-35 of U.S. patent application Ser. No. 14/680, 368, entitled DECORATIVE HELMET, filed Apr. 7, 2015, and incorporated by reference herein.
40. The container of any one of clauses 26, 27, 29-39 wherein said fold lines are oriented to form said sheet into a box which is rectilinear when viewed from a top plan view and which is non-rectilinear and which taper inward at its top half when viewed from a side elevation view.
41. The container of any one of clauses 26-40 wherein said at least two of said pre-made cut lines in the sheet are curvilinear.
42. A container made from a sheet of thin flexible material, comprising:
several pre-made frangible lines in the sheet forming in whole or in part user wearable headgear removable from the sheet; and,
several pre-made fold lines in the sheet, said fold lines oriented to form said sheet into a container to hold other articles.
43. Headgear apparatus comprising a sheet of flexible material forming a top panel (TP) joined to a top edge of a back panel (BP), the back panel (BP) comprising a top edge, a right edge, a left edge and a bottom edge distal from the top edge, wherein the bottom edge extends further in a lateral direction than the top edge, the apparatus further comprising a right side panel (RP) extending from the right edge of the back panel (BP) and a left panel (LP) extending from the left edge of the back panel (BP), wherein the apparatus has an initial configuration and an erected configuration and includes attachment means arranged to attach the side panels to the top panel (TP) in only the erected configuration.
44. The apparatus according to clause 43, wherein the apparatus comprises one or more further left side panels extending from a left edge of the adjacent left side panel and one or more further right side panels extending from a right edge of the adjacent right side panel,
wherein the attachment means is arranged to attach the further side panels to the top panel in only the erected configuration.
45. The apparatus according to clause 43 or clause 44, wherein some or each side panels comprise a top edge, a right edge, a left edge and a bottom edge distal from the top edge, wherein the bottom edge extends further laterally than the top edge.
46. The apparatus according to any one of clauses 43-45, wherein side edges of all or some of the side panels and back panel are curved.
47. The apparatus according to any one of clauses 43-46, wherein the lateral distance between the left edge and right edge of some or all of the side panels and back panel is greatest at a line intermediate the top edge and the bottom edge of the respective panel, and optionally wherein the back panel either narrows between the line and the bottom edge, or remains the same width
48. The apparatus according to clause 47, wherein the, some or each side panel is joined to the adjacent side or back panel or panel only between the line of greatest lateral distance and the respective bottom edge.
49. The apparatus according to any one of clauses 43-48, wherein the back and side panels cooperate in the erected configuration to provide rigidity thereto.
50. The apparatus according to clause 49, wherein the cooperation is abutment and/or interference along the side edges.
51. The apparatus according to any one of clauses 43-50, wherein a lower back panel extends from the lower edge of the back panel, the lower back panel being arranged to fold back over surface of the back panel in the erected configuration.
52. The apparatus according to any one of clauses 43-51, wherein a lower front panel joins two side panels and/or is connected to a front panel (FP) in the erected configuration.

53. The apparatus according to clause 52, wherein the lower front panel extends from the bottom edge of the front panel or from one of the said two side panels joined in the erected configuration.
54. The apparatus according to any one of clauses 43-53, comprising the lower front panel independent of all other panels in the initial configuration and not part of the initial configuration.
55. The apparatus according to any one of clauses 43-54, wherein the initial configuration is substantially planar.
56. The apparatus according to clause 55, wherein the panels that are joined together in the initial configuration are joined along fold lines along the, or part of the, respective edges.
57. The apparatus according to any one of clauses 43-56, wherein the attachment means comprises a tab on one panel and a corresponding slit on another panel where the one panel and the another panel are to be joined in the erected configuration.
58. The apparatus according to clause 57, wherein the attachment means comprises a tab and corresponding slit for each panel joined only in the erected configuration.
59. The apparatus according to any one of clauses 43-58, wherein the erected configuration is three dimensional.
60. The apparatus according to any one of clauses 43-59, wherein the apparatus is configurable to return substantially to the initial configuration from the erected configuration.
61. The apparatus according to any one of clauses 43-60, wherein the top panel is substantially circular, ovoid, rectangular, pentagonal, hexagonal, heptagonal, octagonal, nonagonal, decagonal or other polygon.
62. The apparatus according to any one of clauses 43-61, wherein the top panel includes a front panel (FP) which may be integral therewith.
63. The apparatus according to any one of clauses 43-62, further comprising instructions that detail the actions to transfer the apparatus from the initial configuration to the erected configuration printed on to a surface of one of the panels.
64. The apparatus according to any one of clauses 43-63, wherein the apparatus in the erected configuration simulates an appearance selected from: a) a helmet;
b) sports headgear, wherein the sport is selected from the group comprising American football, baseball, motor-racing, motorcycle racing and ice-hockey; and/or
c) a fictional or non-fictional character.
65. The apparatus according to any one of clauses 43-64, wherein the apparatus is in the form of a single paper blank, except optionally the lower front panel may be a separate component.
66. The apparatus according to any one of clauses 43-65, wherein the sheet comprises paper or paper-based material such as carton board, which may be coated and/or printed.
67. A container comprising the apparatus of any one of clauses 43-66 in the initial configuration.
68. The container according to clause 67 comprising a foodstuff container and the headgear apparatus comprises part of the walls of the container.
69. The container according to clause 67 or clause 68, wherein the headgear apparatus is separable from the container.
70. A blank configurable to form the headgear apparatus according to any one of clauses 43 to 66.
71. A method for forming the erected configuration of the apparatus according to anyone of clauses 43 to 66, wherein the method comprises:
a) folding the back panel (BP) down in relation to the top panel (TP), and b) connecting each side panel to the top panel and/or the front panel in order to form the erected configuration.
72. The method according to clause 71, wherein the method further comprises the initial step of separating the apparatus from the rest of the container according to any one of clauses 67 to 70.
73. The method according to clause 71 or 72, wherein the apparatus is deployed from a blank according to clause 70.
74. Decorative headgear for a head of a wearer, comprising:
a sheet of flexible material, said sheet having boundary edges defining:
a back panel;
a right panel;
a left panel; and,
a top panel;
wherein said sheet is configurable from a first configuration that is substantially flat to a second configuration that is three-dimensional and defines a cavity arranged to receive the head of the wearer;
wherein at least one of said back panel, said right panel, said left panel, and said top panel defines a first slit/tab interface;
wherein said first slit/tab interface is spaced from a second slit/tab interface of said sheet in the first configuration and wherein said first slit/tab interface cooperates with said second slit/tab interface to hold adjacent panels of the sheet together in said second configuration;
wherein one of said first and second slit/tab interfaces includes a slit to receive a tab of the other slit/tab interface; and
wherein the tab is defined by a slit positioned within boundary edges of a panel portion the sheet.
75. The decorative headgear of clause 74, wherein said slit defining the tab has a continuous edge of sheet material extending therearound.
76. The decorative headgear of any one of clauses 74 or 75, wherein said slit defining the tab has ends spaced inward from a peripheral edge of said panel portion.
77. The decorative headgear of any one of clauses 74-76, wherein the tab defined by the slit has a first end hingedly coupled to the panel and a second end bordering said slit defining the tab and positionable out-of-plane with adjacent portions of the panel.
78. The decorative headgear of clause 77, wherein the second end of the tab is positioned inward of the first end of the tab relative to the panel portion.
79. The decorative headgear of any one of clauses 74-78, wherein said slit defining the tab is curved when said sheet is in said first configuration.
80. The decorative headgear of any one of clauses 74-79, wherein said slit to receive the tab is a linear slit.

While the invention has been illustrated and described in detail in the drawings and foregoing description, the same is to be considered as illustrative and not restrictive in character, it being understood that the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A decorative headgear apparatus simulating an appearance of a helmet, comprising:

a sheet of flexible material, said sheet configurable from an initial configuration to an erected configuration simulating the appearance of a helmet, the sheet in said initial configuration being shaped to comprise:

(a) a back panel, said back panel partially defined by a back-panel-right upwardly-extending edge and a back-panel-left upwardly-extending edge, wherein in said initial configuration said back-panel-right upwardly-extending edge and said back-panel-left upwardly-extending edge converge towards each other bottom to top;

(b) a right panel, wherein said right panel in said initial configuration comprises:

(i) a right rear sub-panel, said right rear sub-panel bordering said back panel below said back-panel-right upwardly-extending edge, said right rear sub-panel partially defined by a right-rear-sub-panel-leading upwardly-extending edge and a right-rear-sub-panel-trailing upwardly-extending edge, wherein said right-rear-sub-panel-leading upwardly-extending edge and said right-rear-sub-panel-trailing upwardly-extending edge converge towards each other bottom to top; and, (ii) a right front sub-panel, said right front sub-panel bordering said right rear sub-panel below said right-rear-sub-panel-leading upwardly-extending edge, said right front sub-panel partially defined by a right-front-sub-panel-trailing upwardly-extending edge, wherein said right-front-sub-panel-trailing upwardly-extending edge diverges away from said right-rear-sub-panel-leading upwardly-extending edge bottom to top;

(c) a left panel, wherein said left panel in said initial configuration comprises:

(i) a left rear sub-panel, said left rear sub-panel bordering said back panel below said back-panel-left upwardly-extending edge, said left rear sub-panel partially defined by a left-rear-sub-panel-leading upwardly-extending edge and a left-rear-sub-panel trailing upwardly-extending edge, wherein said left-rear-sub-panel-leading upwardly-extending edge and said left-rear-sub-panel-trailing upwardly-extending edge converge towards each other bottom to top; and (ii) a left front sub-panel, said left front sub-panel bordering said left rear sub-panel below said left-rear-sub-panel-leading upwardly-extending edge, said left front sub-panel partially defined by a left-front-sub-panel-trailing upwardly-extending edge, wherein said left-front-sub-panel trailing upwardly-extending edge diverges away from said left-rear-sub-panel-leading upwardly-extending edge bottom to top;

(d) a top panel, wherein in the erected configuration, the left panel and the right panel attach to the top panel; and (e) a front panel configured to be located above a wearer's eyes, the front panel comprising connectors configured to connect with complementary connectors of the right front sub-panel and the left front sub-panel, wherein in the erected configuration, the complementary connectors of the right front sub-panel and the left front sub-panel attach to the connectors of the front panel, wherein the connectors are integrally formed by the front panel and the complementary connectors are integrally formed by the right front sub-panel and the left front sub-panel, respectively, wherein the front panel borders the top panel in the initial configuration, and wherein the initial configuration is planar.

2. The decorative headgear apparatus according to claim 1, wherein the erected configuration is three dimensional.

3. The decorative headgear apparatus according to claim 1, wherein the apparatus is configurable to return to the initial configuration from the erected configuration.

4. The decorative headgear apparatus according to claim 1, wherein the top panel is circular, ovoid, rectangular, pentagonal, hexagonal, heptagonal, octagonal, nonagonal, decagonal or other polygon.

5. The decorative headgear apparatus according to claim 1, further comprising instructions that detail the actions to transfer the apparatus from the initial configuration to the erected configuration printed on to the sheet.

6. The decorative headgear apparatus according to claim 1, wherein in the erected configuration simulating the appearance of the helmet, the helmet simulates the appearance of sports headgear, of a fictional character, or of a non-fictional character.

7. The decorative headgear apparatus according to claim 1, wherein the apparatus is in the form of a single paper blank.

8. The decorative headgear apparatus according to claim 1, wherein the sheet comprises paper or paper-based material.

9. A container comprising the decorative headgear apparatus of claim 1.

10. The container according to claim 9, comprising a foodstuff container and the decorative headgear apparatus comprises part of walls of the container.

11. The container according to claim 9, wherein the decorative headgear apparatus is separable from the container.

12. A method for forming the erected configuration of the decorative headgear apparatus according to claim 1, wherein the method comprises: a) folding the back panel down in relation to the top panel, and b) connecting each side panel to at least one of the top panel or the front panel in order to form the erected configuration.

13. The method according to claim 12, wherein the method further comprises an initial step of separating the decorative headgear apparatus from a remainder of a container.

14. The decorative headgear apparatus according to claim 1, wherein the connectors are configured as one of a slit or a tab and the complementary connectors are configured as the other of the slit or the tab.

15. The apparatus according to claim 14, wherein the top panel comprises connectors configured to connect to complementary connectors of each of the right rear sub-panel, the right front sub-panel, left rear sub-panel, and left front sub-panel, and wherein the connectors are integrally formed by the top panel and the complementary connectors are integrally formed by the right rear sub-panel, the right front sub-panel, the left rear sub-panel, and the left front sub-panel, respectively.

16. The apparatus according to claim 15, wherein the connectors of the top panel are configured as one of a slit or a tab and the complementary connectors of the right rear sub-panel the right front sub-panel the left rear sub-panel, and the left front sub-panel are configured as the other of the slit or the tab.

* * * * *